US006400344B1

(12) United States Patent
Tsunoda et al.

(10) Patent No.: US 6,400,344 B1
(45) Date of Patent: Jun. 4, 2002

(54) DEVICE AND METHOD FOR DRIVING ADDRESS ELECTRODE OF SURFACE DISCHARGE TYPE PLASMA DISPLAY PANEL

(75) Inventors: Yoshikazu Tsunoda; Akihiko Iwata; Takahiro Urakabe; Takashi Hashimoto; Jun Someya; Takahito Nakanishi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/445,442

(22) PCT Filed: Apr. 13, 1998

(86) PCT No.: PCT/JP98/01701

§ 371 (c)(1),
(2), (4) Date: Dec. 13, 1999

(87) PCT Pub. No.: WO99/53470

PCT Pub. Date: Oct. 21, 1999

(51) Int. Cl.[7] ..... G09G 3/28; G09G 5/00

(52) U.S. Cl. ..... 345/60; 345/67; 345/68; 345/69; 345/211

(58) Field of Search ..... 345/60–63, 67–69, 345/211

(56) References Cited

U.S. PATENT DOCUMENTS

| | | | | |
|---|---|---|---|---|
| 4,492,957 A | * | 1/1985 | Marentic | 345/211 |
| 5,654,728 A | * | 8/1997 | Kanazawa et al. | 315/169.4 |
| 5,760,753 A | * | 6/1998 | Hayashi | 345/100 |
| 6,023,258 A | * | 2/2000 | Kuriyama et al. | 345/208 |
| 6,072,447 A | * | 6/2000 | Noborio | 345/60 |

* cited by examiner

*Primary Examiner*—Richard Hjerpe
*Assistant Examiner*—Duc Q Dinh
(74) *Attorney, Agent, or Firm*—Oblon, Spivak, McClelland, Maier & Neustadt, P.C.

(57) ABSTRACT

The present invention relates to a technique for driving a surface discharge type plasma display panel, and more particularly, it is an object of the present invention to freely perform setting without increasing a rating required for an IC having an address driver when a high voltage is to be output from an address electrode for a priming discharge period and a sustain discharge period. In order to attain the above-mentioned object, if the same voltage is simultaneously output to all address electrodes switches are turned off and on in a circuit respectively and a cathode of a diode and an anode of a diode are conducted. Then, the switches are forcedly turned off and on, respectively. In a circuit switches are turned on and off respectively and a voltage Va2 is substantially applied to all the address electrodes through the diode.

20 Claims, 56 Drawing Sheets

DEVICE AND METHOD FOR DRIVING ADDRESS ELECTRODE OF SURFACE DISCHARGE TYPE PLASMA DISPLAY PANEL

TECHNICAL FIELD

The present invention relates to a surface discharge type plasma display panel and more particularly to a technique for driving an address electrode thereof.

DISCUSSION OF THE BACKGROUND

FIG. 56 is a circuit diagram showing a state of address electrode driving of a surface discharge type plasma display panel. Scan electrodes X and $Y_k$ intersect an address electrode $A_j$ for one display cell $C_{jk}$ of the surface discharge type plasma display panel (j, k=1, 2 . . . ).

In such a surface discharge type plasma display panel, there has conventionally been proposed a technique that a negative pulse is not given to the scan electrode $Y_k$ but a great positive pulse is given to the address electrode $A_j$ when performing a so-called "priming discharge" in which a history in the display cell $C_{jk}$ is erased and a space charge is left. The reason is that a positive pulse can be generated more simply and easily than a negative pulse.

A high voltage generating circuit AD1 and an address drive circuit AD2 for switching an output of the high voltage generating circuit AD1 or a ground potential and for outputting the same to the address electrode $A_j$ are provided corresponding to the address electrode $A_j$. The address drive circuit AD2 comprises switches SW3 and SW4 which are connected in series between the output of the high voltage generating circuit AD1 and the ground potential, and diodes D3 and D4 connected in parallel with the switches SW3 and SW4 respectively.

The scan electrode X is provided with a drive circuit SD3 for generating a voltage to be applied to the scan electrode X. Furthermore, a scanning drive circuit SD1 and a switch circuit SD2 for switching an output of the scanning drive circuit SD1 or a ground potential and for outputting the same to each scan electrode $Y_k$ are provided corresponding to the scan electrode $Y_k$.

Such a structure has been described in Japanese Patent Laid-open No. P07-160218A, for example, in which the high voltage generating circuit AD1 and the address drive circuit AD2 are indicated as the reference numerals 233*a* and 233*bj,* respectively.

To the address electrode $A_j$ are respectively applied a voltage Vaw for a priming discharge for write preparation ("a reset period" described in the Japanese Patent Laid-open No. P07-160218A), a voltage Va for a write discharge ("an address period" described in the Japanese Patent Laid-open No. P07-160218A) and a voltage Vaw for a sustain discharge period ("a sustain discharge period" described in the Japanese Patent Laid-open No. P07-160218A).

For the reset period and the sustain discharge period, a switch SW2 of the high voltage generating circuit AD1 is turned off and a switch SW1 thereof is turned on so that a voltage Vas supported by a Zener diode is added to the voltage Va supplied from a power source and a voltage Vaw(=Va+Vas) is output from the high voltage generating circuit AD1. Then, the switches SW4 and SW3 of the address drive circuit AD2 for all the address electrodes $A_j$ are turned off and on, respectively. Consequently, the voltage Vaw is supplied to all the address electrodes $A_j$.

However, a rated voltage of an IC constituting the high voltage generating circuit AD1 and the address drive circuit AD2 should be set equal to or higher than a maximum value of a voltage to be used in the above-mentioned procedure. For this reason, the rated voltage of the IC should be equal to or higher than the voltage Vaw(=Va+Vas) which is higher than the voltage Va required for the write discharge and is required for the sustain discharge period.

More specifically, an IC having a high breakdown voltage is required to output a high voltage for the reset period and the sustain discharge period. As a result, a cost is increased. Moreover, since the voltages to be output for the reset period and the sustain discharge period are also influenced by the performance of the IC, a value thereof is limited.

In a conventional method, furthermore, in the case where the switch SW3 on a high arm of the address drive circuit AD2 is turned on to output "H" for the write discharge period, a current sometimes flows into the address electrode $A_j$ in a suction direction by the output of the scan electrodes X and $Y_k$.

FIG. 57 is a circuit diagram showing, in detail, a structure of the address drive circuit AD2 illustrated in FIG. 56, in which the display cell $C_{jk}$ is replaced by an electrically equivalent circuit. There exists an equivalent capacitor CP between the scan electrode $Y_k$ and the address electrode $A_j$. Similarly, the equivalent capacitors exist between the scan electrode X and the address electrode $A_j$ and between the scan electrode X and the scan electrode $Y_k$. The switches SW3 and SW4 of the address drive circuit AD2 are implemented by MOS transistors T1 and T2, respectively.

The address drive circuit AD2 gives "H" to the address electrode $A_j$ so that the equivalent capacitor CP is charged. With such charging kept, switches SW5 and SW6 are turned on and off in the switch circuit SD2 for the sustain discharge period, respectively. When the voltage of the scan electrode $Y_k$ is changed to "H", the electric potential of the address electrode $A_j$ tries to perform step-up by the equivalent capacitor CP. At this time, the diode D3 of the address drive circuit AD2 causes a current to flow to the power source side for supplying the electric potential Va, thereby preventing the step-up of the voltage.

In this case, if the MOS, transistors T1 and T2 constituting the address drive circuit AD2 are not formed by using a dielectric isolating method but a self-isolating technique, a parasitic transistor is generated. Consequently, the following problem arises.

FIG. 58 is a sectional view showing structures of the MOS transistors T1 and T2 formed by using the self-isolating technique. A PNP transistor T3 is parasitic on the PMOS transistor T1, and a base current of the parasitic transistor flows with a rise in the electric potential of the address electrode $A_j$. Consequently, a short-circuit current 12 flows from the power source for supplying the electric potential Va to a ground through the transistors T1 and T3. Therefore, there is a possibility that the address drive circuit AD2 might be subjected to a thermal breakdown.

SUMMARY OF THE INVENTION

A first aspect of an address electrode driving apparatus for driving an address electrode for a surface discharge type plasma display panel having a plurality of scan electrodes, a plurality of address electrodes which are orthogonal to the scan electrodes, and a display cell formed on each of intersecting points of the scan electrodes and the address electrodes, in accordance with the present invention, is that the apparatus comprises a plurality of drive circuits including a first number of output stages, each output stage having an output terminal provided corresponding to each of the address electrodes and connected thereto, and a first input terminal and a second input terminal, one of which is selectively connected to the output terminal, a first power control circuit for supplying, to the second input terminal, one of a reference potential and a first electric potential which is higher than the reference potential, and a second power control circuit for supplying, to the first input terminal, a second electric potential which is lower than the first electric potential and is higher than the reference potential or connecting the first input terminal to the second input terminal.

A second aspect of the address electrode driving apparatus in accordance with the present invention is that the apparatus of the first aspect further comprises a control circuit for outputting drive data which serves to set the output terminal of the drive circuit to be connected to the first input terminal or the second input terminal, and a plurality of transmitting circuits provided corresponding to each of the address electrodes for transmitting the drive data for the corresponding address electrodes. Each of the transmitting circuits includes a first buffer having an input terminal for inputting the drive data and an output terminal for transmitting the drive data, being connected to a first reference potential point for supplying the reference potential and a first electric potential point for supplying a first source potential which is higher than the reference potential and is lower than the second electric potential, and receiving operating power therefrom, a capacitor having one of terminals connected to the output terminal of the first buffer and the other terminal, and a second buffer having an input terminal connected to the other terminal of the capacitor and an output terminal connected to a corresponding one of the drive circuits, being connected to the second input terminal and a second electric potential point, and receiving operating power therefrom.

A third aspect of the address electrode driving apparatus in accordance with the present invention is that in the apparatus of the second aspect, each of the drive circuits further includes a protective diode having a cathode connected to a corresponding one of the address electrodes and an anode connected to the second input terminal.

A fourth aspect of the address electrode driving apparatus in accordance with the present invention is that the apparatus of the third aspect further comprises a third electric potential point to be connected to one of a fourth electric potential point to which a second source potential is supplied and the second input terminal. Each of the transmitting circuits further includes a first diode having an anode connected to the first reference potential point and a cathode connected to the terminal of the capacitor, and a second diode having an anode connected to the other terminal of the capacitor and a cathode connected to the third electric potential point, and the second buffer further includes a protective diode having a cathode connected to the other terminal of the capacitor and an anode connected to the second input terminal.

A fifth aspect of the address electrode driving apparatus in accordance with the present invention is that in the apparatus of the fourth aspect, the second electric potential point is the third electric potential point.

A sixth aspect of the address electrode driving apparatus in accordance with the present invention is that in the apparatus of the fourth aspect, the second electric potential point is the fourth electric potential point.

A seventh aspect of the address electrode driving apparatus in accordance with the present inventions is that in the apparatus of the fourth aspect, each of the transmitting circuits further includes a third diode having an anode connected to the terminal of the capacitor and a cathode connected to the first electric potential point.

An eighth aspect of the address electrode driving apparatus in accordance with the present invention is that in the apparatus of the seventh aspect, the second electric potential point is the third electric potential point.

A ninth aspect of the address electrode driving apparatus in accordance with the present invention is that in the apparatus of the seventh aspect, the second electric potential point is the fourth electric potential point.

A tenth aspect of the address electrode driving apparatus in accordance with the present invention is that in the apparatus of the fourth aspect, the first buffer further includes a protective diode having an anode connected to the terminal of the capacitor and a cathode connected to the first electric potential point.

An eleventh aspect of the address electrode driving apparatus in accordance with the present invention is that the apparatus of the fourth aspect further comprises a diode having an anode connected to the fourth electric potential point and a cathode, and a capacitor connected between the cathode of the diode and a second reference potential point acting as a reference of a second source potential to be applied to the fourth electric potential point. The third electric potential point is connected to the fourth electric potential point through the diode.

A twelfth aspect of the address electrode driving apparatus in accordance with the present invention is that the apparatus of the second aspect further comprises a control circuit for outputting drive data which serves to set the output terminal of the drive circuit to be connected to the first input terminal or the second input terminal, and a plurality of transmitting circuits provided corresponding to each of the address electrodes for transmitting the drive data for the corresponding address electrodes. Each of the transmitting circuits includes a first buffer having an input terminal for inputting the drive data and an output terminal for transmitting the drive data, being connected to a first reference potential point for supplying the reference potential and a first electric potential point for supplying a first source potential which is higher than the reference potential and is lower than the second electric potential, and receiving operating power therefrom, a diode having an anode connected to the output terminal of the first buffer and a cathode, and a second buffer having an input terminal connected to the cathode of the diode and an output terminal connected to a corresponding one of the drive circuits, being connected to the second input terminal and a second electric potential point, and receiving operating power therefrom.

A thirteenth aspect of the address electrode driving apparatus in accordance with the present invention is that in the apparatus of the twelfth aspect, each of the transmitting circuits further includes a resistor provided between the cathode of the diode and the second input terminal.

A fourteenth aspect of the address electrode driving apparatus in accordance with the present invention is that in the apparatus of the second aspect, the drive circuits further include a second number of data input terminals for inputting the second number of drive data, and the second number of data output terminals for shifting out data given to the data input terminals, and a third number of drive circuits make a set and are connected in series with respect to the data input terminals and the data output terminals.

A fifteenth aspect of the address electrode driving apparatus in accordance with the present invention is that in the apparatus of the fourteenth aspect, the set of drive circuits have a timing in which the drive data is shifted out from the data input terminal to the data output terminal and a timing in which the drive data given to the data input terminal is latched, the timings being divided into two classes which are different from each other.

A sixteenth aspect of the address electrode driving apparatus in accordance with the present invention is that in the apparatus of the first aspect, the surface discharge type plasma display panel further includes a plurality of other scan electrodes which are orthogonal to the address electrodes, and a predetermined electric potential is applied to the other scan electrodes through a pair of diodes connected in antiparallel with each other.

A first aspect of an address electrode driving method in accordance with the present invention is that the method is applied to a plasma display system comprising a surface discharge type plasma display panel including a plurality of scan electrodes, a plurality of address electrodes which are orthogonal to the scan electrodes, and a display cell formed on each of intersecting points of the scan electrodes and the address electrodes, a plurality of drive circuits including a first number of output stages, each output stage having an output terminal provided corresponding to each of the address electrodes and connected thereto, and a first input terminal and a second input terminal, one of which is selectively connected to the output terminal, a plurality of drive circuits provided corresponding to the address electrodes, each of which has an output terminal connected to a corresponding one of the address electrodes and a first input terminal and a second input terminal, one of which is selectively connected to the output terminal, a control circuit for outputting drive data which serves to set the output terminal of the drive circuit to be connected to the first input terminal or the second input terminal, a first power control circuit for supplying, to the second input terminal, one of a reference potential and a first electric potential which is higher than the reference potential, a second power control circuit for supplying, to the first input terminal, a second electric potential which is lower than the first electric potential and is higher than the reference potential, or for connecting the first input terminal to the second input terminal, a first buffer having an input terminal provided corresponding to each of the address electrodes for inputting the drive data for the corresponding address electrodes, an output terminal for transmitting the drive data, and an output stage having a push-pull structure which is connected in series between a first reference potential point for supplying the reference potential and a first electric potential point for supplying a first source potential which is higher than the reference potential and is lower than the second electric potential, a capacitor having one of terminals connected to the output terminal of the first buffer and the other terminal, a second buffer having an input terminal connected to the other terminal of the capacitor, an output terminal connected to a corresponding one of the drive circuits, and an input stage having a push-pull structure which is connected in series between the second input terminal and a second electric potential point, a first diode having an anode connected to the first reference potential point and a cathode connected to the terminal of the capacitor, and a second diode having a cathode connected to the second electric potential point and an anode connected to the other terminal of the capacitor. The method comprises the steps of (a) for a write preparation period, (a-1) connecting the second electric potential point to the second input terminal, (a-2) connecting the first input terminal to the second input terminal by the second power control circuit, and (a-3) supplying the first electric potential to the second input terminal by the first power control circuit, and then supplying the reference potential, (b) for a write discharge period, (b-1) connecting the second input terminal to the first reference potential point by the first power control circuit, (b-2) supplying the first source potential to the second electric potential point, (b-3) supplying the second electric potential to the first input terminal by the second power control circuit, and (b-4) connecting an output terminal of each of the drive circuits to one of the first input terminal and the second input terminal based on the drive data, and (c) after the write discharge period and before a sustain discharge period, (c-1) connecting the second input terminal to the first reference potential point by the first power control circuit, (c-2) connecting the second electric potential point to the second input terminal, (c-3) connecting the first input terminal to the second input terminal by the second power control circuit, and (c-4) forcedly setting the drive data to a reference potential.

A second aspect of the address electrode driving method in accordance with the present invention is that the method of the first aspect further comprises the step of (a-4) forcedly setting the drive data to "H" prior to the step (a-3) for the write preparation period.

A third aspect of the address electrode driving method in accordance with the present invention is that the method of the second aspect further comprises the step of (d) forcedly setting the drive data to "L" after the write preparation period and before the write discharge period.

A fourth aspect of an address electrode driving method in accordance with the present invention is that the method is applied to a plasma display system comprising a surface discharge type plasma display panel including a plurality of scan electrodes, a plurality of address electrodes which are orthogonal to the scan electrodes, and a display cell formed on each of intersecting points of the scan electrodes and the address electrodes, a plurality of drive circuits including an output terminal provided corresponding to each of the address electrodes and connected to a corresponding one of the address electrodes, and a first input terminal and a second input terminal, one of which is selectively connected to the output terminal, a control circuit for outputting drive data which serves to set the output terminal of the drive circuit to be connected to the first input terminal or the second input terminal, a first power control circuit for supplying one of a reference potential and a first electric potential which is higher than the reference potential to the second input terminal, and a second power control circuit for supplying, to the first input terminal, a second electric potential which is lower than the first electric potential and is higher than the reference potential or connecting the first input terminal to the second input terminal, a first buffer having an input terminal provided corresponding to each of the address electrodes for inputting the drive data for the corresponding address electrodes, an output terminal for transmitting the drive data, and an output stage having a push-pull structure which is connected in series between a first reference potential point for supplying the reference potential and a first electric potential point for supplying a first source potential that is higher than the reference potential and is lower than the second electric potential, a diode having an anode connected to the output terminal of the first buffer and a cathode, a second buffer having an input terminal connected to the cathode of the diode, an output terminal connected to a corresponding one of the drive circuits, and an input stage having a push-pull structure which is connected in series between the second input terminal and a second electric potential point, and a resistor connected to the second input terminal and the input terminal of the second buffer. The method comprises the steps of (a) for a write preparation period, (a-1) connecting the first input terminal to the second input terminal by the second power control circuit, and (a-2) supplying the first electric potential to the second input terminal by the first power control circuit, and then supplying the reference potential, (b) for a write discharge period, (b-1) connecting the second input terminal to the first reference potential point by the first power control circuit, (b-2) supplying the second electric potential to the first input terminal by the second power control circuit, and (b-3) connecting the output terminals of the drive circuits to one of the first input terminal and the second input terminal based on the drive data, and (c) after the write discharge period and before a sustain discharge period, (c-1) connecting the second input terminal to the first reference potential point by the first power control circuit, and (c-2) connecting the first input terminal to the second input terminal by the second power control circuit.

According to the first aspect of the address electrode driving apparatus in accordance with the present invention, the first power control circuit can supply the reference potential to the second input terminal, and the second power control circuit can supply the first electric potential to the first input terminal. By selectively connecting the output terminal to the first input terminal or the second input terminal in the drive circuit, therefore, a write discharge can be performed for the address electrode in a desirable pattern. On the other hand, the first power control circuit supplies the first electric potential to the second input terminal and the second power control circuit connects the first input terminal to the second input terminal and short-circuits the second input terminal and the output terminal of the drive circuit. Consequently, it is possible to supply the second electric potential to all the address electrodes at once without requiring a breakdown voltage for the second electric potential in the drive circuit. Thus, a self-erase discharge for write preparation can be performed.

According to the second aspect of the address electrode driving apparatus in accordance with the present invention, two buffers for transferring the drive data are employed. The first buffer is isolated from the second input terminal of the drive circuit by the capacitor. Accordingly, even if the first power control circuit supplies the first electric potential to the second input terminal of the drive circuit, the first buffer is isolated from the first electric potential. Consequently, the control circuit can also be protected.

According to the third aspect of the address electrode driving apparatus in accordance with the present invention, in the case where the first electric potential is applied to the second input terminal, it is given to the address electrode through the protective diode. Consequently, the self-erase discharge can be caused.

According to the fourth to sixth aspects of the address electrode driving apparatus in accordance with the present invention, the capacitor charged by application of the first electric potential to the second input terminal can be discharged by supplying the reference potential to the second input terminal and connecting the third electric potential point to the second input terminal by means of the first power control circuit. At the time of the write discharge, even if the first buffer is changed between "L" and "H", the charge and discharge of the capacitor can be quickly performed by supplying the reference potential to the second input terminal and connecting the fourth electric potential point to the third electric potential point by means of the first power control circuit. Therefore, the drive data can be transmitted to the second buffer. Furthermore, after the write discharge is completed, the first power control circuit supplies the reference potential to the second input terminal and connects the first reference potential point to the third electric potential point, thereby discharging the capacitor whether the first buffer outputs "L" to charge the capacitor or outputs "H" to charge the capacitor. Consequently, a sustain discharge is not affected.

According to the seventh to tenth aspects of the address electrode driving apparatus in accordance with the present invention, in the case where the first electric potential is to be applied to the address electrode, the first buffer can be protected from the step-up of a voltage caused by the capacitor even if the first buffer is caused to output "H" in order to rapidly rise.

According to the twelfth aspect of the address electrode driving apparatus in accordance with the present invention, the electric potential which is lower than the second source potential by a forward voltage of the diode is applied to the third electric potential point. Therefore, the capacitor is not charged based on the forward voltage of the second diode of the transmitting circuit.

According to the twelfth aspect of the address electrode driving apparatus in accordance with the present invention, two buffers for transferring the drive data are employed. Even if the first electric potential is applied to the second input terminal, the diode is reversibly biased. Therefore, the first buffer is isolated from the first electric potential. Consequently, the control circuit can also be protected.

According to the thirteenth aspect of the address electrode driving apparatus in accordance with the present invention, even if H" is input to the first buffer and the diode is forward biased to cause a forward current to flow when the self-erase discharge is completed, a magnitude of the forward current can be limited by the resistor and the first buffer can be protected from a fluctuation in the electric potential of the second input terminal. Furthermore, if the drive data is changed from "H" to "L" for the write discharge period, electric charges held in an input capacity of the second buffer can be discharged through the resistor.

According to the fourteenth aspect of the address electrode driving apparatus in accordance with the present invention, since it is sufficient that the transmitting circuit transmits the drive data every third number, a structure thereof can be simplified.

According to the fifteenth aspect of the address electrode driving apparatus in accordance with the present invention, since it is sufficient that the transmitting circuit transmits the drive data every 2×the third number of output circuits, a structure thereof can further be simplified.

According to the sixteenth aspect of the address electrode driving apparatus in accordance with the present invention, the electric potential of the other scan electrode is not raised above a predetermined electric potential even if it tries to perform step-up by an equivalent capacitor in the display cell.

According to the first aspect of the address electrode driving method in accordance with the present invention, by the function of the capacitor, the second electric potential can be applied to all the address electrodes at once for the write preparation period without requiring a breakdown voltage for the second electric potential in the drive circuit. Consequently, a self-erase discharge can be performed. The capacitor charged by a write discharge is discharged by the output stage of the first buffer and the second diode or by the input stage of the second buffer and the first diode at the step (c) before the sustain discharge period.

According to the second aspect of the address electrode driving method in accordance with the present invention, the capacitor can be charged in advance to raise an electric potential on the other terminal above an electric potential on the one of terminals. Therefore, it is possible to enhance a speed at which the second input terminal can rise to the first electric potential at the step (a-3).

According to the third aspect of the address electrode driving method in accordance with the present invention, the capacitor charged at the step (a-4) is discharged. Consequently, it is possible to avoid affecting the write discharge period.

According to the fourth aspect of the address electrode driving method in accordance with the present invention, by the function of the diode, the second electric potential can be supplied to all the address electrodes at once for the write preparation period without requiring a breakdown voltage for the second electric potential in the drive circuit. Consequently, the self-erase discharge can be performed. By the function of the resistor, a current flowing in the first buffer means is suppressed if the drive data is changed from "L" to "H" for the write discharge period, and electric charges stored in the input stage of the second buffer are discharged when the drive data is changed from "H" to "L".

In order to solve the above-mentioned problems, it is an object of the present invention to freely set a high voltage output for a priming discharge period and a sustain discharge period without increasing a rating required for an IC having an address driver.

DESCRIPTION OF THE PREFERRED EMBODIMENTS

Figure 1:
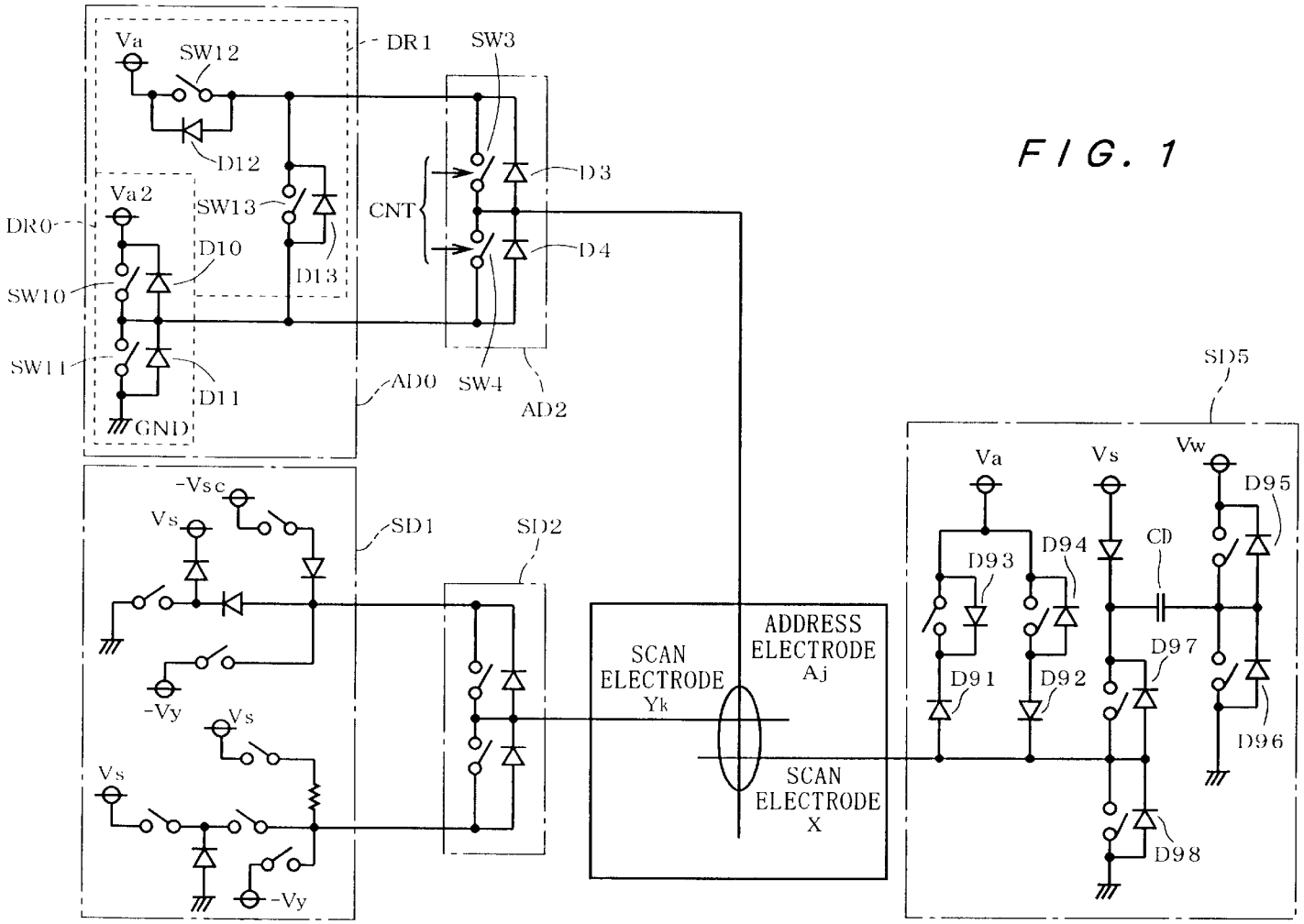
FIG. 1 is a circuit diagram illustrating a basic thought of the present invention.
Figure 56:
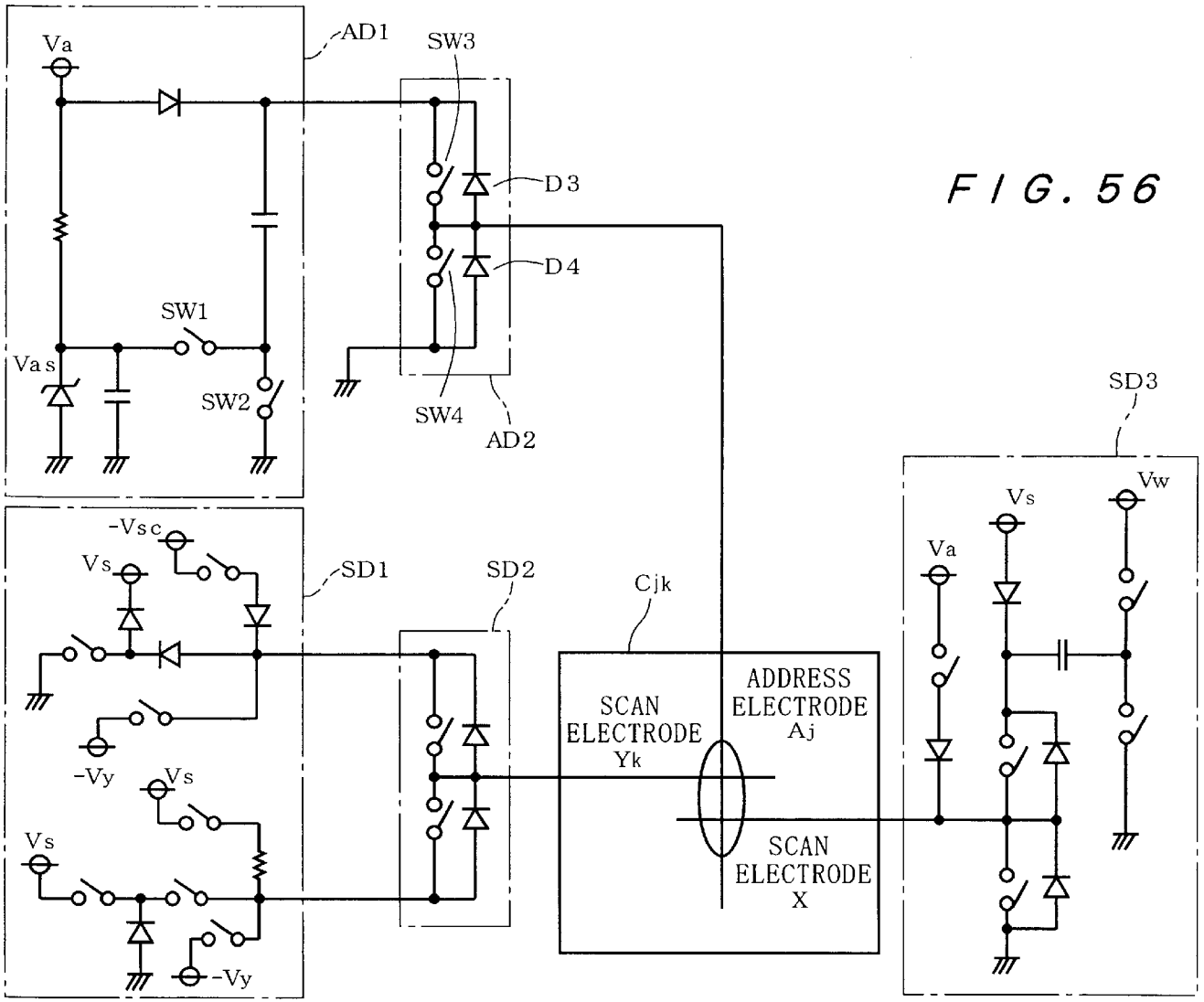
FIGS. 56 and 57 are circuit diagrams showing the prior art.

Prior to description of the best mode, the technique of the present invention will be described briefly. FIG. 1 is a circuit diagram illustrating a basic thought of the present invention. The high voltage generating circuit AD1 and the drive circuit SD3 in the structure shown in FIG. 56 are replaced by a high voltage generating circuit AD0 and a drive circuit SDS, respectively.

The high voltage generating circuit AD0 includes power control circuits DR0 and DR1. The power control circuit DR0 has switches SW10 and SW11 and diodes DR10 and D11, and the power control circuit DR1 has switches SW12 and SW13 and diodes D12 and D13.

The diode D13 has a cathode connected to a cathode of a diode D3 on a high arm side of an address drive circuit AD2, and an anode connected to an anode of a diode D4 on a low arm side of the address drive circuit AD2. The switch SW13 is connected in parallel with the diode D13. The diode D12 has an anode connected to the cathode of the diode D3, and a cathode to which an electric potential Va is applied. The switch SW12 is connected in parallel with the diode D12.

The diode D10 has a cathode to which an electric potential Va2 is applied, and an anode connected to the anode of the diode D4 and a cathode of the diode D11. The diode D11 has an anode to which a ground potential is applied. The switches SW10 and SW11 are provided in parallel with the diodes D10 and D11, respectively.

With a write discharge in which a voltage is output to an address electrode $A_j$ based on individual drive data, the switches SW12 and SW13 are turned on and off in the circuit DR1 respectively, and a write discharge voltage Va is applied to the cathode of the diode D3 of the address drive circuit AD2. On the other hand, the switches SW10 and SW11 are turned off and on in the circuit DR0 respectively, and the ground potential is applied to the anode of the diode D4 of the address drive circuit AD2. Such an electric potential is applied to both terminals of the address drive circuit AD2. Therefore, the discharge voltage Va is applied to the address electrode $A_j$ when switches SW3 and SW4 are turned on and off, respectively. And the ground potential is applied to the address electrode $A_j$ when switches SW3 and SW4 are turned off and on, respectively.

For a reset period and a sustain discharge period in which the same voltage is output to all address electrodes at the same time, the switches SW12 and SW13 are turned off and on respectively to cause the cathode of the diode D3 and the anode of the diode D4 to be conducted. In this sequence, the switches SW3 and SW4 are forcedly turned off and on, respectively. In the circuit DR0, if the switches SW10 and SW11 are turned on and off respectively, the voltage Va2 is applied to the anode of the diode D4 and is substantially applied to all the address electrodes through the diode D4. Furthermore, in the case where the switches SW10 and S11 are turned off and on respectively, electric charges stored in all the address electrodes are discharged to the switch SW11 through the switch SW4, the switch SW13 and the diode D3.

By the above-mentioned operation, a rating of an IC having the address drive circuit AD2 which withstands the write discharge voltage Va is enough and the high voltage Va2 for the priming discharge period and the sustain discharge period can freely be set.

For the sustain discharge period, even if a voltage of a scan electrode $Y_k$ is changed to "H" with an equivalent capacitor CP charged, a recovery current does not flow into the diodes D3 and D4 because they are short-circuited. Furthermore, even if a parasitic transistor T3 is present in an NMOS transistor which implements the switch SW4, a current I2 shown in FIG. 57 does not flow because a collector and an emitter are short-circuited.

More specifically, if a power source to be supplied to the address drive circuit AD2 is substantially removed, the generation of the short-circuit current I2 can be avoided to prevent the breakdown of the IC. Therefore, an IC using a self-isolating technique can also be utilized. In other words, a reduction in a voltage is realized to widely choose the IC. Therefore, a cost can be reduced.

It is necessary to transmit, at a high speed, a control signal CNT for controlling the switches SW3 and SW4, for example, drive data corresponding to each address electrode $A_j$. The drive data is given from a predetermined control circuit. In the case where the voltage Va2 is applied to the anode of the diode D4, it is necessary to protect the control circuit.

Even if the control circuit and the voltage Va2 are isolated from each other by a photocoupler in a conventional manner, no trouble is caused in respect of operation. In a high-speed address drive circuit having a large number of signal lines, however, a high-speed photocoupler should be used and furthermore, a large number of drive data segments are required. Therefore, a reduction in the cost is impeded very greatly. Therefore, the present invention has used a comparatively inexpensive capacitor for isolation.

In this case, the charge and discharge of the capacitor for isolation influences a transfer delay of the drive data. For this reason, the present invention comprises a diode for rapidly performing the charge and discharge of the capacitor. Moreover, the present invention also provides a technique related to a sequence for discharging the capacitor.

In order to relieve the transfer delay of the drive data, furthermore, the present invention also provides an isolation technique using a diode in place of the capacitor.

Figure 57:
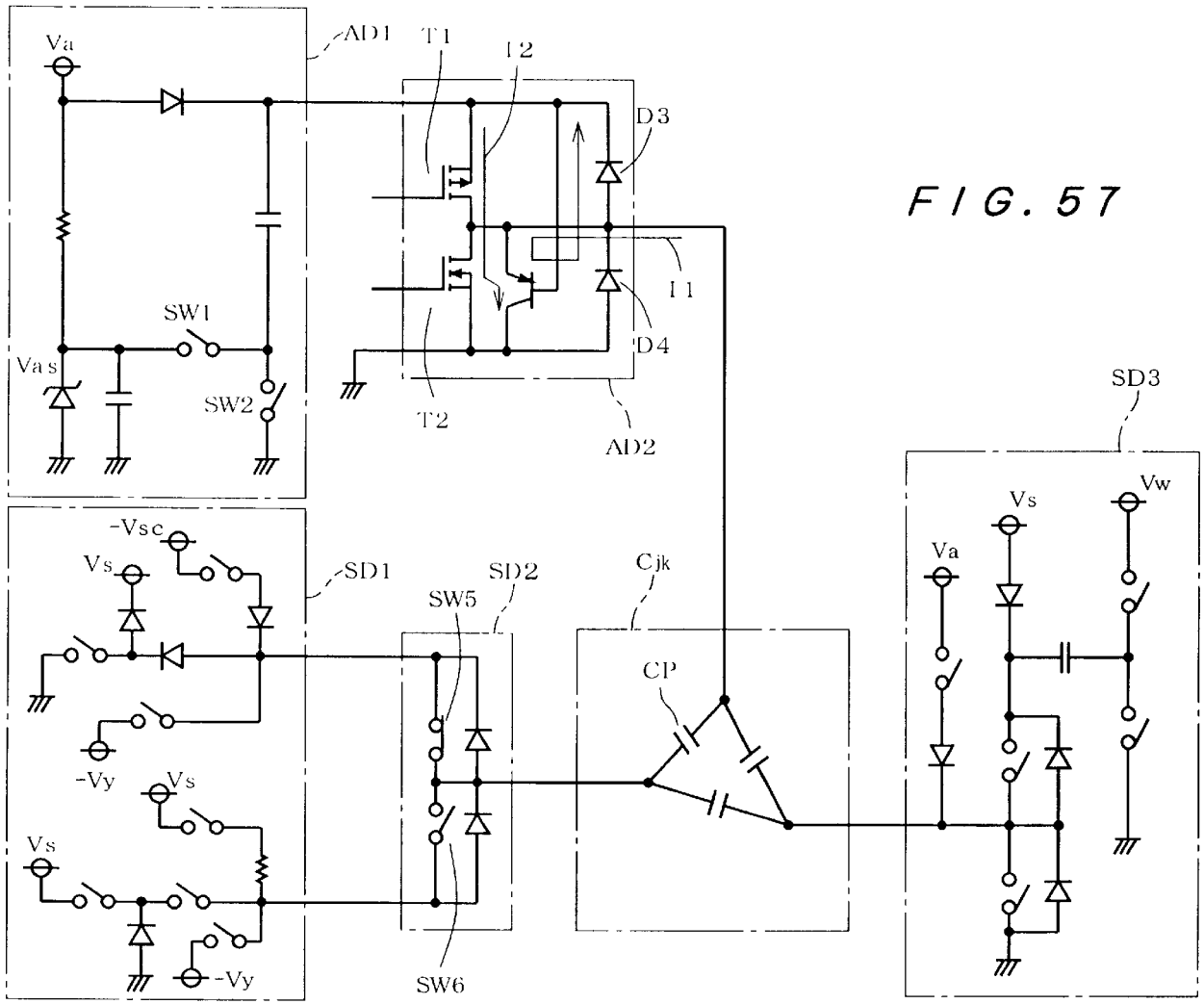
Figure 58:
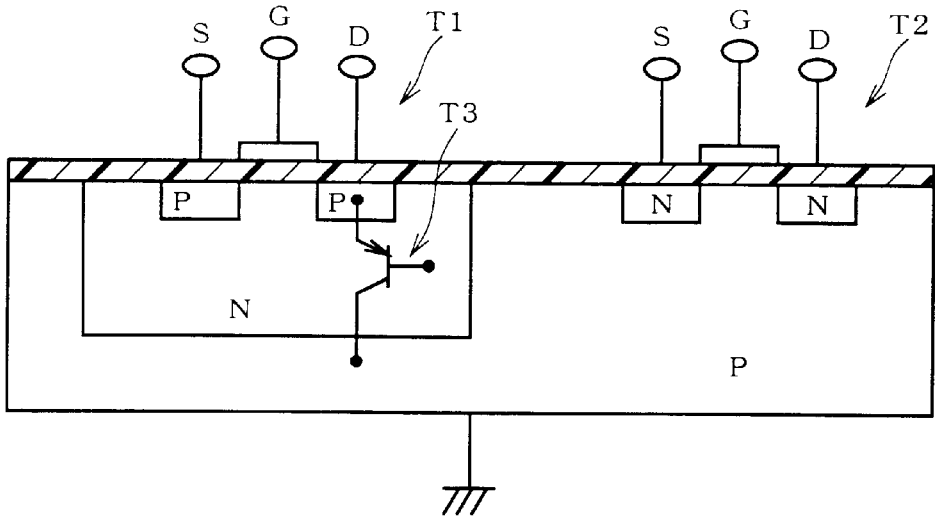
FIG. 58 is a sectional view showing the prior art.

Differently from the conventional drive circuit SD3 shown in FIGS. 56 and 57, the potential Va is applied to a scan electrode X through diodes D91 and D92 connected in antiparallel with each other in a drive circuit SD5 for a write discharge period. Consequently, even if an electric potential tries to perform step-up by the equivalent capacitor provided in a display $C_{jk}$, the electric potential of the scan electrode X is not raised above the electric potential Va.

By the step-up using a capacitor $C_D$, an electric potential (Vs+Vw) is applied to the scan electrode X for a write preparation period as will be described below. In addition, an electric potential Vs is applied for the sustain discharge period.

Switches for applying the electric potentials Va, Vs and Vw to the scan electrode X are constituted by MOS transistors. In order to protect them, each of diodes D93 to D98 is provided in parallel with each of the switches.

B. First Embodiment

Figure 2:
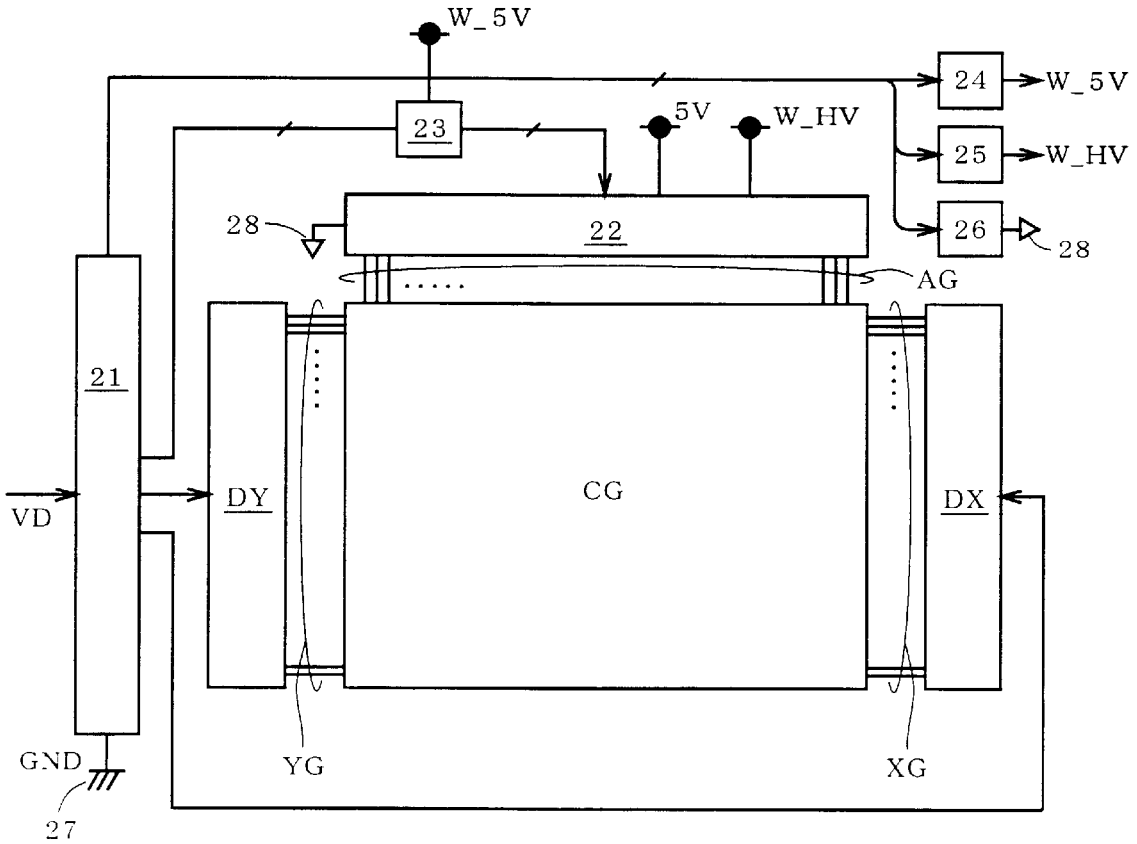
FIG. 2 is a block diagram showing a first embodiment of the present invention.

FIG. 2 is a block diagram showing a first embodiment of the present invention. Two scan electrode groups XG and YG, each comprising a plurality of scan electrodes, and an address electrode group AG comprising a plurality of address electrodes are provided in a surface discharge type plasma display panel CG having a plurality of display cells arranged in a matrix.

Figure 3:
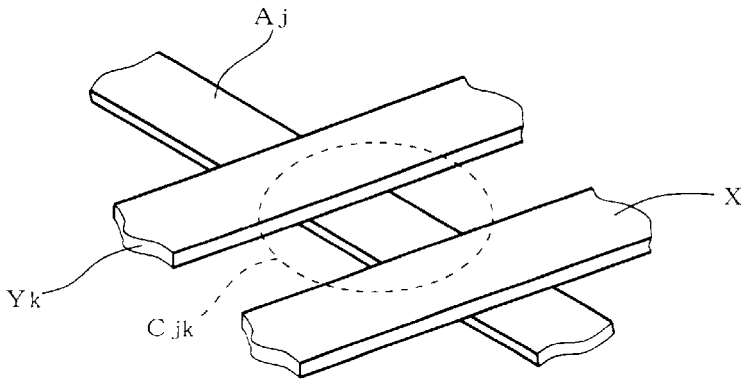
FIG. 3 is an enlarged view showing a state obtained in the vicinity of one display cell $C_{jk}$.

FIG. 3 is an enlarged view showing a state obtained in the vicinity of one display cell $C_{jk}$ in the surface discharge type plasma display panel CG, in which one scan electrode X in the scan electrode group XG and one scan electrode $Y_k$ are provided in parallel with each other and an address electrode $A_j$ is provided orthogonal to the scan electrodes X and $Y_k$ (Although a plurality of scan electrodes X are provided, a common voltage is applied to all of them. Therefore, each scan electrode X is not particularly distinguished for illustration). The display cell $C_{jk}$ is formed on an intersecting point of these electrodes.

When scanning each of the scan electrodes X and $Y_k$, data corresponding to respective addresses are output from the address electrode $A_j$ all at once to perform a write discharge. After an address period is terminated, the same signal is output to all the address electrodes for a sustain discharge period.

A plurality of push-pull type drive circuits for driving each address electrode $A_j$ are provided and constitute an address drive circuit 22. Furthermore, a drive circuit for driving each scan electrode $Y_k$ is provided to constitute a scanning drive circuit DY. In addition, a scanning drive circuit DX for driving the scan electrode X is also provided.

The scanning drive circuits DX and DY serve to drive the scan electrodes X and $Y_k$ by a digital signal generating circuit 21, and furthermore, the address drive circuit 22 serves to drive the address electrode $A_j$ through an isolation circuit 23 on receipt of a control signal and drive data generated from a video signal VD.

A first common potential point 27 for applying an electric potential (a first common potential: a ground potential in the present embodiment) which is a reference of the operation is connected to the digital signal generating circuit 21. A second common potential point 28 for applying an electric potential (a second common potential) which is a reference of the operation is connected to the address drive circuit 22.

Power control circuits 25, 24 and 26 are provided to generate predetermined electric potentials W_HV and W_5V (which are based on the second common potential) and the second common potential on receipt of a first power control signal, a second power control signal and a common potential control signal from the digital signal generating circuit 21, respectively.

(b-1) Digital Signal Generating Circuit

Figure 4:
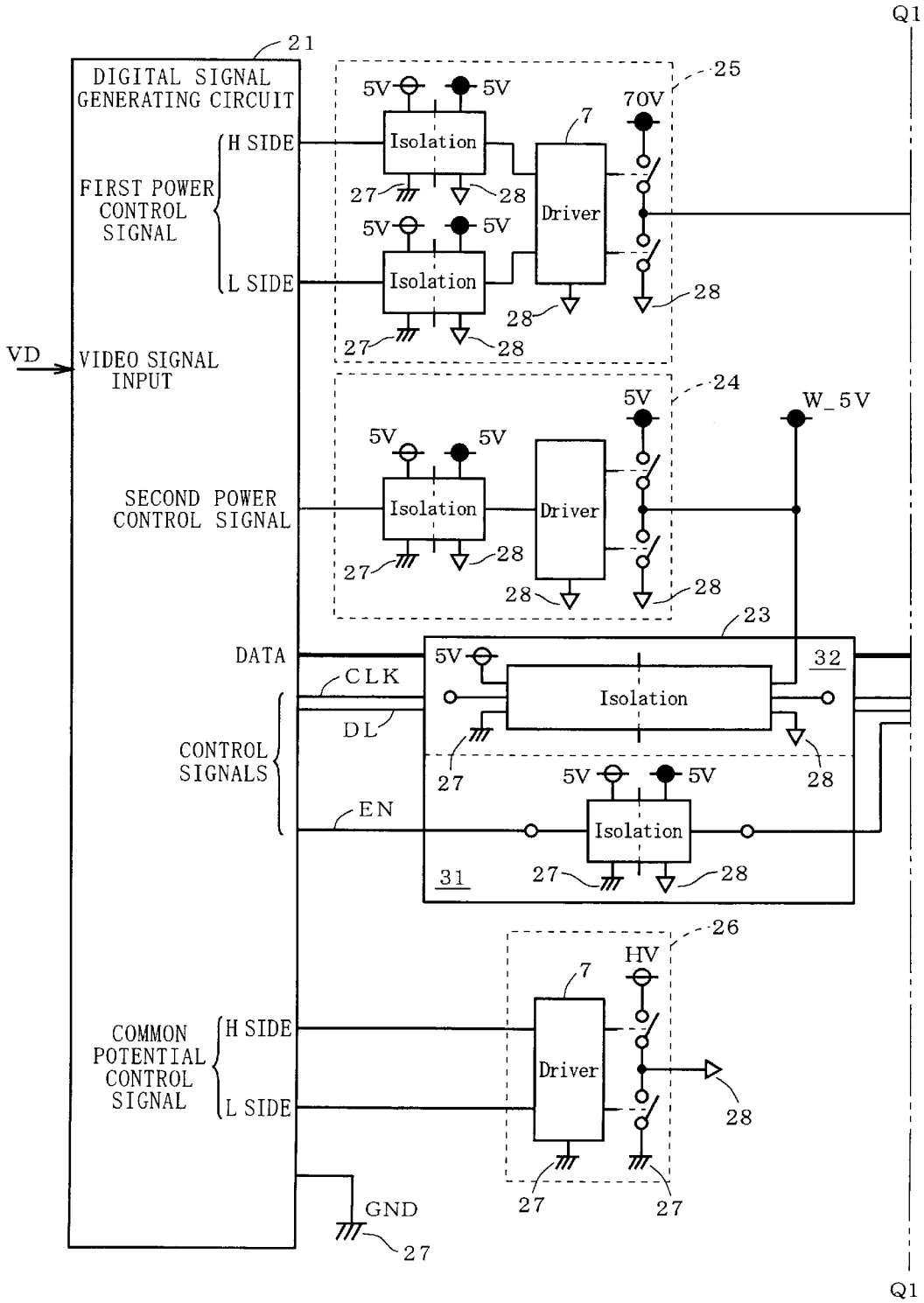
FIGS. 4 and 5 are circuit diagrams showing a state in which a digital signal generating circuit 21 is connected to other circuits.
Figure 5:
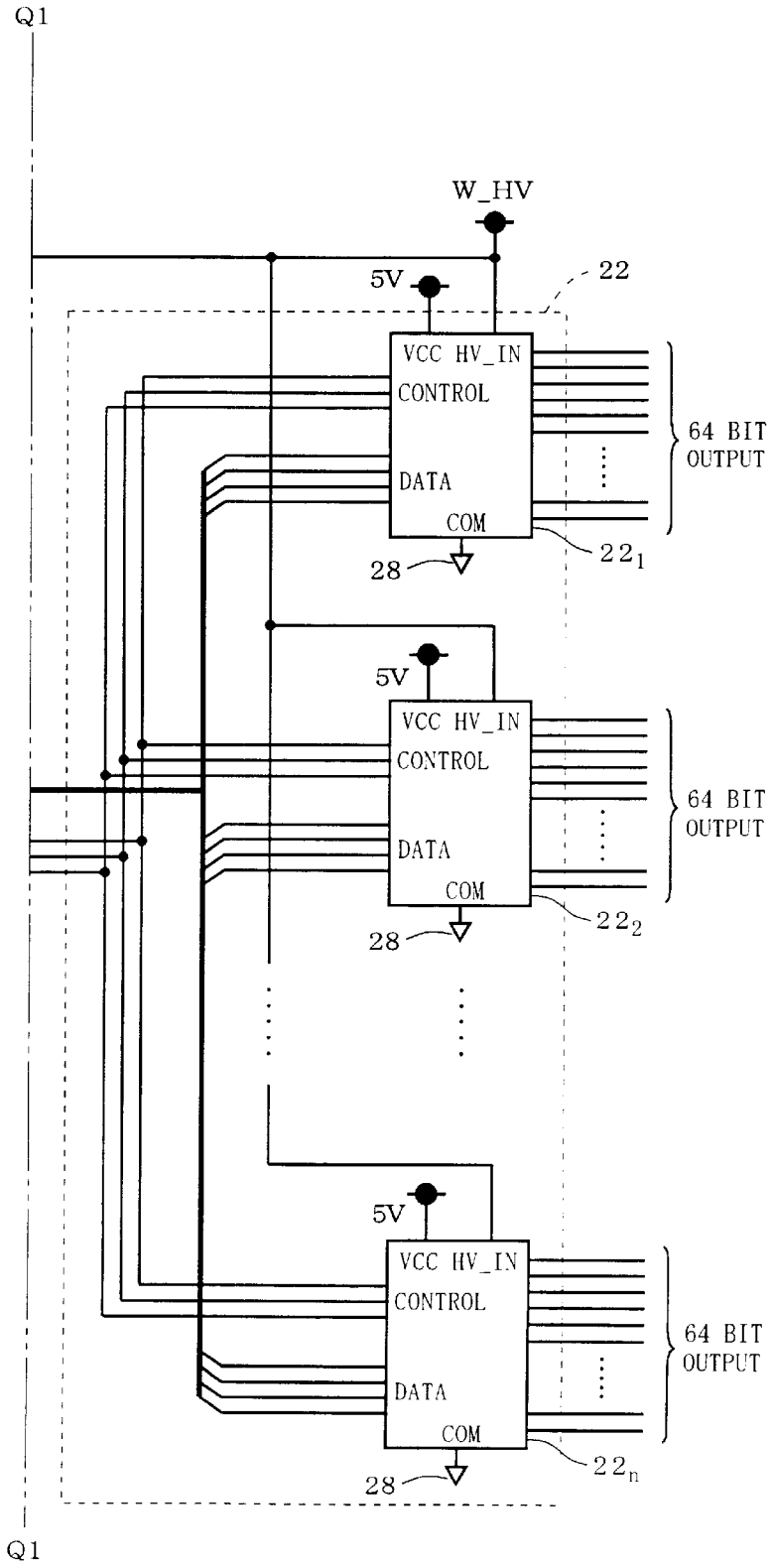

FIGS. 4 and 5 are circuit diagrams showing a connecting relationship among the digital signal generating circuit 21, the power control circuits 25, 24 and 26, the isolation circuit 23 and the address drive circuit 22, which continue in a virtual line Q1—Q1. The digital signal generating circuit 21 sends, to the isolation circuit 23, an output enable signal EN, a clock signal CLK and a data latch signal DL which are control signals for controlling the address drive circuit 22 based on the video signal VD received from the outside.

A power source necessary for the digital signal generating circuit 21 is obtained from the other terminal of a voltage source having one of terminals to which the first common potential is applied (hereinafter referred to as "a power source which is based on the first common potential"). In the drawing, the power source which is based on the first common potential is shown by an open circle. In the following, the power source which is based on the first common potential will be referred to as "a first 5V power source" if a voltage thereof is 5V, for example. In the following, furthermore, a power source for applying an electric potential Z is indicated as the same reference designation Z.

(b-2) Address Drive Circuit 22

The address drive circuit 22 is constituted by drive circuits $\mathbf{22}_1$ to $\mathbf{22}_n$ having push-pull type input and output stages. For each of the drive circuits $\mathbf{22}_1$ to $\mathbf{22}_n$, $\mu$PD 16327 manufactured by NEC can be employed, for example. The second common potential point 28 is connected to a common terminal of each of drive circuits $\mathbf{22}_i$ (i=1 to n). A 5V power source (a 5V power source which is shown by a solid circle in the drawing and will be hereinafter referred to as "a second SV power source", and so are other voltages) based on a voltage source having a terminal to which the second common potential (hereinafter referred to as "a power source that is based on the second common potential") is applied is given to a power terminal VCC for an internal logic circuit, and an electric potential W_HV based on the second common potential is applied to an HV power terminal. The electric potential W_HV is equivalent to the electric potential Va shown in FIG. 1.

Each of 64 output terminals of the drive circuits $\mathbf{22}_i$ to $\mathbf{22}_n$ is connected corresponding to each of the address electrodes $A_j$. Any one piece of information about three colors (red, green and blue) is transmitted to one address electrode. Accordingly, (640×3/64=30) is a minimum value of the number n of the drive circuits in a VGA (Video Graphics Array) specification, for example.

The control signals and the drive data which are transmitted through the isolation circuit 23 are input to an input terminal of each drive circuit $\mathbf{22}_i$. Three kinds of control signals are input and 4-bit drive data are input in parallel.

(b-3) Isolation Circuit 23

The isolation circuit 23 has a part 31 for transmitting the output enable signal EN, and a part 32 for transmitting the clock signal CLK, the data latch signal DL and drive data. The isolation circuit 23 has a function of outputting a signal obtained from the digital signal generating circuit 21 to the address drive circuit 22 while isolating the digital signal generating circuit 21 from a fluctuation in the second common potential. The control signals output from the isolation circuit 23 are sent to all the drive circuits $\mathbf{22}_i$ and the drive data is transmitted to a data input of each of corresponding drive circuits $\mathbf{22}_i$.

Figure 6:
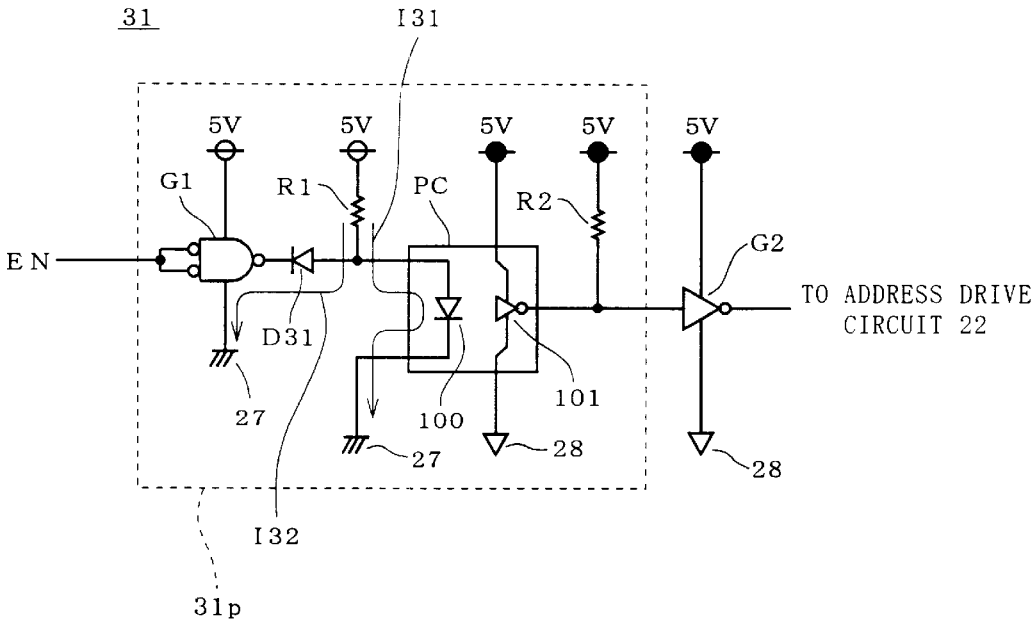
FIG. 6 is a circuit diagram showing a structure of a part 31.

FIG. 6 is a circuit diagram showing a structure of the part 31. The part 31 performs isolation by means of a photocoupler. The output enable signal EN is sent to a driver G1. Electric potentials are applied from the first common potential point 27 and the first 5V power source to the driver G1, respectively.

An output of the driver G1 is sent to a cathode of a diode D31. An anode of the diode D31 is connected to that of an LED 100 of a photocoupler PC, and furthermore, is connected to the first 5V power source through a pull-up resistor R1.

Since a buffer 101 of the photocoupler PC has an output terminal which is an open collector, it is connected to the secondb 5V power source through a pull-up resistor R2. An output of the photocoupler PC is subjected to logical adjustment (waveform shaping and inversion) by a logic circuit G2. Common terminals of the photocoupler PC and the logic circuit G2 are connected to the second common potential point 28, and respective power terminals are connected to the second 5V power source.

When a signal "H" is input to the driver G1, the driver G1 outputs "H". Since this signal reversibly biases the diode D31, a current does not flow to the diode D31. Consequently, a current I31 flows forward in the LED 100 through the pull-up resistor R1. Correspondingly, "L" is output from the buffer 101 and "H" is output from the logic circuit G2 which functions as an inverter.

When a signal "L" is input to the driver G1, the driver G1 outputs "L". Since this signal forward biases the diode D31, a current I32 flows in the diode D31 toward the driver G1. Consequently, a current does not flow to the LED 100, and the buffer 101 outputs a high-impedance state ("Z"). Then, "H" is input to the logic circuit G2 by the pull-up resistor R2, and the logic circuit G2 outputs "L".

Figure 7:
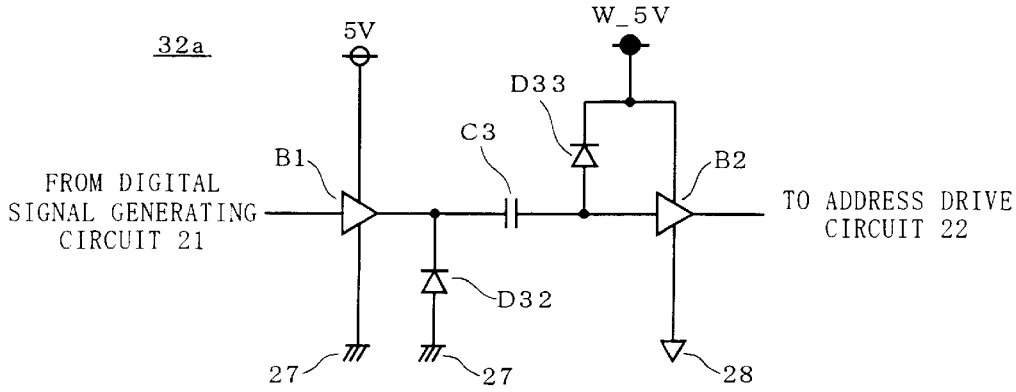
FIG. 7 is a circuit diagram showing a structure of a component 32*a* of a part 32.

FIG. 7 is a circuit diagram showing a structure of a component 32*a* of the part 32. In the part 32, the necessary number of components 32*a* for transmitting the clock signal CLK, the data latch signal DL and the drive data are provided in parallel. This number will be specifically described in an eighth embodiment.

In the component 32*a*, for example, the data latch signal DL obtained from the digital signal generating circuit 21 (so are the clock signal CLK and one bit of the drive data) is input to a buffer B1 (for which 74HC244 or the like can be employed, for example), and an output terminal of the buffer B1 is connected to one of terminals of a capacitor C3 and a cathode of a diode D32 in common. Operating power is supplied from the first common potential point 27 and the first 5V power source to the buffer B1, respectively.

Furthermore, an anode of the diode D32 is connected to the first common potential point 27. The other terminal of the capacitor C3 is connected to an input terminal of a buffer B2 (for which the 74HC244 or the like can be employed, for example) and an anode of a diode D33 in common. The electric potential W_5V is applied to a cathode of the diode D33 together with a power terminal of the buffer B2. The second common potential point 28 is connected to a common terminal of the buffer B2. In other words, the operating power is supplied from the second common potential point 28 and the power source W_5V to the buffer B1, respectively.

The operation of the component 32*a* will be hereinafter described in detail in (b-7) in relation to other circuits.

(b-4) Power Control Circuit 24

Figure 8:
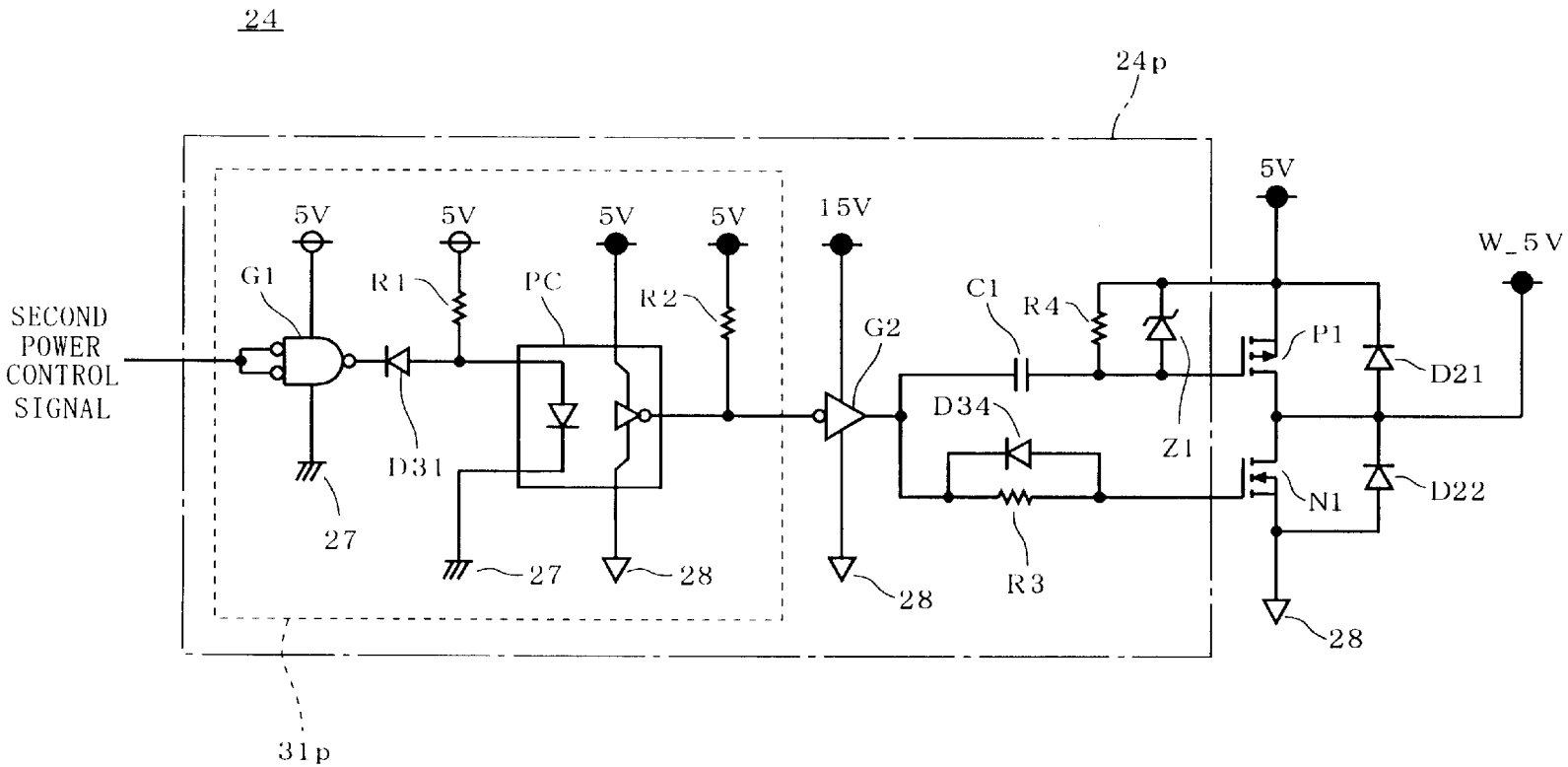
FIG. 8 is a circuit diagram showing a structure of a power control circuit 24.

FIG. 8 is a circuit diagram showing a structure of the power control circuit 24. The electric potential W_5V output from the power control circuit 24 is based on the second common potential, and 5V is supplied only for a period in which the control signal and the drive data are transmitted to the address drive circuit 22 and the second common potential is supplied for other periods, thereby preventing erroneous transfer of the control signal and drive data.

A part 31*p* is the same as the part 31*p* shown in FIG. 6, that is, the circuit constituted by the driver G1, the diode D31, the resistor R1, the photocoupler PC and the resistor R2.

The second power control signal sent from the digital signal generating circuit 21 is transmitted through the part 31*p* and is input to the driver G2. Both a PMOS transistor P1 on a high arm side and an NMOS transistor N1 on a low arm side are driven based on the output of the driver G2.

More specifically, the output of the driver G2 is sent to a gate of the NMOS transistor N1 through a gate resistor R3 and a diode D34 which are connected in parallel with each other. An anode of the diode D34 is connected to the gate of the NMOS transistor N1. The NMOS transistor N1 has a source connected to the second common potential point 28, and a drain connected to an output terminal of the power control circuit 24.

An output terminal of the driver G2 is connected to a gate of the PMOS transistor P1 through a capacitor C1. The second 5V power source is given to a source of the PMOS transistor P1, and a drain of the PMOS transistor P1 is connected to the output terminal of the power control circuit 24. Parallel connection of a resistor R4 and a Zener diode Z1 is provided between the second 5V power source and the gate of the PMOS transistor P1. The Zener diode Z1 has an anode connected to the gate of the PMOS transistor P1.

The NMOS transistor N1 and the PMOS transistor P1 are provided with protective diodes D22 and D21, respectively. They have a function of causing a current to flow in a reverse direction to a current which usually flows to each transistor.

For the driver G2, it is necessary to employ an IC having an input TTL level and serving to output a power level to be given to itself. For example, TC4429 (manufactured by TelCom Co., Ltd.) or the like is used. A common terminal of the driver G2 is connected to the second common terminal 28. A second 15V power source is supplied as a power source.

The PMOS transistor P1 and the NMOS transistor N1 are totem-pole connected, and can output the electric potential W_5V with a low impedance from their drains. A part 24*p* enclosed by a one-dotted dashed line in the drawing functions as a drive circuit for the PMOS transistor P1 and the NMOS transistor N1.

In the case where the power control circuit 24 supplies the second common potential as the electric potential W_5V, a second power control signal is set to "H". In the same manner as the operation of the part 31 of the isolation circuit 23, the driver G2 outputs "H". The driver G2 operates based on a voltage supplied from the second common potential point 28 and the second 15V power source. Therefore, the output "H" from the driver G2 is about 15V for the second common potential. Consequently, the NMOS transistor N1 is turned on through the gate resistor R3. Thus, the electric potential W_5V takes the second common potential.

On the other hand, a source of the PMOS transistor P1 is connected to the second 5V power source and the capacitor Cl holds a voltage of about 5V. Accordingly, an electric potential of 20V is instantaneously applied to the gate of the PMOS transistor P1 with respect to the second common potential so that the PMOS transistor P1 is turned off. At this time, the Zener diode Z1 is forward biased. Therefore, the gate potential of the PMOS transistor P1 shortly returns to 5V based on the second common potential.

In the case where 5V for the second common potential is to be supplied as the electric potential W_5V, the second power control signal is set to "L". In the same manner as the operation of the part 31 of the isolation circuit 23, the driver G2 outputs "L". The electric potential is almost equal to the second common potential.

Since electric charges stored in the gate of the NMOS transistor N1 are rapidly discharged through the diode D34, the NMOS transistor N1 is turned off. Furthermore, the electric potential of one of terminals of the capacitor C1 on the side connected to the output terminal of the driver G2 is reduced with a potential difference of about 15V. Accordingly, the gate potential of the PMOS transistor P1 becomes −10V for the second common potential so that the PMOS transistor P1 is turned on. At this time, the Zener diode Z1 functions to avoid applying an overvoltage to the gate of the PMOS transistor P1, thereby protecting the PMOS transistor P1.

The gate potential of the PMOS transistor P1 is gradually raised toward 5V by a resistor R4. However, when the gate of the PMOS transistor P1 reaches 0V, the PMOS transistor P1 is turned off. Therefore, it is necessary to carefully set the values of the capacitor C1 and the resistor R4.

In the case where the second common potential is to be supplied as the electric potential W_5V, the NMOS transistor N1 is turned on with a little delay for the output of the driver G2 by the gate resistor R3, while the PMOS transistor P1 is immediately turned off. Accordingly, it is possible to prevent a current from flowing between the PMOS transistor P1 and the NMOS transistor N1 (a short circuit between arms). Furthermore, in the case where 5V is supplied as the electric potential W_5V, the NMOS transistor N1 is rapidly turned off for the output of the driver G2 because it is bypassed by the diode D34. By such operation, it is possible to minimize the short circuit between the arms which is caused by the delayed turn-off operation of the NMOS transistor N1.

(b-5) Power Control Circuit 25

Figure 9:
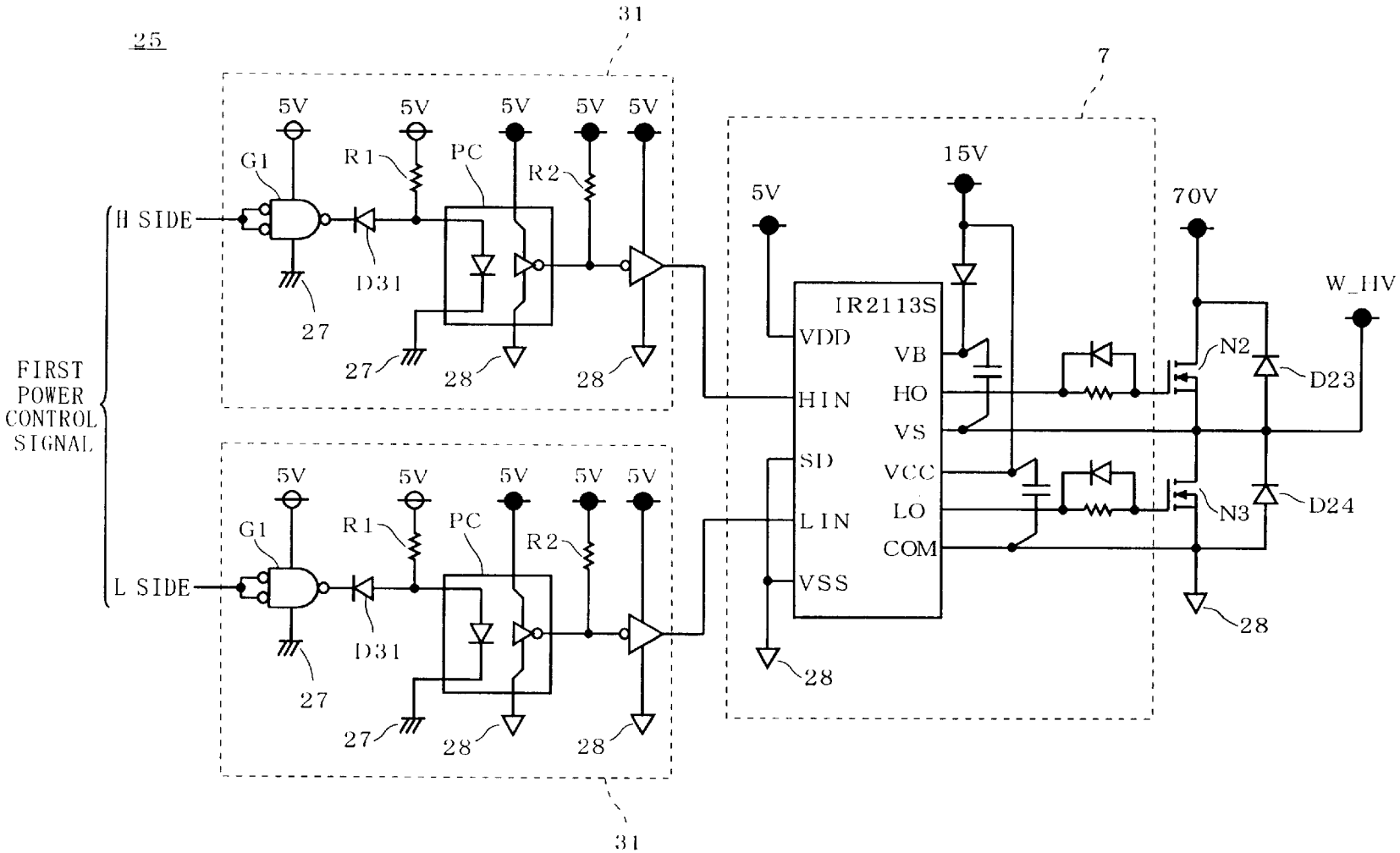
FIG. 9 is a circuit diagram showing a structure of a power control circuit 25.

FIG. 9 is a circuit diagram showing a structure of the power control circuit 25. An electric potential W_HV output from the power control circuit 25 is based on the second common potential, and 70V is supplied only for an address period and the second common potential is supplied for other periods, thereby protecting the output stage of the address drive circuit 22.

A pair of first power control signals (on H and L sides) which do not simultaneously take "H" are transmitted to the power control circuit 25. The "H side" and the "L side" indicate that the high arm and low arm sides of a transistor in the final stage of the power control circuit 25 are controlled and do not indicate the level of the first power control signal.

The power control circuit 25 includes a pair of parts 31 corresponding to the pair of first power control signals, NMOS transistors N3 and N2 which are totem-pole connected between a second 70V power source and the second common potential point 28 and a gate circuit 7 for a push-pull driver for driving the NMOS transistors N3 and N2 on receipt of respective outputs of the pair of parts 31. A signal transmitted through the part 31 is sent to the push-pull drive circuit 7. Furthermore, protective diodes D24 and D23 are connected to the NMOS transistors N3 and N2 in parallel.

The NMOS transistor N3 on the low arm side has a source connected to the second common potential point 28 and a drain connected to the second 70V power source. A source of the NMOS transistor N2 is connected to a drain of the NMOS transistor N3 on the low arm side in common, to which the electric potential W_HV is output.

The second common potential, the second 5V power source and the second 15V power source are supplied to the push-pull drive circuit 7. A structure of the push-pull drive circuit 7 will be described below in detail.

The H and L sides of the first power control signal are transmitted through the parts 31, respectively. The outputs of the parts 31 function as high and low arm side inputs of the gate circuit 7 for a push-pull driver. The gate circuit 7 for a push-pull driver sends a drive signal to respective gates of the NMOS transistors N2 and N3.

By setting values on the H and L sides of the first power control signal to "H" and "L" respectively, the gate circuit 7 for a push-pull driver turns off the NMOS transistor N3 and the NMOS transistor N2 is turned on to supply, as the electric potential W_HV, 70V which is based on the second common potential. Conversely, by setting the values on the H and L sides of the first power control signal to "L" and "H", the gate circuit 7 for a push-pull driver turns on the NMOS transistor N3 and turns off the NMOS transistor N2 to supply the second common potential as the electric potential W_HV.

(b-6) Power Control Circuit 26

Figure 10:
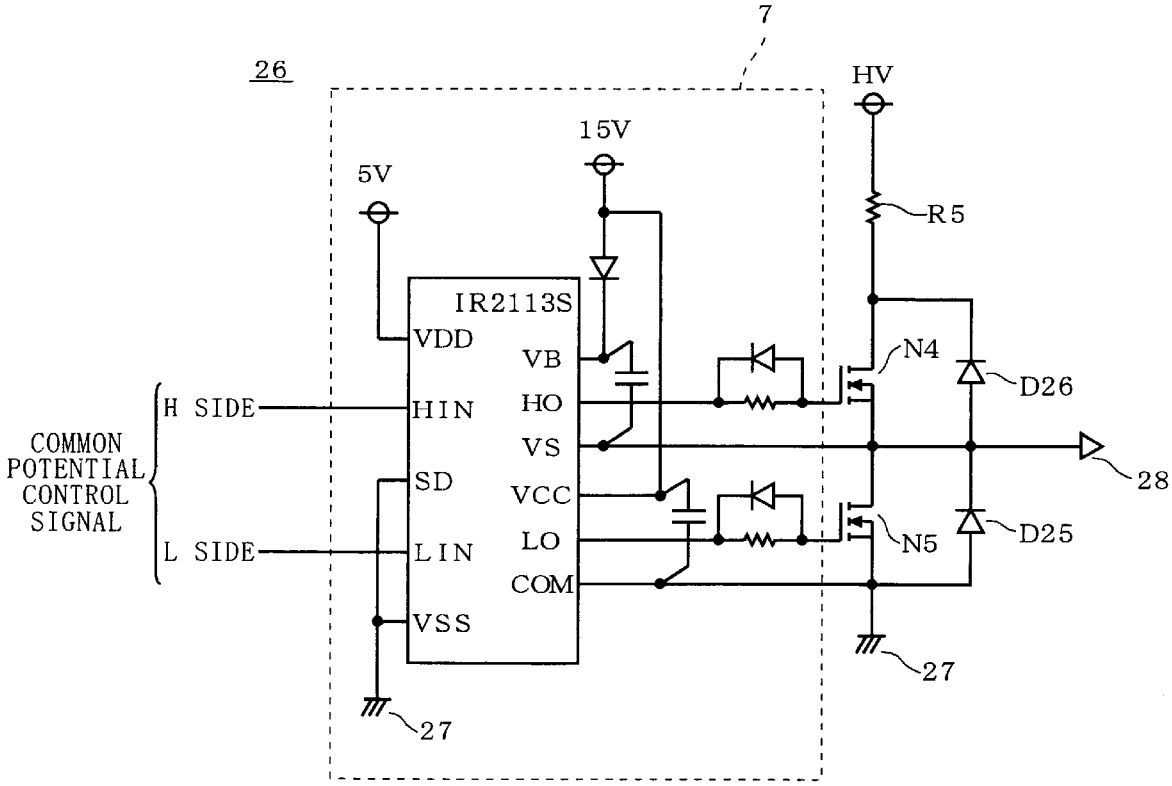
FIG. 10 is a circuit diagram showing a structure of a power control circuit 26.

FIG. 10 is a circuit diagram showing a structure of the power control circuit 26. The second common potential output from the power control circuit 26 takes the first common potential or an electric potential (hereinafter referred to as "a first HV potential") which is higher than the first common potential by a predetermined voltage HV (>W_HV) based on the second common control signal sent from the digital signal generating circuit 21. The first HV potential is equivalent to the electric potential Va2 shown in FIG. 1.

A pair of common potential control signals (on H and L sides) which do not simultaneously take "H" are sent to the power control circuit 26. The "H side" and the "L side" indicate that the high and low arm sides of a transistor in the final stage of the power control circuit 26 are controlled and do not indicate the level of the common control signal.

The power control circuit 26 comprises a push-pull drive circuit 7 for receiving the common potential control signal, and NMOS transistors N4 and N5 which are totem-pole connected between the first HV power source and the first common potential point 27. Furthermore, protective diodes D26 and D25 are provided on the NMOS transistors N4 and N5, respectively.

The NMOS transistor N5 on the low arm side has a source connected to the first common potential point 27, and the NMOS transistor N4 on the high arm side has a drain connected to the first HV power source through a resistor R5. A pair of outputs of the gate circuit 7 for a push-pull driver are given to the respective gates.

A source of the NMOS transistor N4 is connected to the drain of the NMOS transistor N5 in common, to which the second common potential is output.

Differently from the power control circuit 25, the first common potential, the first 5V power source and the first 15V power source are supplied to the push-pull drive circuit 7.

In the case where the first HV potential is to be supplied as the second common potential, the values on the H and L sides of the common potential control signal are set to "H" and "L", respectively. The gate circuit 7 for a push-pull driver turns off the NMOS transistor N5 and turns on the NMOS transistor N4. Accordingly, the electric potential supplied from the second common potential point 28 (that is, the second common potential) by the first HV power source and the resistor R5 is gradually raised to the first HV potential.

On the other hand, in the case where the first common potential (ground potential) is to be output to the second common potential point 28, the values on the H and L sides of the common potential control signal are set to "L" and "H", respectively. The gate circuit 7 for a push-pull driver turns on the NMOS transistor N5 and turns off the NMOS transistor N4. Consequently, the second common potential point 28 immediately supplies the first common potential.

(b-7) Gate Circuit 7 for Push-pull Driver

Figure 11:
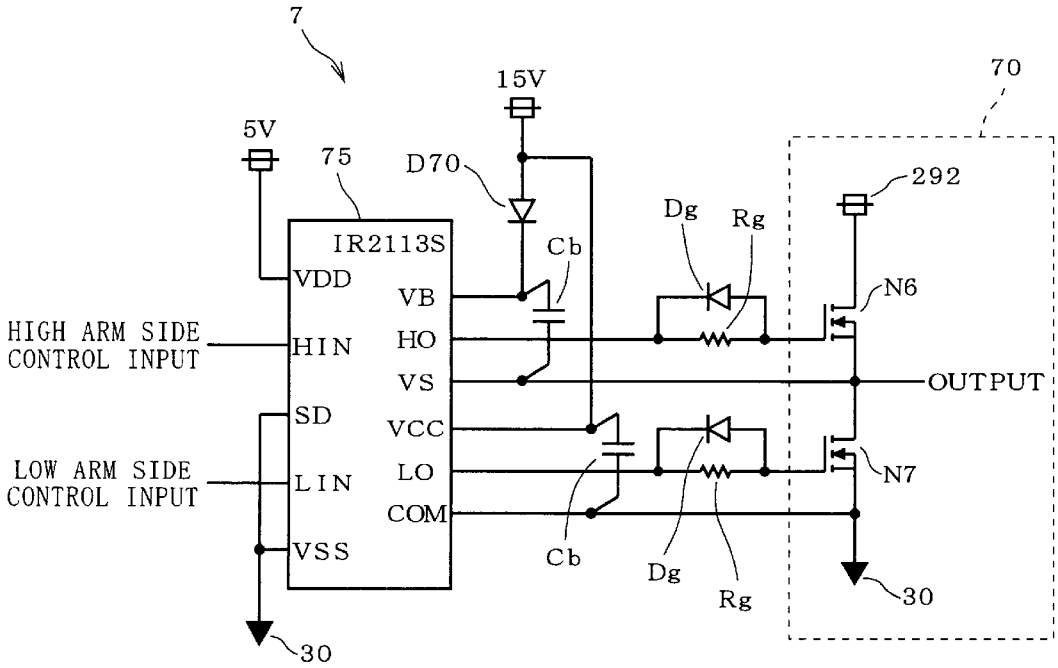
FIG. 11 is a circuit diagram showing a structure of a gate circuit 7 for a push-pull driver.

FIG. 11 is a circuit diagram showing a structure of the gate circuit 7 for a push-pull driver and a switch circuit 70 connected thereto. The switch circuit 70 includes two NMOS transistors N6 and N7 which are totem-pole connected, and the gate circuit 7 for a push-pull driver drives these NMOS transistors.

A source of the NMOS transistor N7 on a low arm side is connected to a common potential point 30, and a drain of the NMOS transistor N6 on a high arm side is connected to a high electric potential point 292 which is based on the common potential point 30. In FIG. 11, an electric potential point or a power source which is based on the common potential point 30 is shown by a square. A drain of the NMOS transistor N7 is connected to a source of the NMOS transistor N6 in common, from which an output is obtained.

The gate circuit 7 for a push-pull driver includes a gate driving IC 75 (IR2113S manufactured by IR Co., Ltd., for example). Common terminals VS and COM on high and low arm sides of the gate driving IC 75 are connected to the sources of the NMOS transistors N6 and N7, respectively. As a result, the common potential point 30 is connected to the common terminal COM on the low arm side in the same manner as the switch circuit 70.

Gate output terminals HO and LO on the high and low arm sides are connected to gates of the NMOS transistors N6 and N7 through element parallel connections, respectively. The element parallel connection is a parallel connection of a diode Dg and a gate resistor Rg. An anode of the diode Dg is connected close to the NMOS transistors N6 and N7. The element parallel connection is provided to turn off the NMOS transistors N6 and N7 at a high speed and to prevent a short circuit between arms.

The gate driving IC 75 includes a common terminal VSS for a logic as a power common terminal as well as a common terminal VS on the high arm side and a common terminal COM on the low arm side. The common terminal VSS for a logic is also connected to the common potential point 30 in the same manner as in the switch circuit 70.

The gate driving IC 75 includes a power input terminal VDD for a logic, a power input terminal VB for a gate signal on the high arm side and a power input terminal VCC for a gate signal on the low arm side as power input terminals. Voltages of 5V and 15V based on the electric potential of the common potential point 30 are applied to the power input terminal VDD for a logic and the power input terminal VCC for a gate signal on the low arm side, respectively. A 15V power source which is based on the common terminal VS on the high arm side is required for the power input terminal VB for a gate signal on the high arm side. Therefore, a voltage of 15V is applied through a diode D70. A capacitor Cb is provided between the power input terminal VCC for a gate signal on the low arm side and the common terminal COM on the low arm side and between the power input terminal VB for a gate signal on the high arm side and the common terminal VS on the high arm side, respectively.

A high arm side control input and a low arm side control input are given to the gate circuit 7 for a push-pull driver. These are input to control input terminals HIN and LIN on the high and low arm sides of the driver IC 75. In the case where the high arm side control input has "H", a gate signal having the "H" based on the common terminal VS on the high arm side is output to the gate of the NMOS transistor N6 on the high arm side through the gate resistor Rg. The turn-on operation of the NMOS transistor N6 is delayed for the gate signal according to a discharge time constant determined by an input capacity of itself and the gate resistor Rg. Furthermore, if the source potential of the NMOS transistor N6 is raised more, the electric potential of the common terminal VS on the high arm side becomes higher.

In the case where the high arm side control input has "L", the gate signal for the gate of the NMOS transistor N6 has "L". Since the diode Dg is forward biased, electric charges are extracted from the gate of the NMOS transistor N6 at a high speed irrespective of the discharge time constant. As a result, the NMOS transistor N6 is rapidly turned off for the gate signal.

The operation of the low arm side control input and the NMOS transistor N7 is the same as described above. The same common potential (that is, an electric potential to be applied by the common potential point 30) as the common potential on which the high arm side control input and the low arm side control input are based should be applied to the source of the NMOS transistor N7.

In this circuit, while the turn-on of the NMOS transistors N6 and N7 is delayed according to the discharge time constant by the existence of the resistor Rg, the turn-off thereof is instantaneously performed because bypassing is carried out by the diode Dg. By such operation, even if the high arm side control input and the low arm side control input are changed at the same time, it is possible to prevent a short circuit between arms from being caused by the delay of the turn-off of the transistor.

Of course, the high arm side control input and the low arm side control input should not be set to "H" at the same time in order to avoid the short circuit between the arms.

In the case where the gate circuit 7 for a push-pull driver is used in the power control circuit 25, the common potential point 30 corresponds to the second common potential point 28 and the NMOS transistors N6 and N7 correspond to the NMOS transistors N2 and N3, respectively. Furthermore, the H and L sides of the first power control signal correspond to the high arm side control input and the low arm side control input, respectively.

On the other hand, in the case where the gate circuit 7 for a push-pull driver is used in the power control circuit 26, the common potential point 30 corresponds to the first common potential point 27 and the NMOS transistors N6 and N7 correspond to the NMOS transistors N4 and N5, respectively. Furthermore, the H and L sides of the common potential control signal correspond to the high arm side control input and the low arm side control input, respectively.

(b-8) Explanation of Operation according to the Present Embodiment

Figure 12:
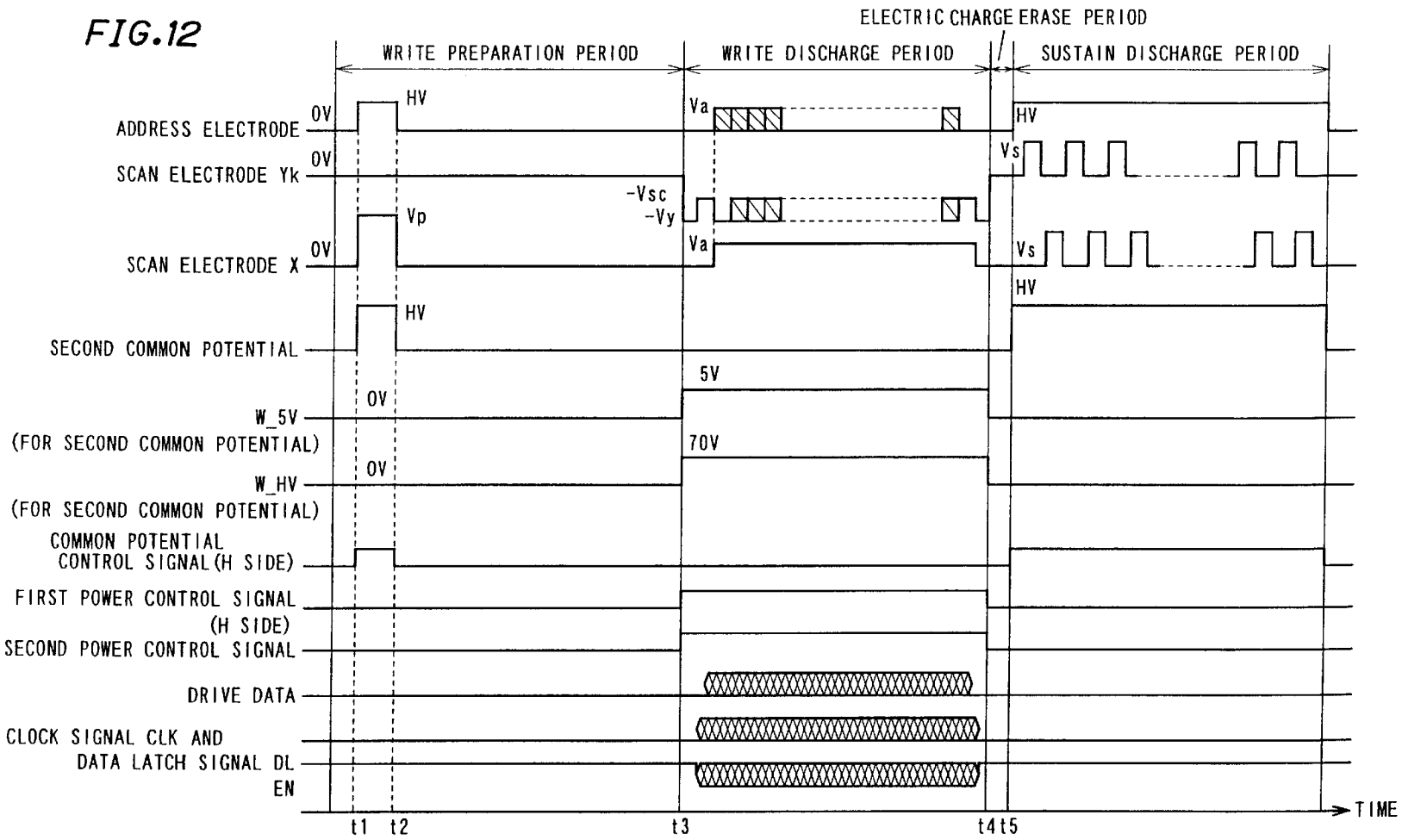
FIG. 12 is a timing chart showing operation according to the first embodiment of the present invention.

FIG. 12 is a timing chart showing operation according to the present embodiment. The operation according to the present embodiment is broadly divided into four stages;

(I) Write preparation (priming), (II) Write discharge, (III) Electric charge erasing (reset), and (IV) Sustain discharge.

The respective stages will be described below in order.

(I) Write Preparation (Priming)

In this sequence, an erase pulse is input to erase electric charges stored in each display cell $C_{jk}$ and space charges are caused to remain as a priming for a write discharge to be carried out next, thereby performing the preparation for the write discharge in the surface discharge type plasma display panel.

In the write preparation, the control signal and the drive data which are transmitted from the digital signal generating circuit 21 are set to an inactive state. More specifically, the drive data, the clock signal CLK and the data latch signal are forcedly set to "L" and the output enable signal EN is forcedly set to "H". Such setting is performed by the digital signal generating circuit 21.

The H side of the first power control signal has "L". In general, the L side of the first power control signal has a logic different from that on the H side. Consequently, the electric potential W_HV takes the second common potential. The second power control signal has "L". Consequently, the electric potential W_5V takes the second common potential.

At a time t1, the H side of the common potential control signal is changed from "L" to "H" (the L side of the common potential control signal generally has a logic different from that on the H side), and an electric potential HV based on the first common potential (ground potential) is supplied from the second common potential point 28. At the time t1, furthermore, the scan electrode X has an electric potential which is raised from a ground potential 0V to an electric potential Vp. The electric potentials Vp and HV are selected such that a greater discharge than the sustain discharge can be performed in the display cell $C_{jk}$. For example, the electric potential Vp is set to the sum of electric potentials Vw and Vs shown in FIG. 1, and the electric potential HV is set to the electric potential Va2.

Figure 13:
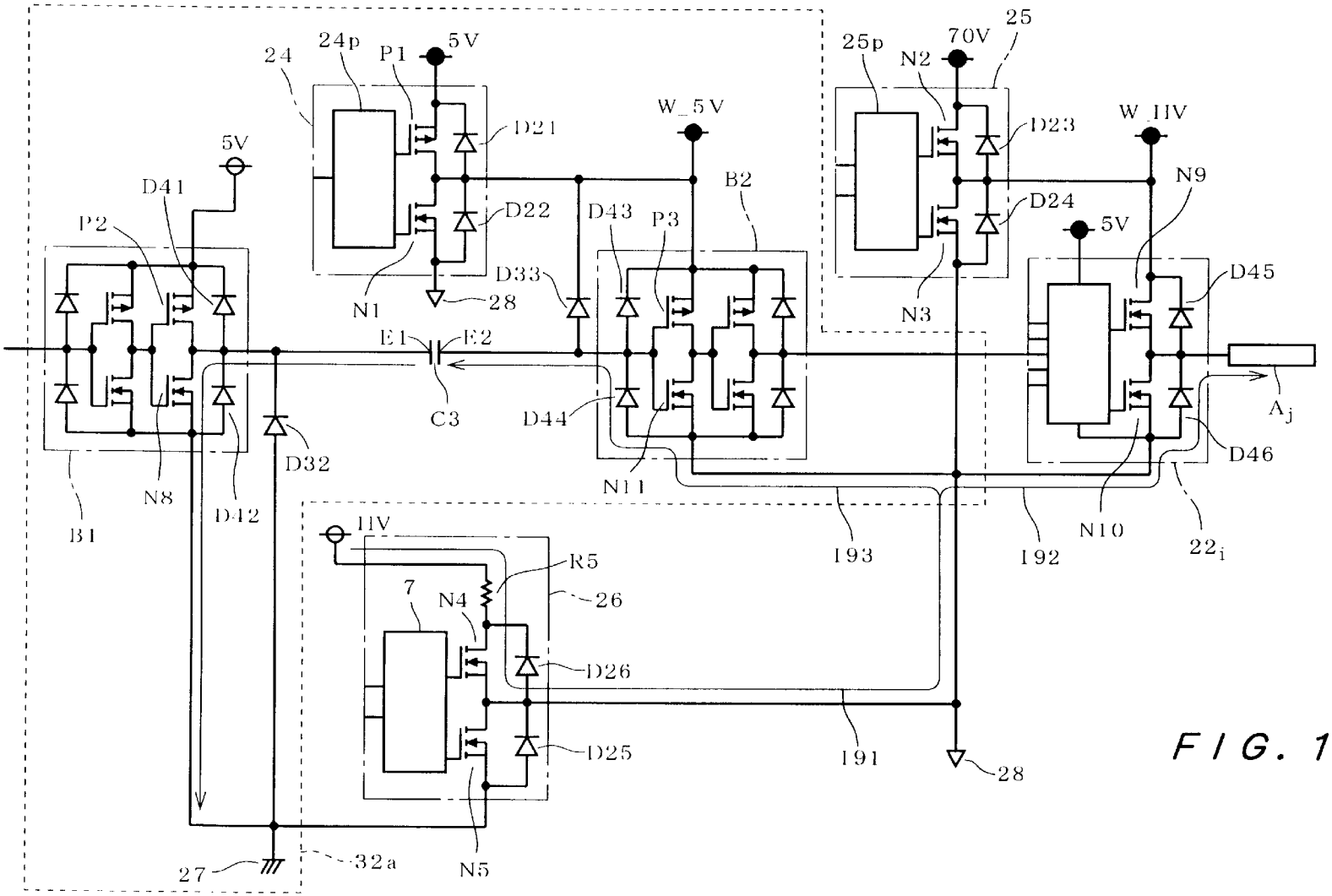
FIGS. 13 to 18 are circuit diagrams showing the operation according to the first embodiment of the present invention.

FIG. 13 is a circuit diagram showing a connecting relationship among a partial equivalent circuit of the drive circuit $\mathbf{22}_i$, a component 32*a* provided in the isolation circuit 23 for sending an input signal corresponding to an output stage for one bit of the drive circuit $\mathbf{22}_i$, and the power control circuits 24, 25 and 26. A part 25*p* of the power control circuit 25 indicates the gate circuit 7 for a push-pull driver and a pair of parts 31 collectively. FIG. 13 illustrates a current flow obtained when the electric potential HV based on the first common potential is supplied from the second common potential point 28.

It is apparent from a contrast between FIGS. 13 and 1 that the power control circuits 26 and 25 correspond to the circuits DR0 and DR1, respectively. In more detail, transistors N2, N3, N4 and N5 correspond to the switches SW12, SW13, SW10 and SW11 respectively and protective diodes D23, D24, D25 and D26 correspond to the diodes D12, D13, D11 and D10 respectively.

The output stage for one bit of the drive circuit $\mathbf{22}_i$ is constituted by NMOS transistors N9 and N10 for turning on/off according to the control of a control circuit provided in the drive circuit $\mathbf{22}_i$ and protective diodes D45 and D46 provided in parallel therewith. An internal circuit operates on receipt of the electric potential 5V and the electric potential W_HV which are based on the second common potential. The output stage for one bit of the drive circuit $\mathbf{22}_i$ corresponds to the address drive circuit AD2 shown in FIG. 1, the NMOS transistors N9 and N10 correspond to the switches SW3 and SW4, and the protective diodes D45 and D46 correspond to the diodes D3 and D4, respectively.

The electric potential W_HV to be given to the address electrode is applied to a drain of the NMOS transistor N9 for a write discharge period, and a source of the NMOS transistor N9 is connected to an address electrode $A_j$ through an output terminal of the drive circuit $22_j$. The NMOS transistor N10 has a source to which the second common potential point 28 is connected, and a drain connected to the address electrode $A_j$ through the output terminal of the drive circuit $22_i$. The protective diodes D45 and D46 are connected in parallel with the NMOS transistors N9 and N10 respectively, and have a function of causing a current to flow in a reverse direction to a current which usually flows to the NMOS transistors N9 and N10.

Each of the buffers B1 and B2 usually includes respective two sets of PMOS and NMOS transistors (high and low arm sides) for input and output stages which are totem-pole connected. Protective diodes are provided on the high and low arm sides in the input and output stages, respectively. For example, the output stage of the buffer B1 is constituted by a PMOS transistor P2 and an NMOS transistor N8 which are totem-pole connected, and protective diodes D41 and D42 are provided in the PMOS transistor P2 and the NMOS transistor N8, respectively. Furthermore, the input stage of the buffer B2 is constituted by a PMOS transistor P3 and an NMOS transistor N1 which are totempole connected, and protective diodes D43 and D44 are provided in the PMOS transistor P3 and the NMOS transistor N1, respectively.

The H and L sides of the first power control signal have "L" and "H", respectively. Therefore, the NMOS transistors N3 and N2 of the power control circuit 25 are on and off, respectively. Furthermore, the second power control signal has "L". Therefore, the PMOS transistor P1 of the power control circuit 24 is off and the NMOS transistor N1 thereof is on.

Since the drive data is forcedly set to "L", the PMOS transistor P2 is off and the NMOS transistor N8 is on. Furthermore, the NMOS transistors N9 and N10 of the drive circuit 22i are off and on respectively by the control of the control circuit provided in the drive circuit $22_i$ based on the fact that the output enable signal EN is set to "H".

At the time t1, the H and L sides of the common potential control signal are changed to "H" and "L", respectively. In the power control circuit 26, therefore, the NMOS transistors N4 and N5 are turned on and off, respectively. Accordingly, a current I91 flows from the first HV power source to the second common potential point 28 through the resistor R5 and the NMOS transistor N4. A part of the current I91 becomes a current I92 which flows from the second common potential point 28 to the drive circuit $22_i$ and then to the address electrode $A_j$ through the protective diode D46. Consequently, electric charges are stored in the display cell $C_{jk}$.

A part of the current I91 becomes a current I93 which transiently flows to the first common potential point 27 through the protective diode D44 of the buffer B2, the capacitor C3 and the NMOS transistor N8 of the buffer B1. In other words, the capacitor C3 is charged such that the side connected to an input terminal of the buffer B2 has a high electric potential.

Thus, a charging current flows to the capacitor C3. If a capacitance of the capacitor C3 is set small, for example, to about 470 pF, a period for which the current flows can be more reduced than a period for which a voltage of the address electrode should be raised. Accordingly, the component 32*a* is substantially isolated from a fluctuation in the second common potential. Consequently, the digital signal generating circuit 21 is also isolated from the fluctuation in the second common potential.

Furthermore, the resistor R5 is provided in the power control circuit 26 to set a maximum value of the current I93 so as not to exceed the protection capability of the protective diode D44 and the transistor N8 in which a rating is set corresponding to the output capability of the buffer B1.

At a time t2, next, the H side of the common potential control signal is set to "L" and the first common potential is supplied from the second common potential point 28. Furthermore, the electric potential of the scan electrode X is set to a ground potential Consequently, a self-erase discharge is performed in the display cell $C_{jk}$ so that space charges acting as a priming remain.

Figure 14:
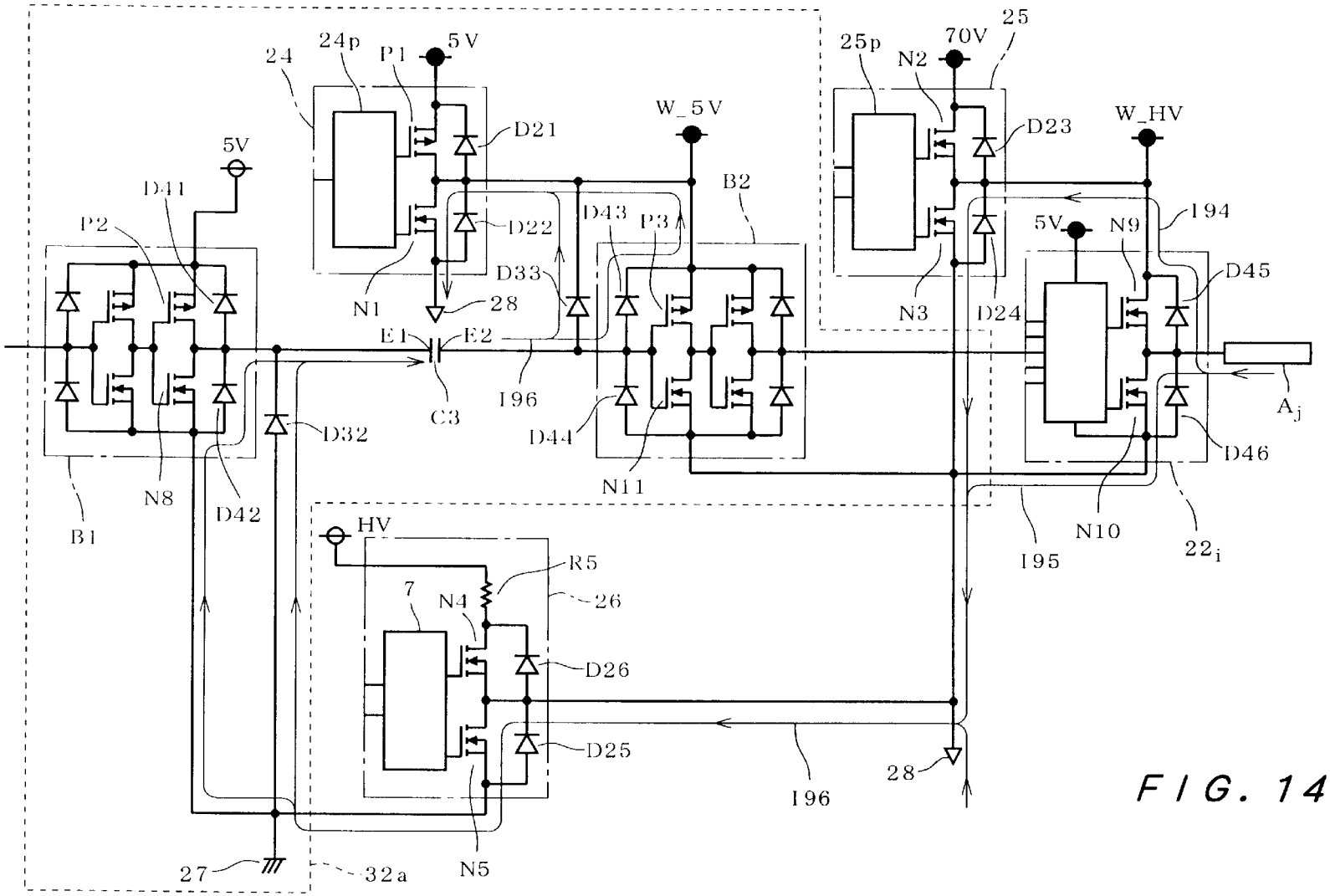

FIG. 14 corresponds to FIG. 13, and is a circuit diagram showing a current flow obtained when the first common potential is supplied from the second common potential point 28. Also at the time t2, the first power control signal, the second power control signal, the drive data and the control signal are not changed. Therefore, the on/off states of the transistors N1, P1, N3, N2, N9, N10, P2 and N8 are not changed.

However, the NMOS transistors N4 and N5 are turned off and on in the power control circuit 26, respectively. Therefore, the first common potential is supplied to the second common potential point 28. Accordingly, the electric charges stored in the display cell $C_{jk}$ flow as a current I94 from the address electrode $A_j$ to the second common potential point 28 through the protective diode D45 of the drive circuit $22_i$ and the NMOS transistor N3 of the power control circuit 25. On the other hand, a current I95 also flows from the address electrode $A_j$ to the second common potential point 28 through the NMOS transistor N10. These currents I94 and I95 flow from the second common potential point 28 to the first common potential point 27 through the NMOS transistor N5 of the power control circuit 26 so that the electric charges stored in the display cell $C_{jk}$ are discharged.

On the other hand, the capacitor C3 charged between the times t1 and t2 discharges the stored electric charges. Based on the discharge, a current I96 flows to the second common potential point 28 through the protective diode D43 of the buffer B2, the diode D33 and the NMOS transistor N1 of the power control circuit 24. The current I96 flows from the second common potential point 28 to the first common potential point 27 through the NMOS transistor N5 of the power control circuit 26. Furthermore, the current I96 flows from the first common potential point 27 to the capacitor C3 through the protective diode D42 of the buffer B1 and the diode D32.

The diodes D32 and D33 can quickly discharge the capacitor C3, and can rapidly reduce the electric potential of the second common potential point 28 down to the first common potential (an electric potential equal to or less than 500 nsec.) Furthermore, the diodes D32 and D33 help the functions of the protective diodes D42 and D43. Therefore, the component 32*a* is substantially isolated from the fluctuation in the second common potential.

As described above, the electric potential of the second common potential point 28 is varied between the first common potential and the electric potential of the first HV power source. Consequently, a pulse-shaped voltage HV can be generated on the address electrode $A_j$ correspondingly.

(II) Write discharge

In this sequence, the voltage Va (<HV) is applied to all the address electrodes $A_j$ at once corresponding to respective data to perform a write discharge at the time of each line scanning.

For a write discharge period, the H and L sides of the common potential control signal keep "L" and "H" respectively, and the NMOS transistors N4 and N5 are off and on in the power control circuit 26 respectively. Accordingly, the second common potential is set to the first common potential.

At a time t3, the H and L sides of the first power control signal are changed to "H" and "L" respectively, and the second power control signal is also changed to "H". Consequently, the PMOS and NMOS transistors P1 and N1 of the power control circuit 24 are turned on and off respectively, and the NMOS transistors N2 and N3 of the power control circuit 25 are turned on and off respectively. Since the second common potential is equal to the first common potential, the electric potentials W_5V and W_HV have values of 5V and 70V based on the first common potential respectively. Thus, each electric potential is set. Therefore, the drive data can be transferred in a write discharge sequence which has conventionally been performed, thereby performing write from the address electrode. For example, the scan electrode $Y_k$ is varied between a scan potential $-V_{sc}$ and an electric potential −Vs which are negative.

For the write discharge period, the control signal and the drive data which are transmitted from the digital signal generating circuit 21 are not forcedly set to an inactive state but are changed between "H" and "L". There will be described the charge/discharge of the capacitor C3 which is performed when the clock signal CLK, the data latch signal DL and the drive data to be processed in the part 32 are changed between "H" and "L".

Figure 15:
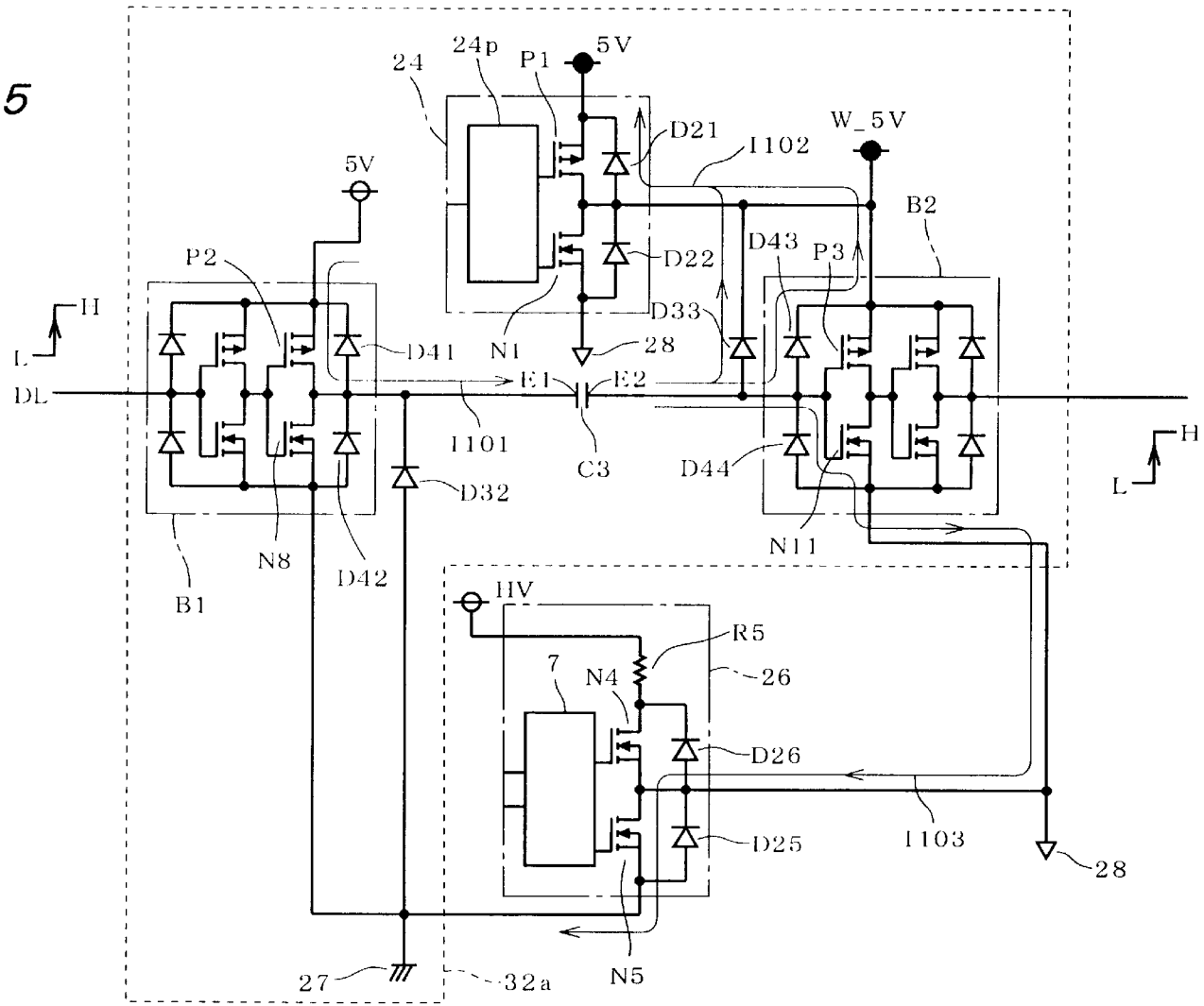

FIG. 15 is a circuit diagram showing a connecting relationship between the power control circuit 26 and the component 32*a*. FIG. 15 illustrates a current flow obtained when the data latch signal DL sent from the digital signal generating circuit 21 is changed from "L" to "H" (so are the clock signal CLK and one bit of the drive data), for example.

When the data latch signal DL is changed from "L" to "H", the PMOS transistor P2 and the NMOS transistor N8 in the output stage of the buffer B1 are turned on and off, respectively. Consequently, an electric potential of an output terminal of the buffer B1 is suddenly raised from 0V to 5V. Therefore, this fluctuation is transmitted to the buffer B2 through the capacitor C3, and rapidly turns on and off the NMOS transistor N11 and the PMOS transistor P3 in an input stage of the buffer B2, respectively. Consequently, the NMOS transistor on the low arm side and the PMOS transistor on the high arm side in an output stage of the buffer B2 are turned off and on respectively, and an output of the buffer B2 is changed from "L" to "H".

Thus, the step-up of a voltage can be implemented by using the capacitor C3. Therefore, a transition of the data latch signal DL can be rapidly transmitted in the component 32*a*.

When the data latch signal DL is "L", the PMOS transistor P3 of the buffer B2 is turned on. Therefore, more electric charges than in a terminal E1 on the side of the capacitor C3 connected to the buffer B1 are stored in a terminal E2 on the side connected to the buffer B2. More specifically, such a voltage as to raise an electric potential on the buffer B2 side more than on the buffer B1 side is kept by the capacitor C3. In this case, a current flows to the protective diode D21 of the power control circuit 24 through the diode D33 in addition to the protective diode D43 which is usually provided on the high arm side of the buffer B2. By such operation, an unnecessary increase in a voltage is not caused in the input stage of the buffer B2. In other words, the protective diode D21 of the power control circuit 24 also protects the input stage of the buffer B2.

Then, the capacitor C3 is charged in a reverse direction by a micro leakage current I103 of the NMOS transistor N11 of the buffer B2 and a current I101 flowing in the PMOS transistor P2 of the buffer B1 so that an electric potential on the terminal E1 is more raised than that on the terminal E2.

Figure 16:
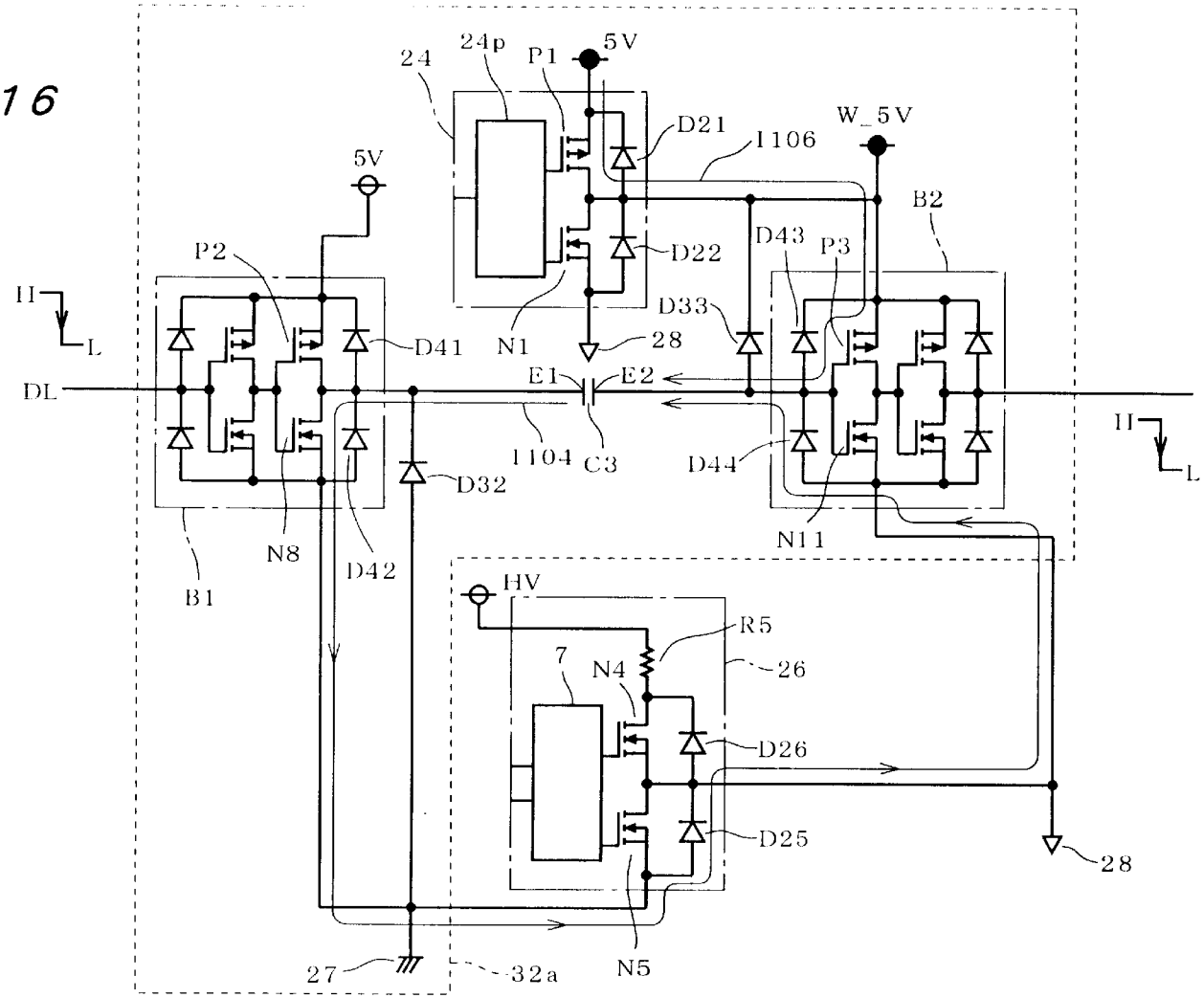

FIG. 16 is a circuit diagram corresponding to FIG. 15, illustrating a current flowing when the data latch signal DL is changed from "H" to "L". The PMOS and NMOS transistors P2 and N8 provided in the output stage of the buffer B1 are turned off and on, respectively. Consequently, the electric potential on the output terminal of the buffer B1 is suddenly reduced from 5V to 0V. Therefore, this fluctuation is transmitted to the buffer B2 through the capacitor C3, and rapidly turns off and on the NMOS and PMOS transistors N11 and P3 of the buffer B2, respectively. Consequently, the NMOS transistor on the low arm side and the PMOS transistor on the high arm side in the output stage of the buffer B2 are turned on and off respectively, and the output of the buffer B2 is changed from "H" to "L".

When the data latch signal DL is "H", the electric potential on the terminal E1 of the capacitor C3 is higher than that on the terminal E2. However, since the NMOS transistor N8 on the low arm side in the output stage of the buffer B1 is turned on, electric charges stored in the terminal E1 of the capacitor C3 become a current I104 to flow to the first common potential point 27. Furthermore, the current I104 reaches the terminal E2 of the capacitor C3 through the protective diode D25 of the power control circuit 26 and the protective diode D44 of the buffer B2. Consequently, the capacitor C3 is discharged.

However, the capacitor C3 further starts to be charged in a reverse direction. The reason is that the electric charges are supplied from the second 5V power source to the terminal E2 of the capacitor C3 by a micro leakage current I106 of the PMOS transistor P3 of the buffer B2 because the PMOS transistor P1 of the power control circuit 24 is on.

(III) Electric Charge Erasing

After respective drive data are written to all the address electrodes by the write discharge, an electric charge erasing sequence is performed.

The H and L sides of the common potential control signal keep "L" and "H" respectively, and the second common potential keeps the first common potential.

At a time t4, the H and L sides of the first power control signal are changed to "L" and "H" respectively, and the second power control signal is also changed to "L". Consequently, the PMOS and NMOS transistors P1 and N1 of the power control circuit 24 are turned off and on respectively, and the NMOS transistors N2 and N3 of the power control circuit 25 are turned off and on respectively. The electric potentials W_5V and W_HV become equal to the second common potential respectively. However, since the second common potential is equal to the first common potential, the electric potentials W_5V and W_HV finally become equal to the first common potential.

At the time t4, the output enable signal EN has already been set to "H" (inactive). Furthermore, the drive data, the clock signal CLK and the data latch signal DL are forcedly set to "L" to become inactive at the time t4. Moreover, the electric potential of the scan electrode $Y_k$ is set to 0V.

Thus, the electric charges of the charged capacitor C3 can be discharged by the write discharge. In this case, the electric potential W13 HV is 0V. Therefore, no voltage is applied to both terminals of a series connection of the transistors N9 and N10 in the output stage of the drive circuit $\mathbf{22}_i$ so that the address electrode $A_j$ is not affected.

Figure 17:
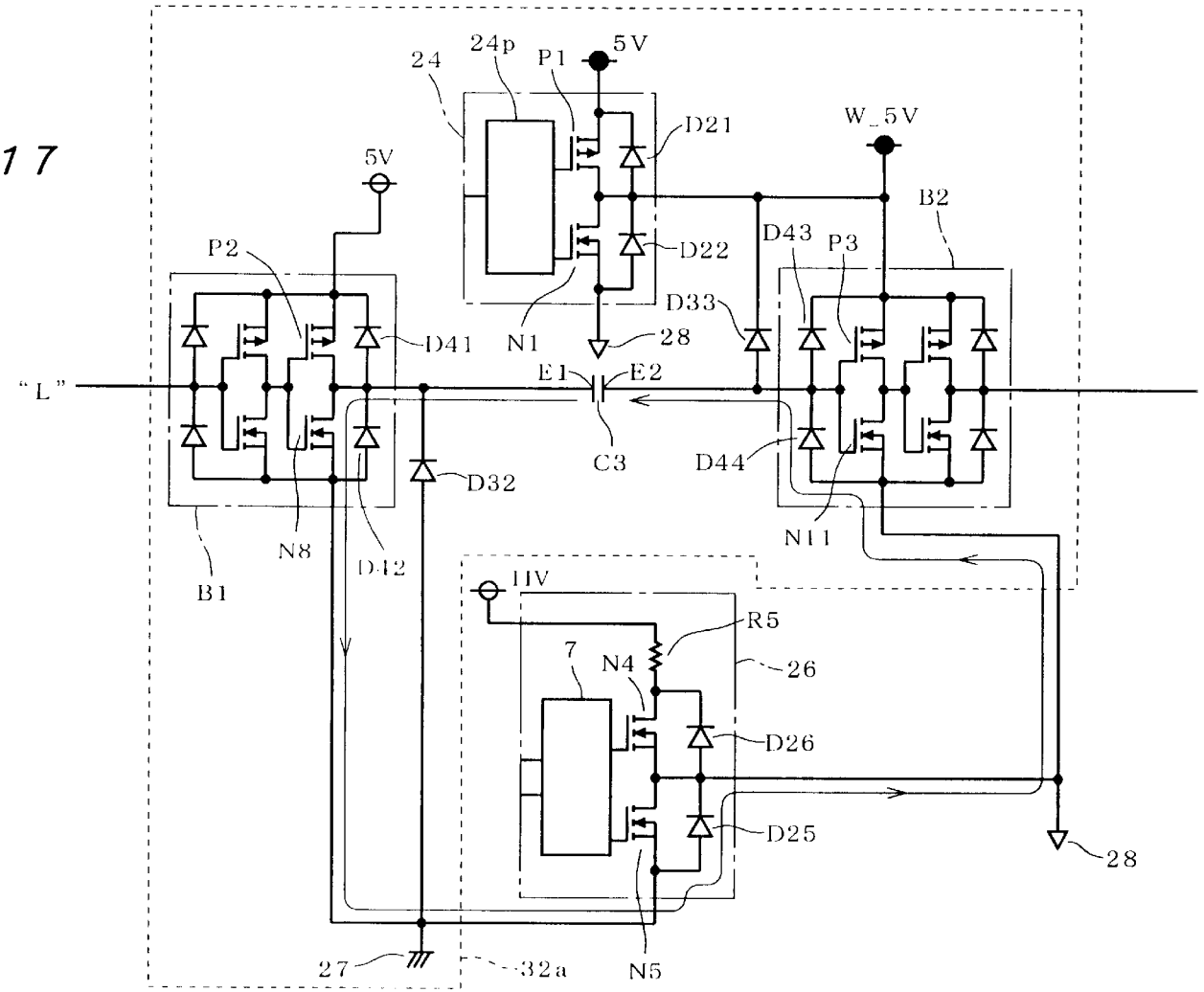

FIG. 17 is a circuit diagram showing a connecting relationship between the power control circuit 26 and the component 32*a*. FIG. 17 illustrates a discharge of the capacitor C3 when the electric potential on the terminal E1 of the capacitor C3 has been higher than that on the terminal E2.

Since the second power control signal has "L", the PMOS and NMOS transistors P1 and N1 of the power control circuit 24 are off and on respectively. Since the drive data, the clock signal CLK and the data latch signal are "L", the PMOS and NMOS transistors P2 and N8 of the buffer B1 are off and on respectively. Since the H and L sides of the common potential control signal keep "L" and "H" respectively, the NMOS transistors N4 and N5 are off and on in the power control circuit 26 respectively.

The electric charges stored in the capacitor C3 are discharged through the NMOS transistor N8, the first common potential point 27, the protective diode D25 of the power control circuit 26, the second common potential point 28 and the protective diode D44 of the buffer B2 in this order in the same manner as the current I104 shown in FIG. 16.

The current I106 shown in FIG. 16 does not flow. The reason is that the PMOS transistor P1 of the power control circuit 24 is off.

Figure 18:
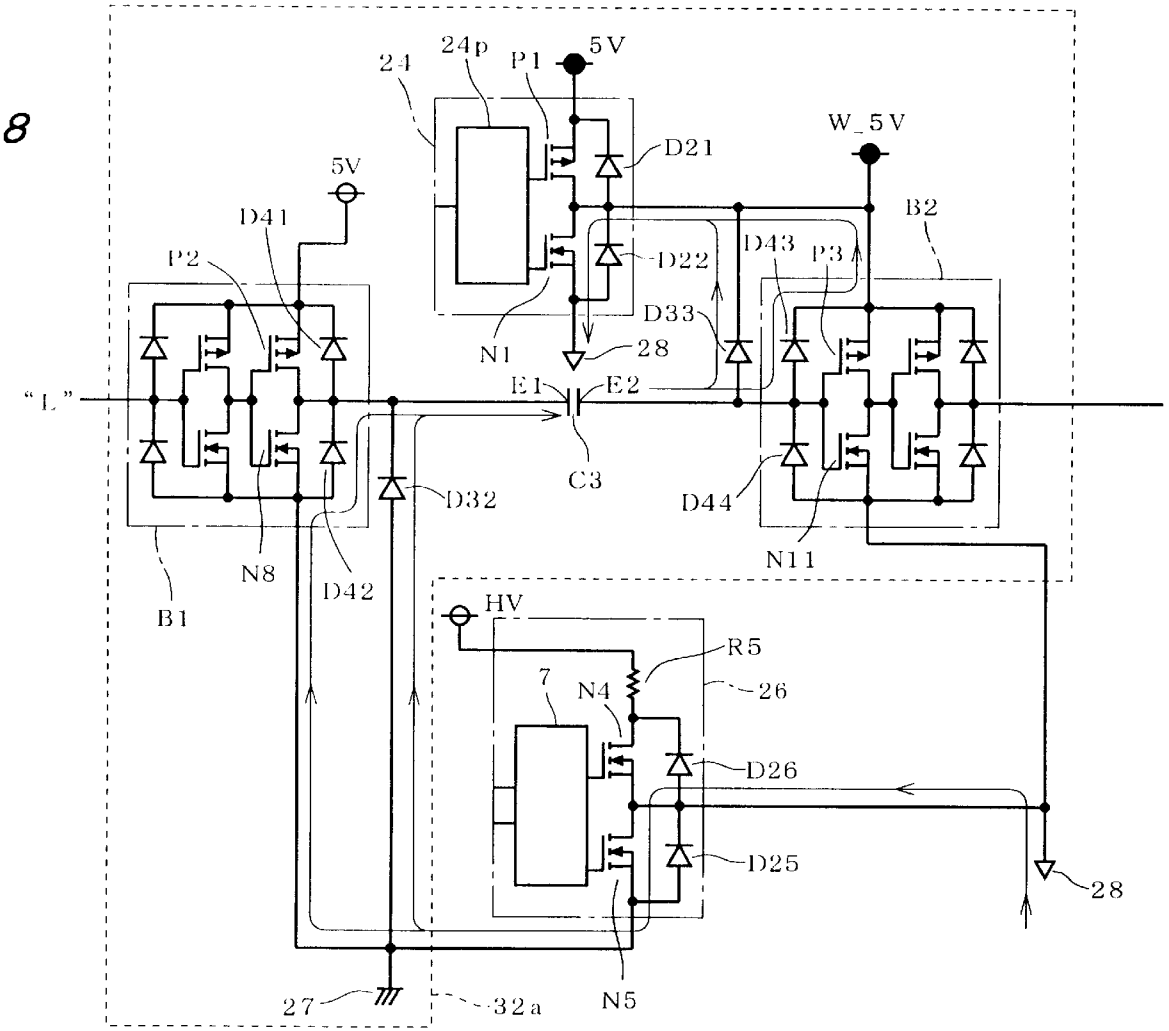

FIG. 18 is a circuit diagram showing a connecting relationship between the power control circuit 26 and the component 32*a*. FIG. 18 illustrates a discharge of the capacitor C3 when the electric potential on the terminal E2 of the capacitor C3 has been higher than that on the terminal E1.

The electric charges stored in the capacitor C3 are discharged through the protective diode D43 of the buffer B2, the diode D33, the NMOS transistor N1 of the power control circuit 24, the second common potential point 28, the NMOS transistor N5 on the low arm side of the power control circuit 26, the first common potential point 27, the protective diode D42 of the buffer B1 and the diode D32 in this order.

The requirements for the discharge are met for the priming discharge sequence period and a sustain discharge sequence period which will be described below as well as the above-mentioned timing. Therefore, the capacitor C3 is discharged.

(IV) Sustain discharge

After the electric charge erasing period is terminated, a sustain discharge for light emission between the scan electrodes X and $Y_k$ is carried out.

Also at a time t5, the output enable signal EN is inactive with "H" and the drive data, the clock signal CLK and the data latch signal DL are inactive with "L". The "H" side of the first power control signal and the second power control signal have "L" successively to the time t4, and the electric potentials W_5V and W_HV take the second common potential.

However, the common potential control signal is changed from "L" to "H" at the time t5. Therefore, the second common potential becomes equal to an electric potential supplied from the first HV power source. In other words, a voltage HV is applied to the address electrode $A_j$. When a sustain discharge period is terminated at a time t6, the H side of the common potential control signal is changed from "H" to "L" so that the second common potential takes the first common potential (ground potential). By such a fluctuation in the second common potential, a state of a current flowing among the address electrode $A_j$, the component 32*a* and the power control circuits 24, 25 and 26 is the same as that of the current described in (I) write preparation.

C. Second Embodiment

Figure 19:
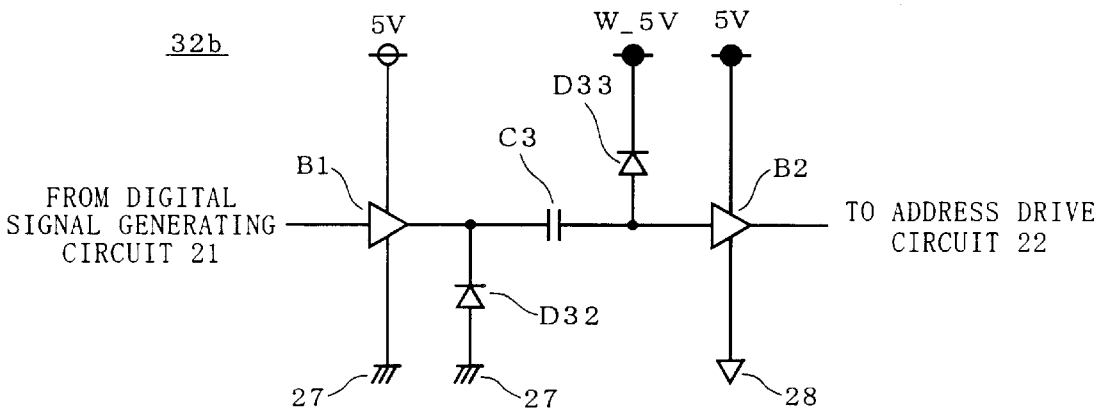
FIG. 19 is a circuit diagram showing a structure of a component 32*b;*

A second embodiment will describe a technique in which the component 32*a* shown in the first embodiment is deformed. FIG. 19 is a circuit diagram showing a structure of a component 32*b*. The component 32*a* is replaced by the component 32*b* to constitute the part 32 of the isolation circuit 23.

The component 32*b* is different only in that the second 5V potential is applied to the buffer B2 to which the electric potential W_5V is applied in the component 32*a*. More specifically, although an electric potential is supplied to the diode D33 in the same manner as in the first embodiment, the second 5V potential is always applied to the buffer B2. Accordingly, it is possible to relieve an output load of the power control circuit 24 for applying the electric potential W_5V to both the diode D33 and the buffer B2.

Figure 20:
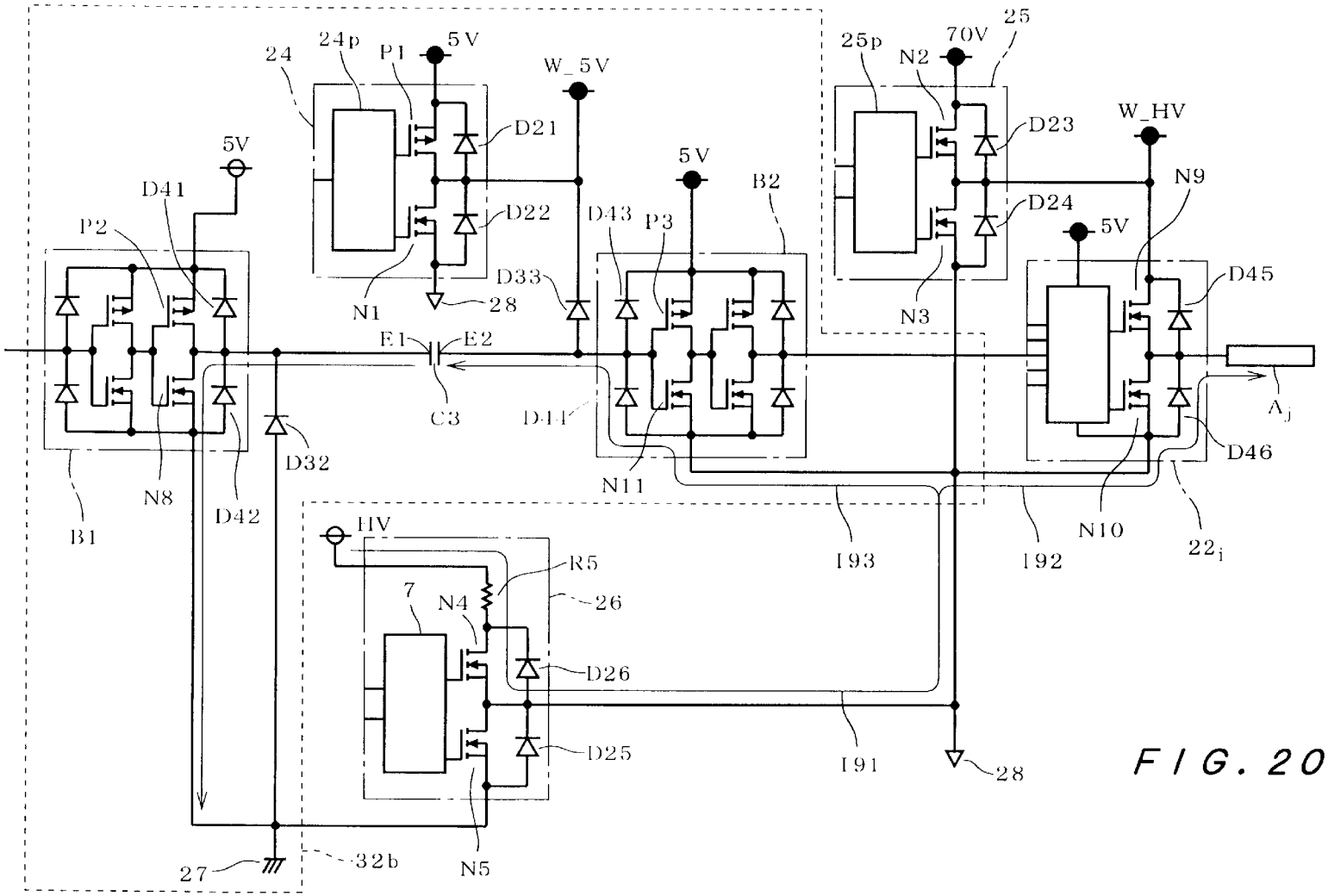
FIGS. 20 to 25 are circuit diagrams showing operation according to a second embodiment of the present invention.

An operating sequence according to the second embodiment is the same as the operating sequence according to the first embodiment shown in FIG. 12. Differences will chiefly be described below. FIG. 20 corresponds to FIG. 13 showing the first embodiment, and illustrates a current flow obtained when the electric potential HV based on the first common potential is supplied from the second common potential point 28. The current flow makes no difference between FIGS. 13 and 20.

Figure 21:
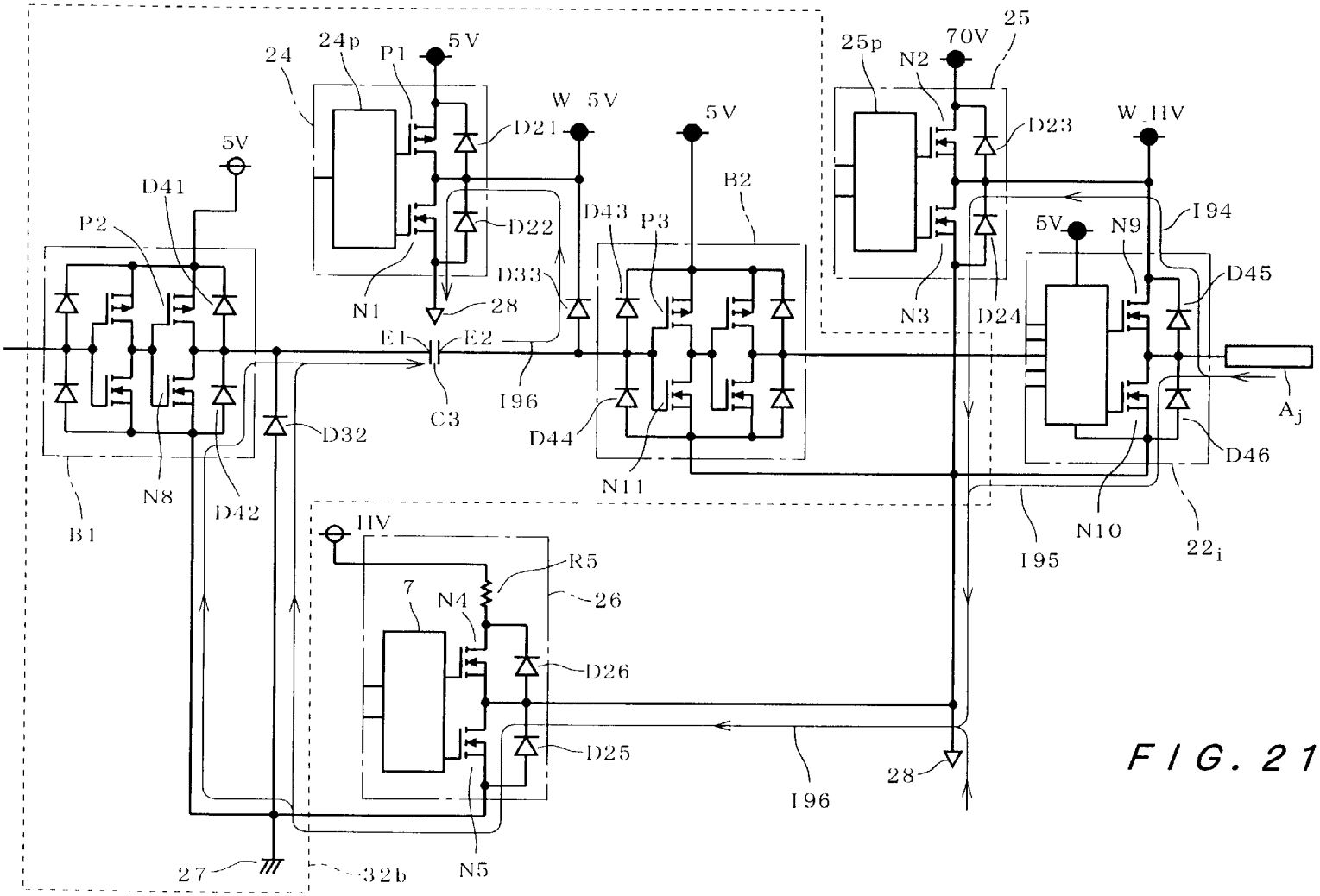

FIG. 21 corresponds to FIG. 14 illustrating the first embodiment, and is a circuit diagram showing a current flow obtained when the first common potential is supplied from the second common potential point 28. Differently from the first embodiment, the second 5V power source is connected to the high arm side of the buffer B2. Therefore, a current I96 flows to an NMOS transistor N1 of the power control circuit 24 through only the diode D33 without passing through the protective diode D43 of the buffer B2.

Figure 22:
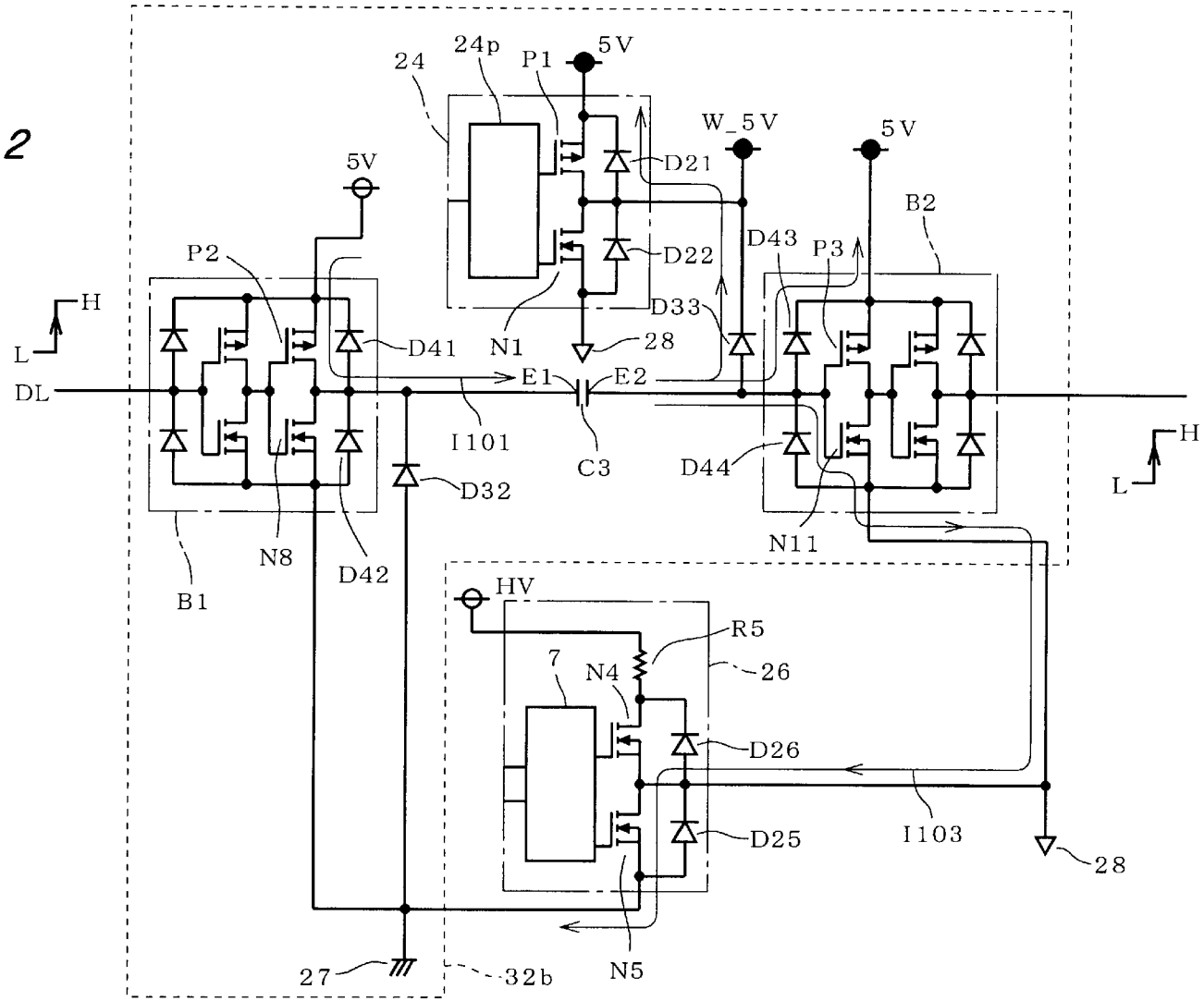

FIG. 22 corresponds to FIG. 15 illustrating the first embodiment, and is a circuit diagram showing a current flow obtained when the data latch signal DL is changed from "L" to "H", for example. For a write discharge period, the electric potential W_5V takes the second 5V potential. Therefore, the flow of a current I102 has no substantial difference. The current flowing in the protective diode D43 is different only in that it flows to the second 5V power source without passing through the diode D21.

Figure 23:
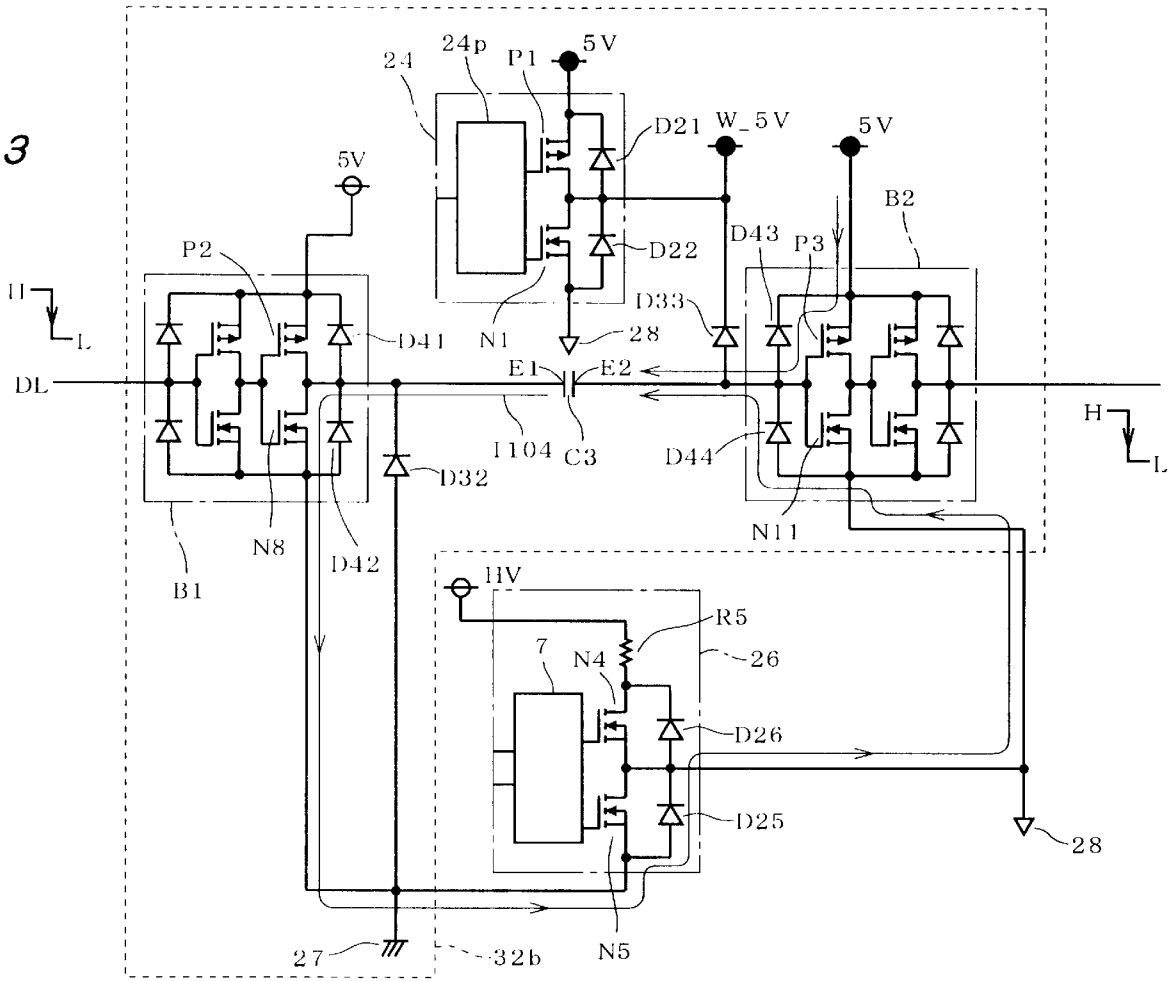

FIG. 23 corresponds to FIG. 16 illustrating the first embodiment, and is a circuit diagram showing a current flow obtained when the data latch signal DL is changed from "H" to "L". The flow of the leakage current I106 has no substantial difference. The leakage current I106 is different only in that it is supplied from the second 5V power source without passing through the PMOS transistor P1 of the power control circuit 24.

Figure 24:
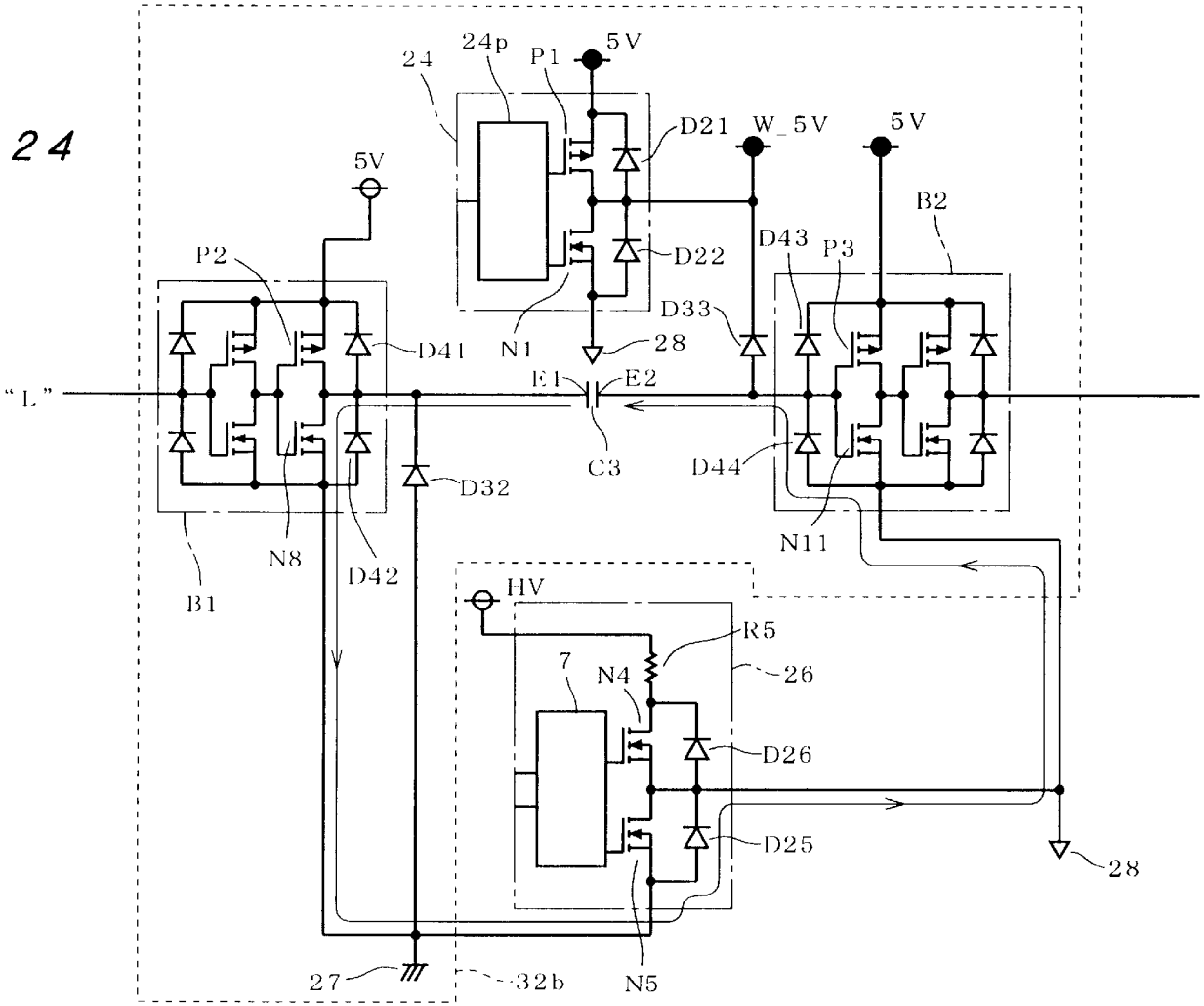

FIG. 24 corresponds to FIG. 17 illustrating the first embodiment, and is a circuit diagram showing a discharge of the capacitor C3 when an electric potential on the terminal E1 of the capacitor C3 has been higher than that on the terminal E2. The current flow makes no difference between FIGS. 17 and 24.

Figure 25:
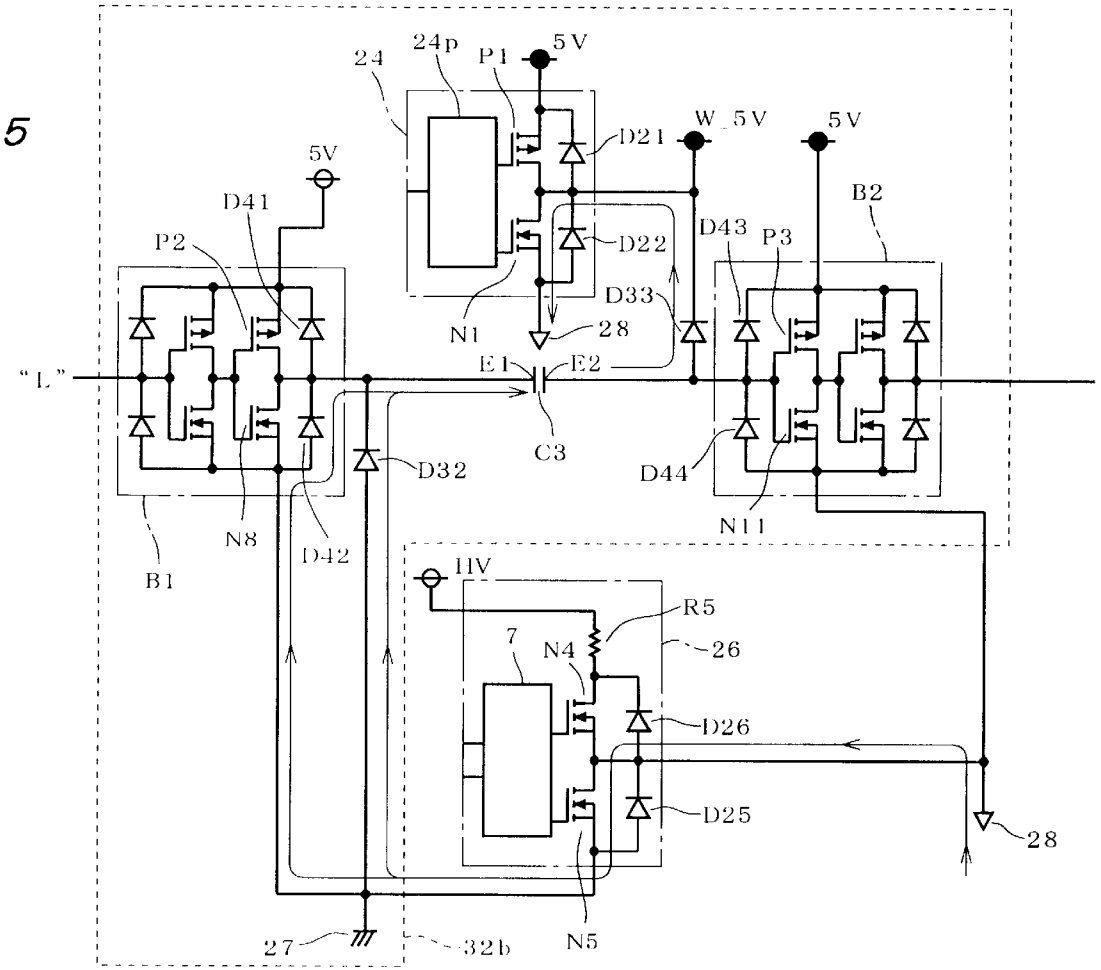

FIG. 25 corresponds to FIG. 18 illustrating the first embodiment, and is a circuit diagram showing a discharge of the capacitor C3 when the electric potential on the terminal E2 of the capacitor C3 has been higher than that on the terminal E1. Differently from the first embodiment, the second 5V power source is connected to the high arm side of the buffer B2 so that a discharge path does not include the protective diode D43 of the buffer B2.

D. Third Embodiment

Figure 26:
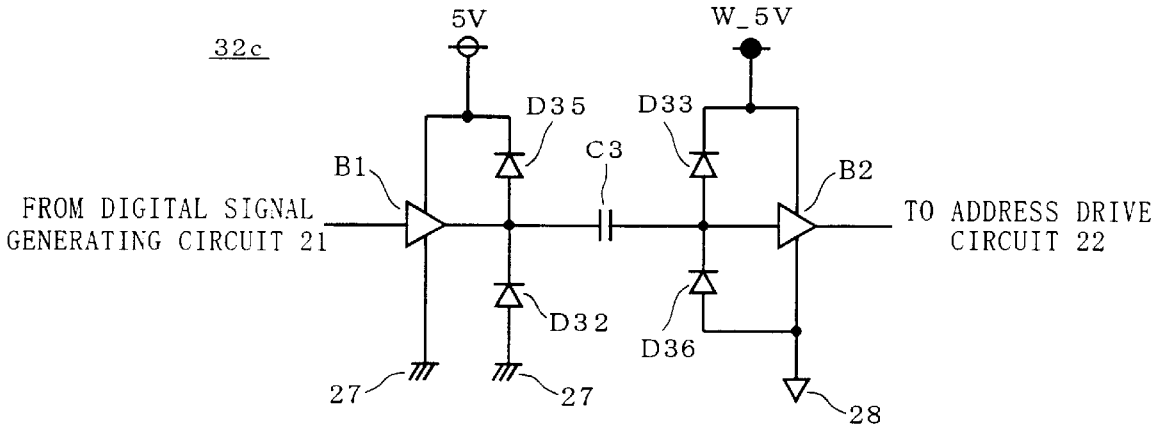
FIG. 26 is a circuit diagram showing a structure of a component 32*c;*

A third embodiment will describe a technique in which the component 32*a* shown in the first embodiment is deformed. FIG. 26 is a circuit diagram showing a structure of a component 32*c*. The component 32*a* is replaced by the component 32*c* to constitute the part 32 of the isolation circuit 23.

The component 32*c* has a structure in which diodes D35 and D36 are added to the component 32*a*. The first 5V power source and the cathode of a diode D32 are connected to a cathode of the diode D35 and an anode thereof, respectively. Furthermore, the anode of the diode D33 and the second electric potential point 28 are connected to a cathode of the diode D36 and an anode thereof, respectively.

Thus, the diodes D35 and D36 are added so that an output of the buffer B1 can be set to "H" to rapidly cause the second common potential to rise into the first HV potential in a sequence for the priming discharge sequence and the sequence for causing the sustain discharge as will be described below.

Figure 27:
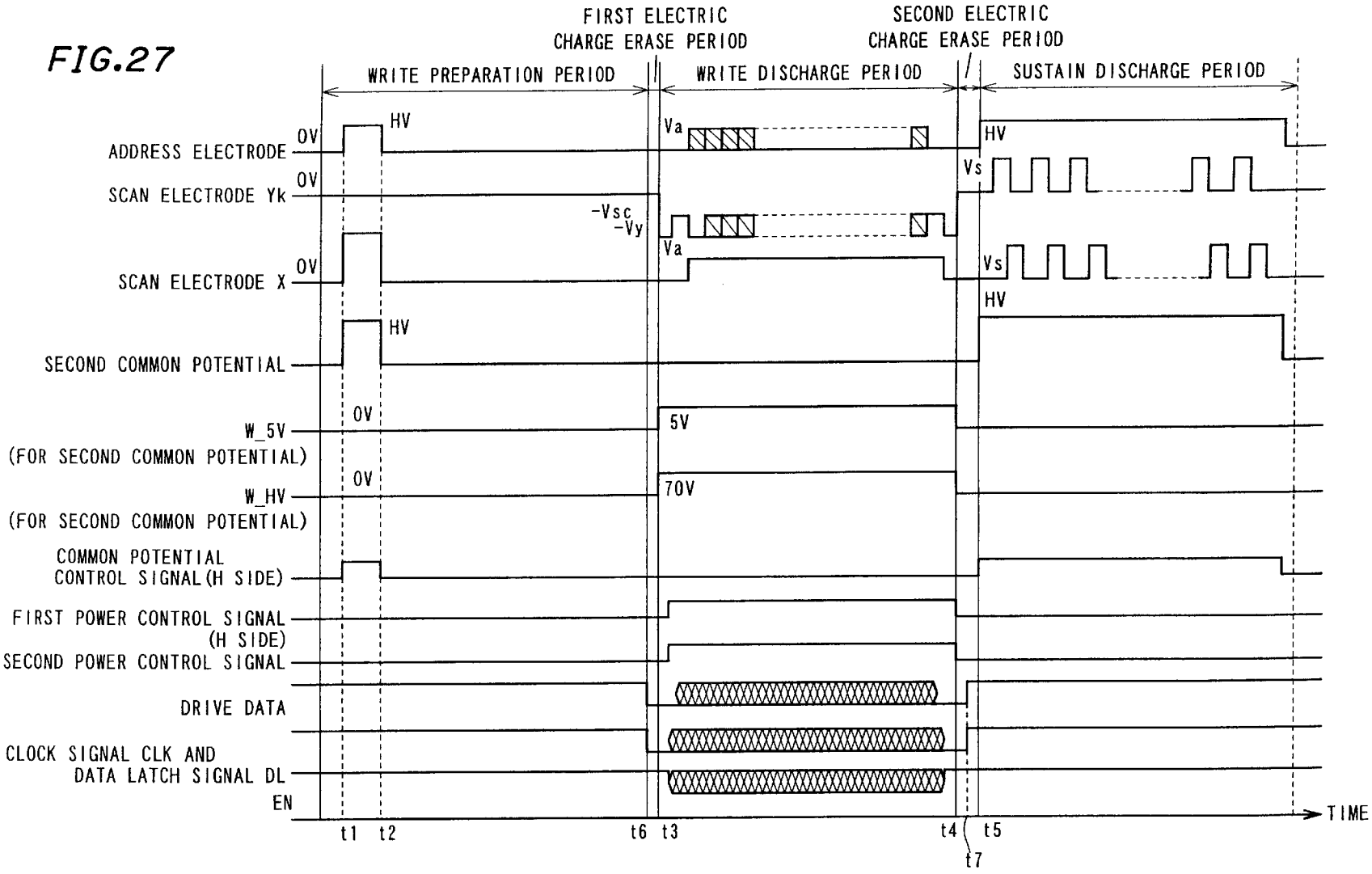
FIG. 27 is a timing chart showing the operation according to the second embodiment of the present invention.

FIG. 27 is a timing chart showing operation according to the present embodiment. As compared with FIG. 12 which is a timing chart illustrating the first embodiment, a difference is made in that drive data, the clock signal CLK, the data latch signal DL and the output enable signal EN are forcedly set to "H" for a write preparation period and a sustain discharge period. Before the write discharge period is started at a time t3, the drive data, the clock signal CLK and the data latch signal DL are forcedly set to "L" at a time t6 and the output enable signal is kept at "H". The write preparation period is terminated at the time t6, and the times t6 to t3 make a first electric charge erasing period. For the write discharge period, the clock signal CLK, the data latch signal DL and the output enable signal EN are not forcedly set, respectively.

The electric charge erasing period set at the times t4 to t5 in the first embodiment is set as a second electric charge erasing period in the present embodiment. At a time t7 for this period, the drive data, the clock signal CLK, the data latch signal DL and the output enable signal EN are forcedly set to "H" again.

Figure 28:
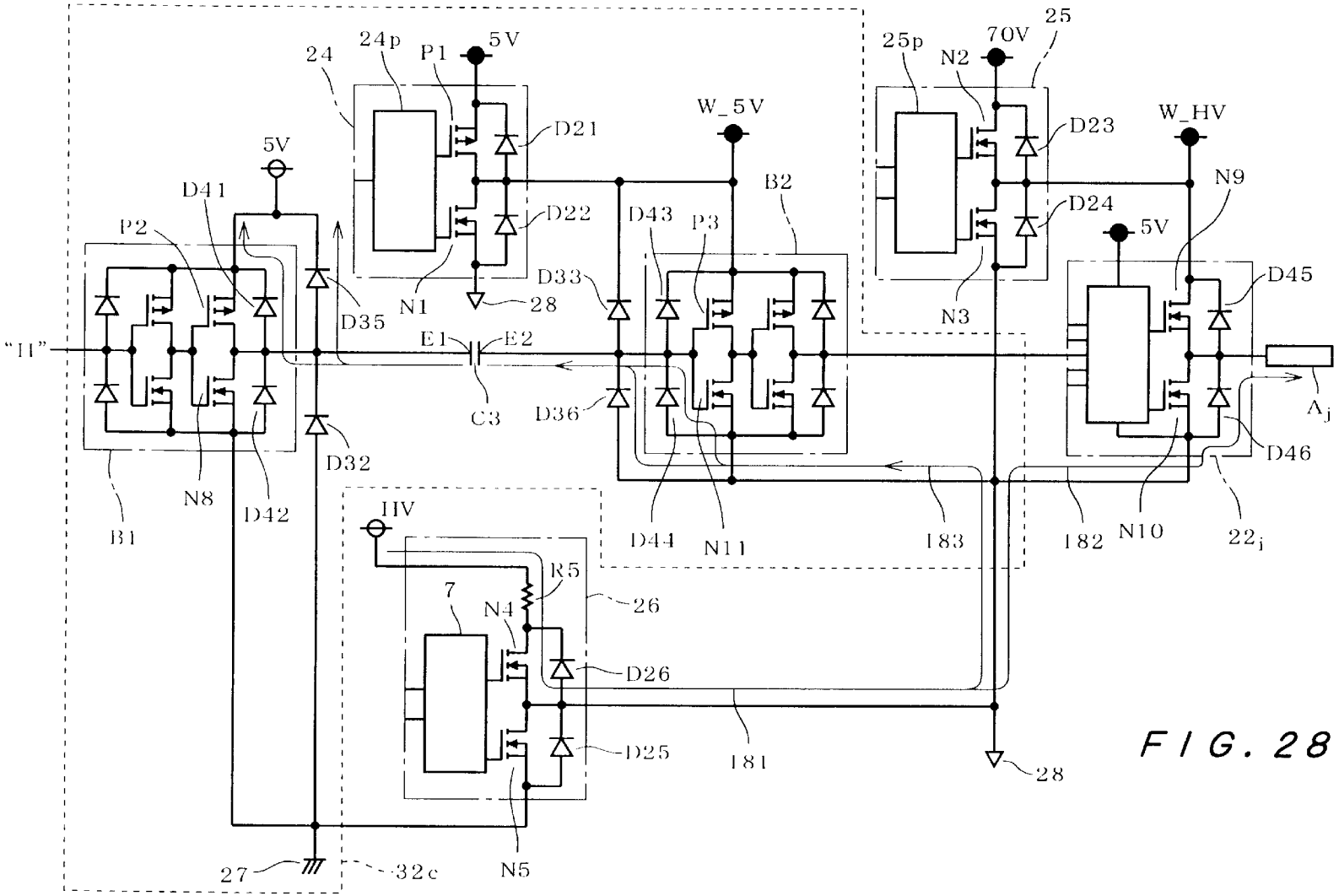
FIGS. 28 to 33 are circuit diagrams showing operation according to a third embodiment of the present invention.

The operation according to the present embodiment will be described below by attaching importance to differences made between the first embodiment and the present embodiment. FIG. 28 is a circuit diagram corresponding to FIG. 13 illustrating the first embodiment and shows a current flow obtained when the electric potential HV based on a first common potential is supplied from the second common potential point 28.

Since a control signal, for example, the data latch signal DL is forcedly set to "H", transistors P2 and N8 of the buffer B1 are on and off, respectively. Furthermore, since the output enable signal EN is forcedly set to "H", transistors N9 and N10 of the drive circuit $\mathbf{22}_i$ are off and on, respectively. In such a situation, when H and L sides of the common control signal have "H" and "L"at a time t1, NMOS transistors N4 and N5 of the power control circuit 26 are turned on and off respectively and a current I81 flows from the first HV power source to the second common potential point 28 through the NMOS transistor N4. A part of the current I81 flows from the second common potential point 28 to the address electrode $A_j$ through the protective diode D46 of the drive circuit $\mathbf{22}_i$ in the same manner as the current I92 in the first embodiment.

On the other hand, a part of the current I81 transiently flows as a current I83 from the second common potential point 28 through the diodes D36 and D44, a capacitor C3 and the diodes D35 and D41 in this order, thereby charging the capacitor C3. At this time, a voltage charged to the capacitor C3 by the current I83 is almost equal to a difference between the electric potential of the first HV power source and 5V. As compared with the first embodiment in which the voltage charged to the capacitor C3 is almost equal to the electric potential of the first HV power source, it is apparent that a time required for charging is more reduced in the present embodiment than in the first embodiment. In other words, the electric potential of the second common potential point 28 rapidly rises.

Furthermore, the diodes D35 and D36 are provided in parallel with the protective diodes D41 and D44, respectively. Therefore, an impedance of a charging path is lowered to help the above-mentioned operation be performed more rapidly. Of course, as long as the protective diodes D41 and D44 are provided in the buffers B1 and B2 respectively, the component 32*a* which does not include the diodes D35 and D36 can also execute an operating sequence for the first electric charge erasing period shown in FIG. 27, thereby causing the electric potential of the second common potential point 28 to rise rapidly.

Figure 29:
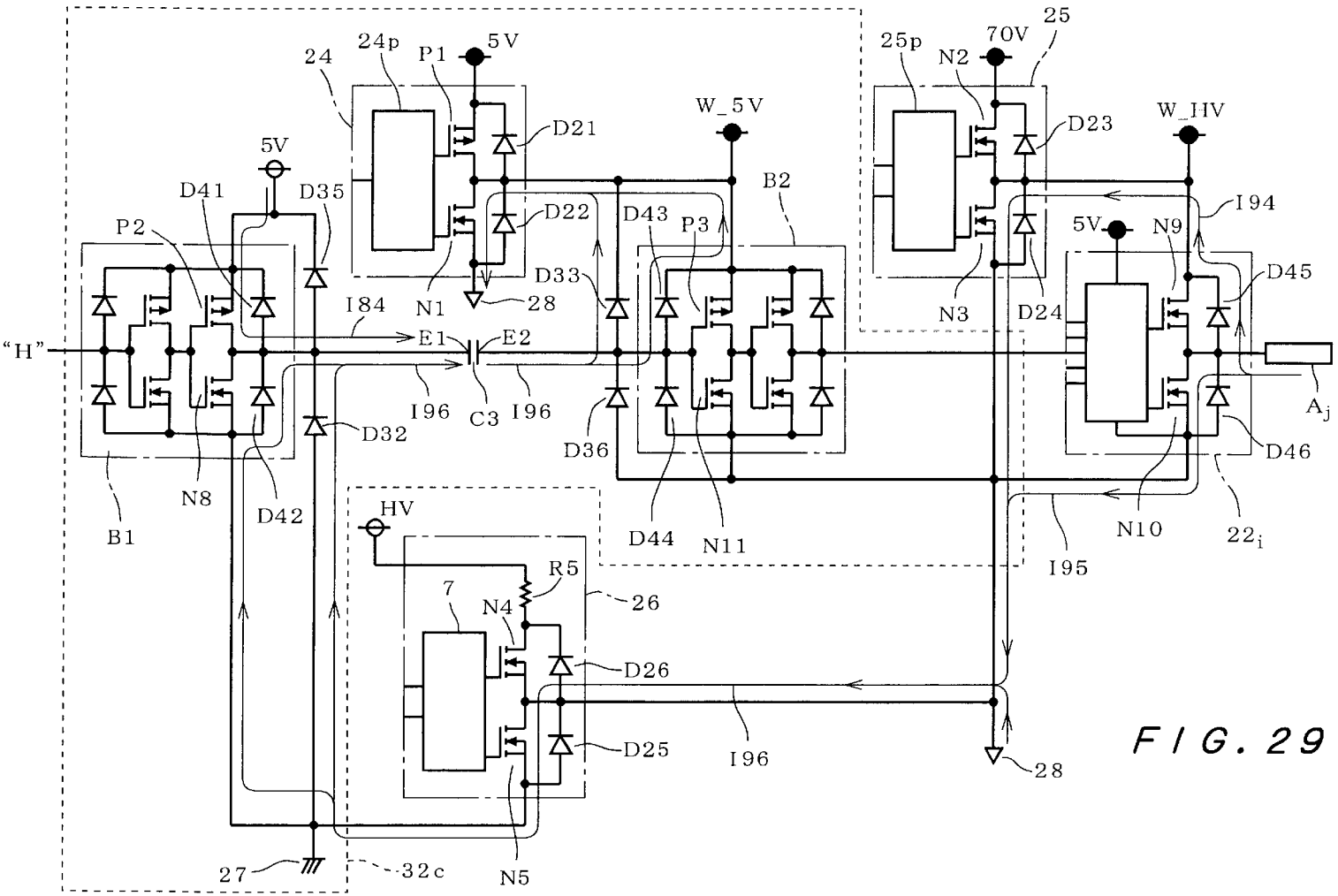

FIG. 29 corresponds to FIG. 14, and is a circuit diagram showing a current flow obtained when the first common potential is supplied from the second common potential point 28. In the same manner as in the first embodiment, currents I94, I95 and I96 flow so that electric charges of the capacitor C3 are discharged. In the present embodiment, however, the capacitor C3 is kept somewhat charged. Since "H" is input to the buffer B1, the PMOS transistor P2 thereof is turned on, electric charges are supplied from the first 5V power source and an electric potential on the terminal E1 is higher than that on the terminal E2 by 5V. In order to perform a discharge, the first electric charge erasing period is provided at the times t6 to t3.

Figure 30:
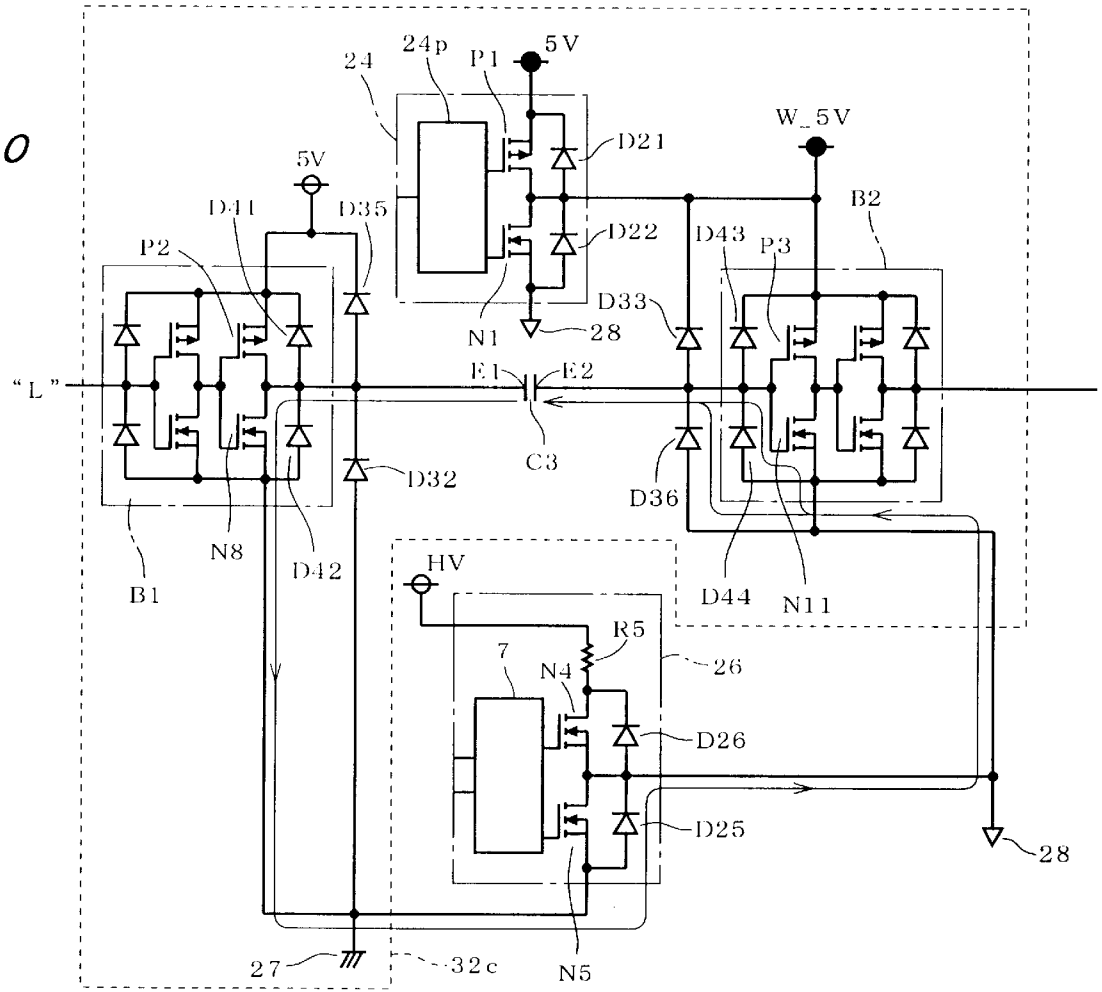

FIG. 30 is a circuit diagram showing the discharge of the capacitor C3 for the first electric charge erasing period. Since the drive data, the data latch signal DL and the clock signal CLK are forcedly set to "L", almost the same operation as for the electric charge erasing period according to the first embodiment shown in FIG. 17 is performed. The diode D36 is connected in the same direction in parallel with the protective diode D44 of the buffer B2. Therefore, a difference is made only in that the diode D36 is added to a discharging current path in parallel with the protective diode D44.

Figure 31:
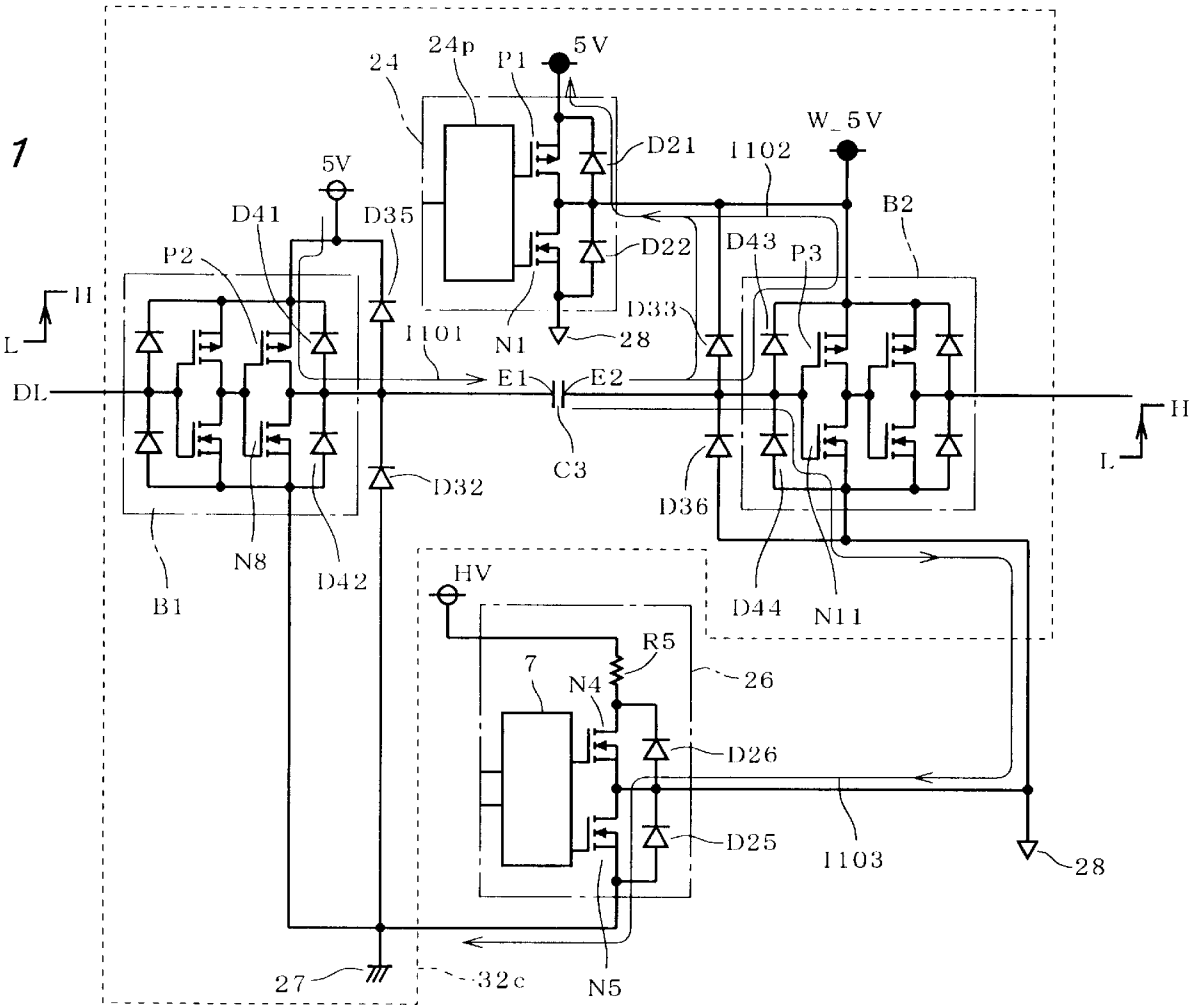

Although the operation to be performed for the write discharge period is almost the same as in the first embodiment, a path for a current for charging and discharging the capacitor C3 is somewhat different when a level input to the buffer B1 is changed. FIG. 31 is a circuit diagram corresponding to FIG. 15 and shows a current flow obtained when the data latch signal DL is changed from "L" to "H". Both the PMOS transistor P2 of the buffer B1 and the NMOS transistor N11 of the buffer B2 are turned on. Therefore, neither of the diodes D35 and D36 added to the component 32*a* according to the first embodiment contribute to a current path. Accordingly, the current path is the same as in the first embodiment.

Figure 32:
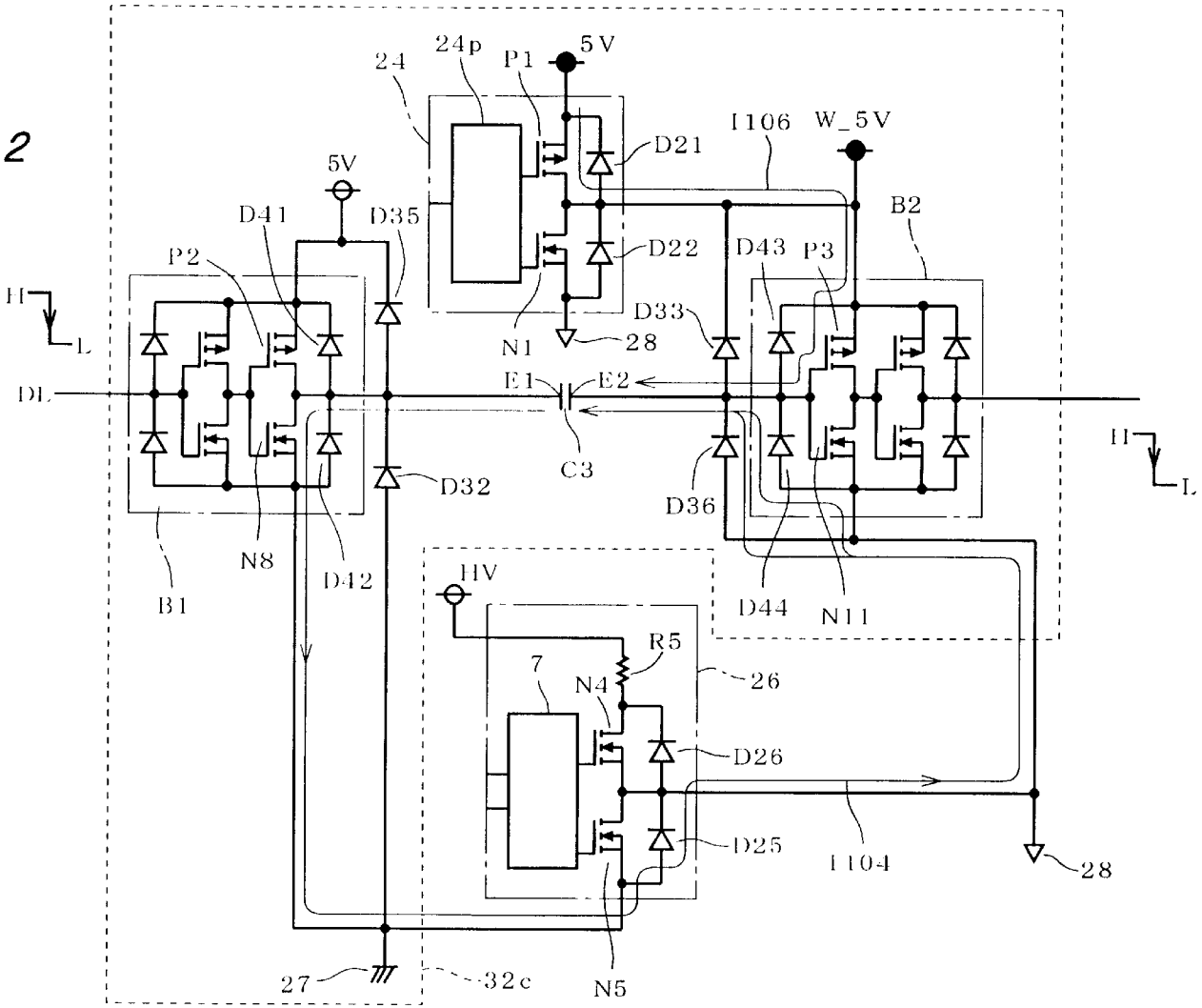

FIG. 32 is a circuit diagram corresponding to FIG. 16 and shows a current flow obtained when the data latch signal DL is changed from "H" to "L". Since the diode D35 is reversibly biased, it does not contribute to the current path, either. The diode D36 is connected in the same direction in parallel with the protective diode D44 in the input stage of the buffer B2. Therefore, a difference is made only in that the diode D36 is added to a discharging current path in parallel with the protective diode D44.

A second electric charge erasing period is started and the clock signal CLK, the data latch signal DL and the drive data are forcedly set to "L" also at the time t4 successively to the write discharge period. Accordingly, the capacitor C3 is discharged in the same manner as for the electric charge erasing period according to the first embodiment.

Figure 33:
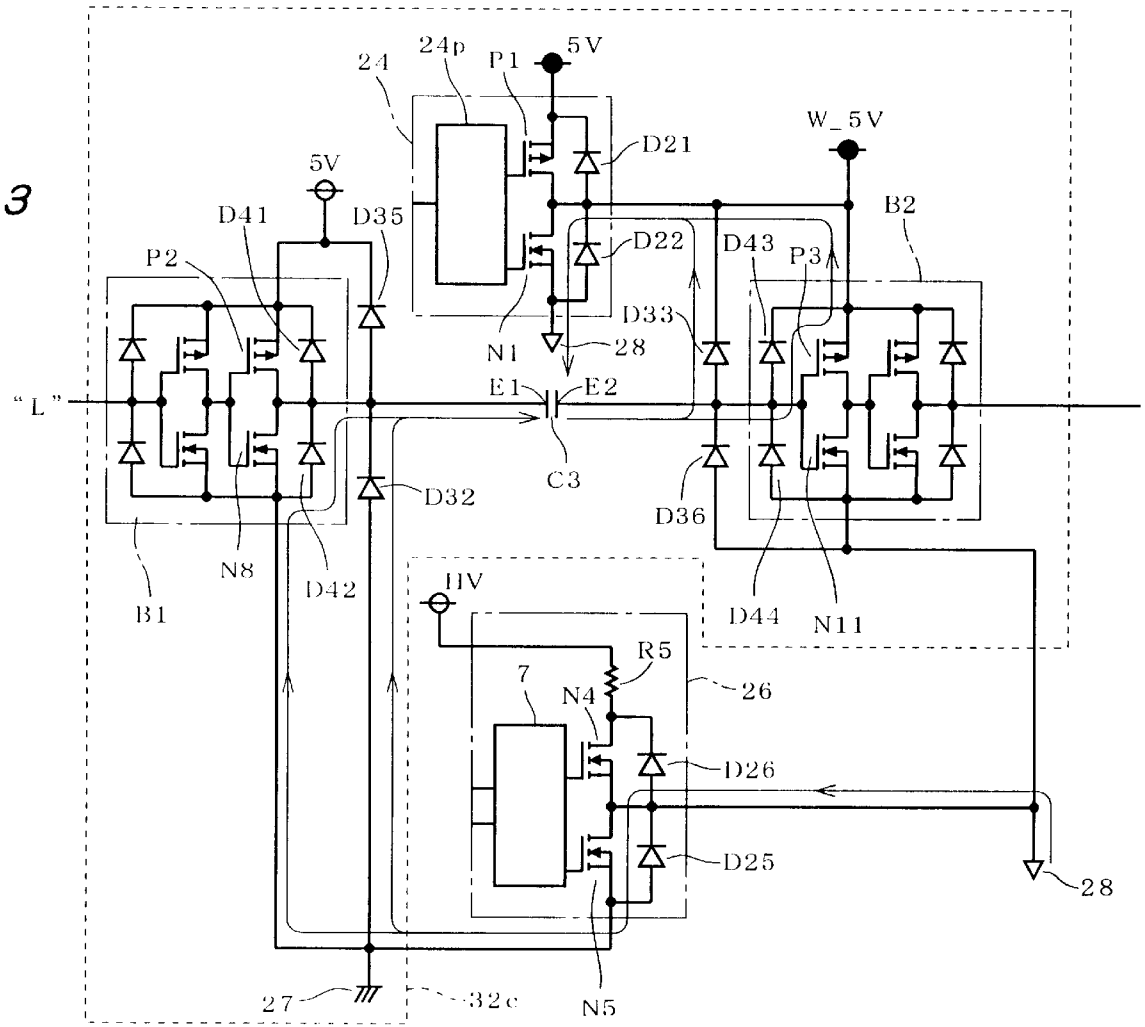

In a case where an electric potential on the terminal E1 is charged more highly than that on the terminal E2 in the capacitor C3, the same operation as that for the first electric charge erasing period shown in FIG. 30 is performed. On the other hand, FIG. 33 is a circuit diagram showing a discharge path obtained when the electric potential on the terminal E1 is charged more highly than that on the terminal E2 in the capacitor C3, which corresponds to FIG. 18. The discharge path is the same as in FIG. 18.

After the discharge of the capacitor C3, the clock signal CLK, the data latch signal DL and the drive data are forcedly set to "H" at a time t7 prior to the time t5 that the sustain discharge period is started. The reason is that the second common potential point 28 should rapidly rise because it supplies the first HV potential for the sustain discharge period.

E. Fourth Embodiment

Figure 34:
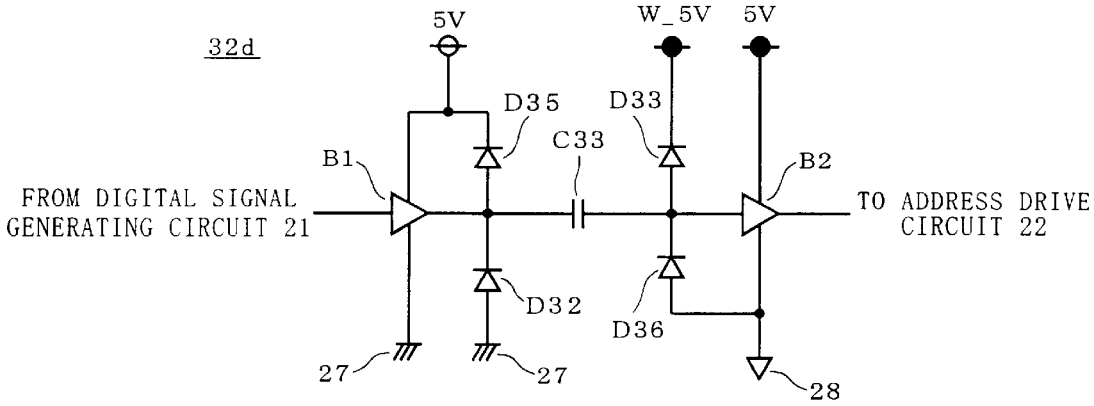
FIG. 34 is a circuit diagram showing a structure of a component 32*d;*

A fourth embodiment will describe a technique in which the component 32*c* shown in the third embodiment is deformed. FIG. 34 is a circuit diagram showing a structure of a component 32*d*. The component 32*a* is replaced by the component 32*d* to constitute the part 32 of the isolation circuit 23.

The component 32*d* is different only in that it applies a second 5V potential to the buffer B2 to which the electric potential W_5V is applied in the component 32*c*. More specifically, while an electric potential is applied to a diode D33 in the same manner as in the first embodiment, the second 5V potential is always applied to the buffer B2. Accordingly, it is possible to relieve an output load of the power control circuit 24 for applying the electric potential W_5V to both the diode D33 and the buffer B2.

Figure 35:
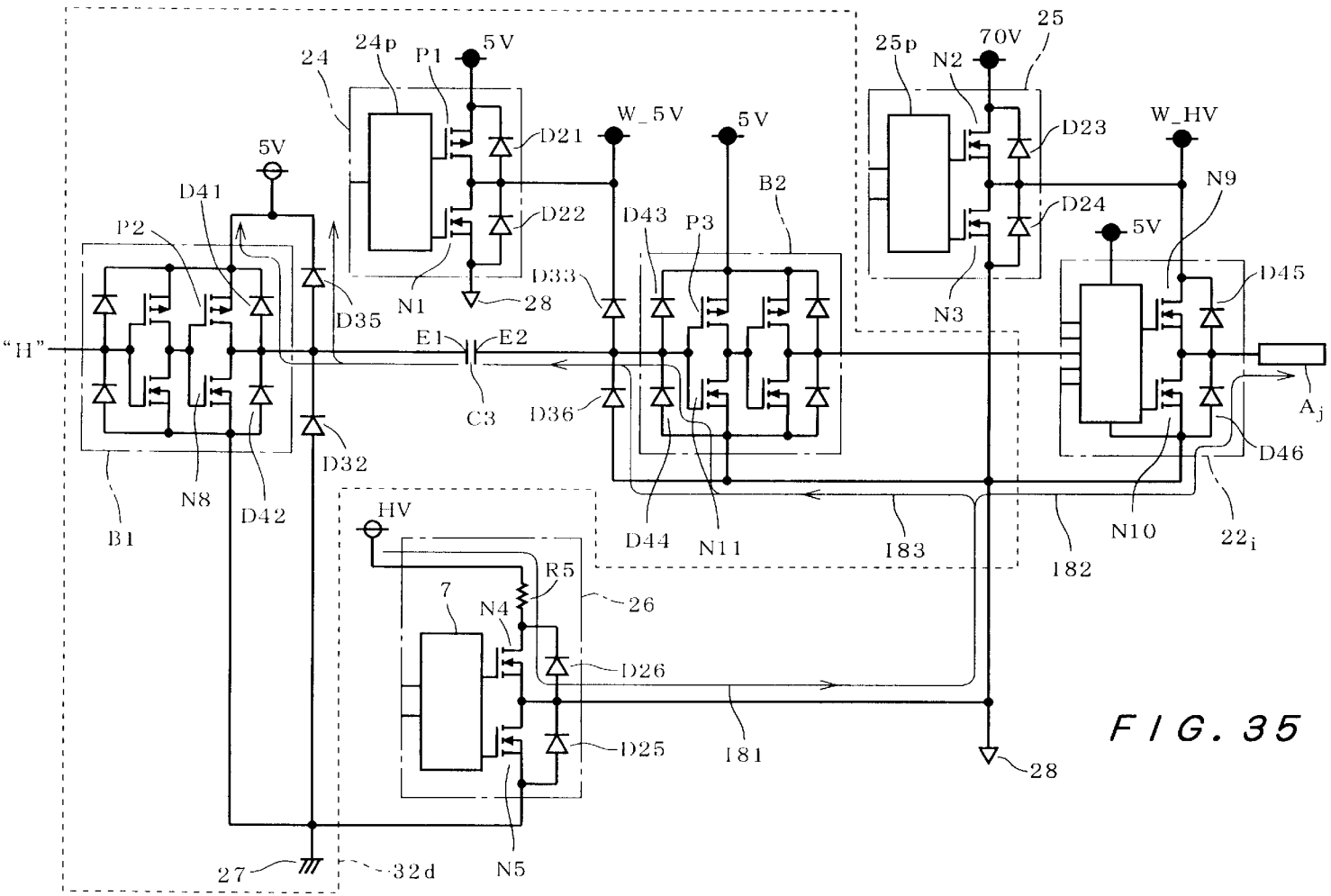
FIGS. 35 to 40 are circuit diagrams showing operation according to a fourth embodiment of the present invention.
Figure 36:
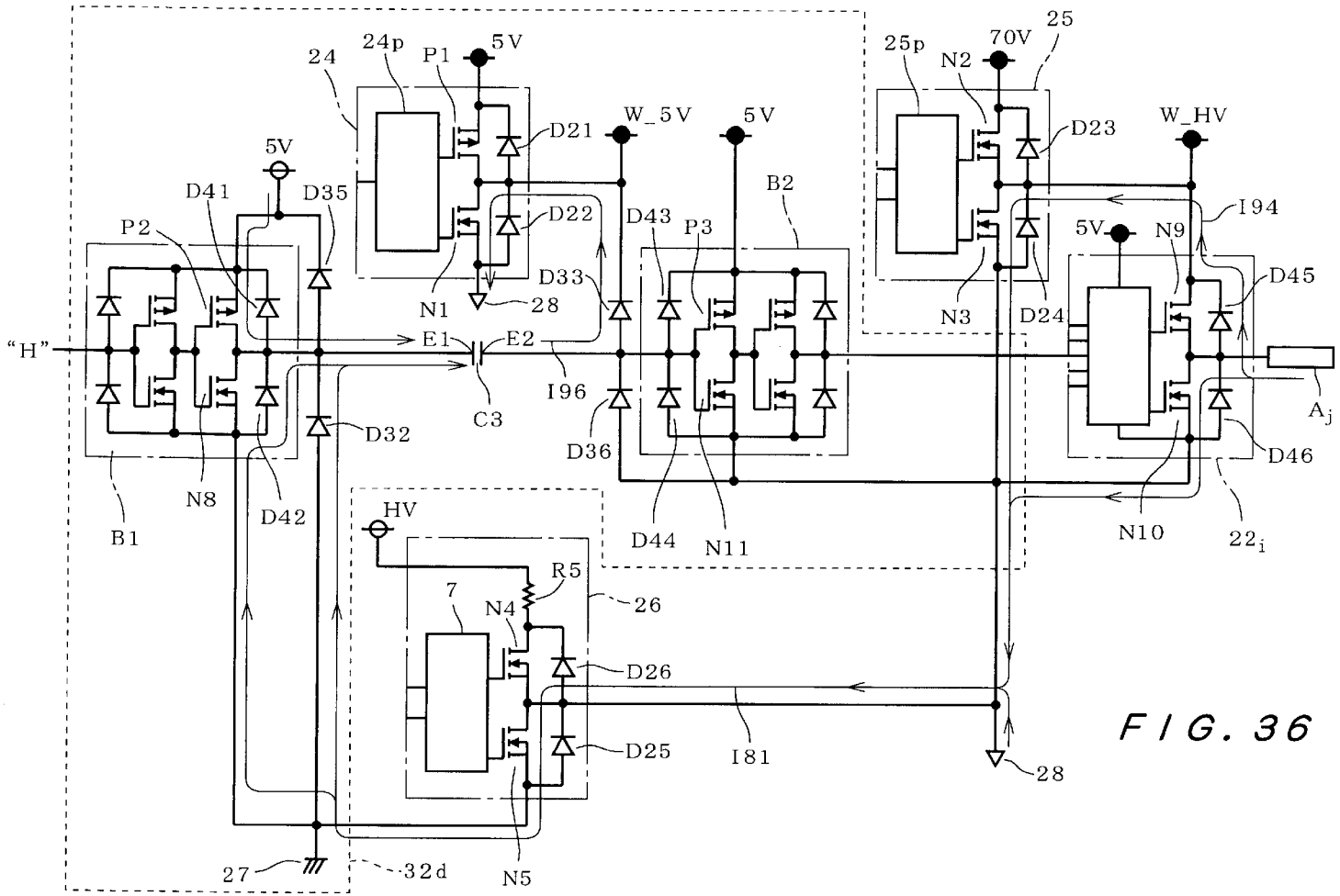

An operating sequence employed in the present embodiment is identical to the operating sequence according to the third embodiment shown in FIG. 27. Operation according to the present embodiment will be described below by attaching importance to differences. FIGS. 35 and 36 are circuit diagrams showing the operation to be performed for a write preparation period according to the present embodiment, and correspond to FIGS. 28 and 29 respectively. A charging and discharging current of the capacitor C3 for the write preparation period according to the present embodiment is almost the same as that in the third embodiment. As shown in FIG. 36, in the case where the second common potential point 28 supplies the first common potential, a difference is made in that the current I96 does not pass through the cathode of the protective diode D43 because the second 5V potential is supplied thereto.

Figure 37:
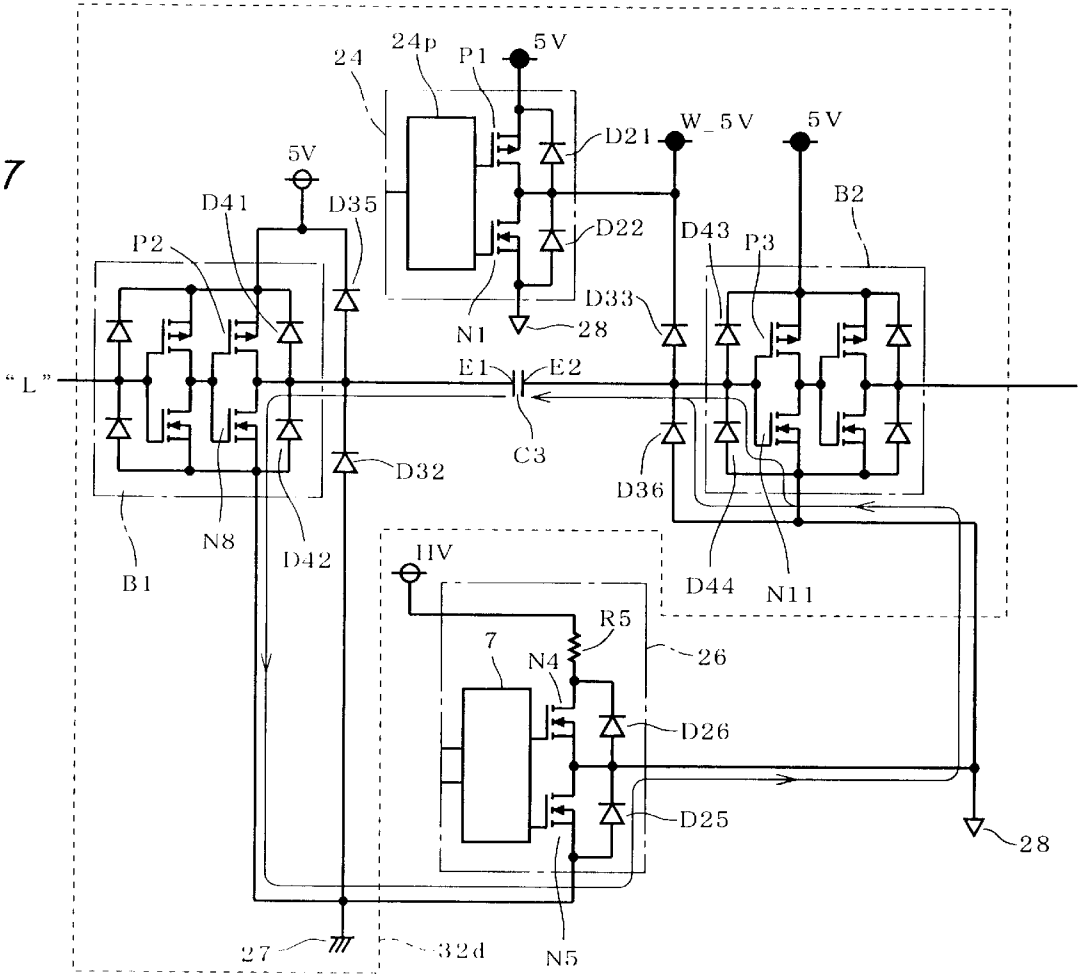
Figure 38:
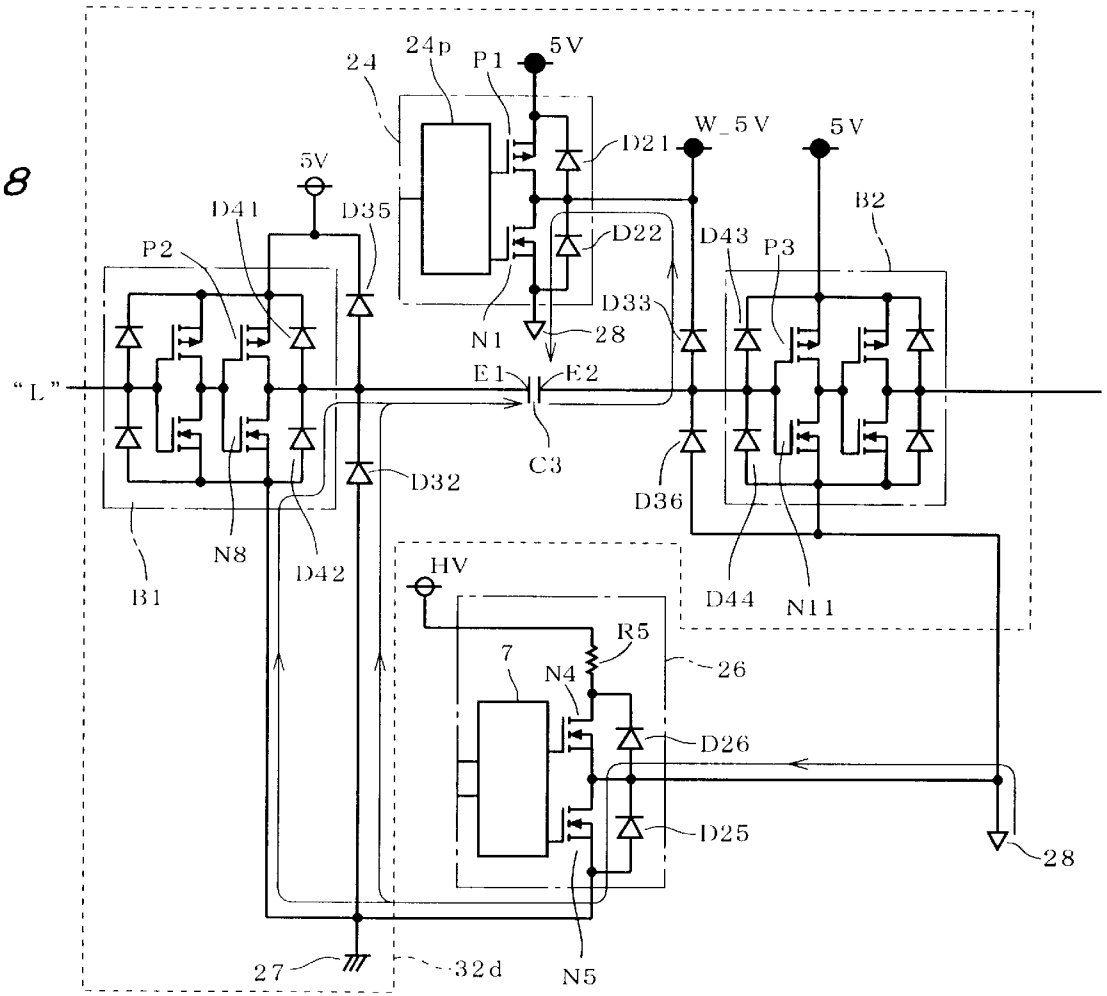

FIG. 37 is a circuit diagram showing a path for a discharging current of the capacitor C3 for the first electric charge erasing period and the second electric charge erasing period obtained in a case where the terminal E1 of the capacitor C3 is charged more highly than the terminal E2 in the present embodiment. FIG. 38 is a circuit diagram showing a path for the discharging current of the capacitor C3 for the second electric charge erasing period in a case where the terminal E2 of the capacitor C3 is charged more highly than the terminal E1 in the present embodiment. FIGS. 37 and 38 correspond to FIGS. 30 and 33 according to the third embodiment respectively, and illustrate almost the same paths for the discharging current as those in FIGS. 30 and 33. As shown in FIG. 38, a difference is made in that the protective diode D43 does not act as a discharging path because the second 5V potential is supplied to a cathode thereof for the second electric charge erasing period in which the terminal E2 of the capacitor C3 is charged more highly than the terminal E1.

Figure 39:
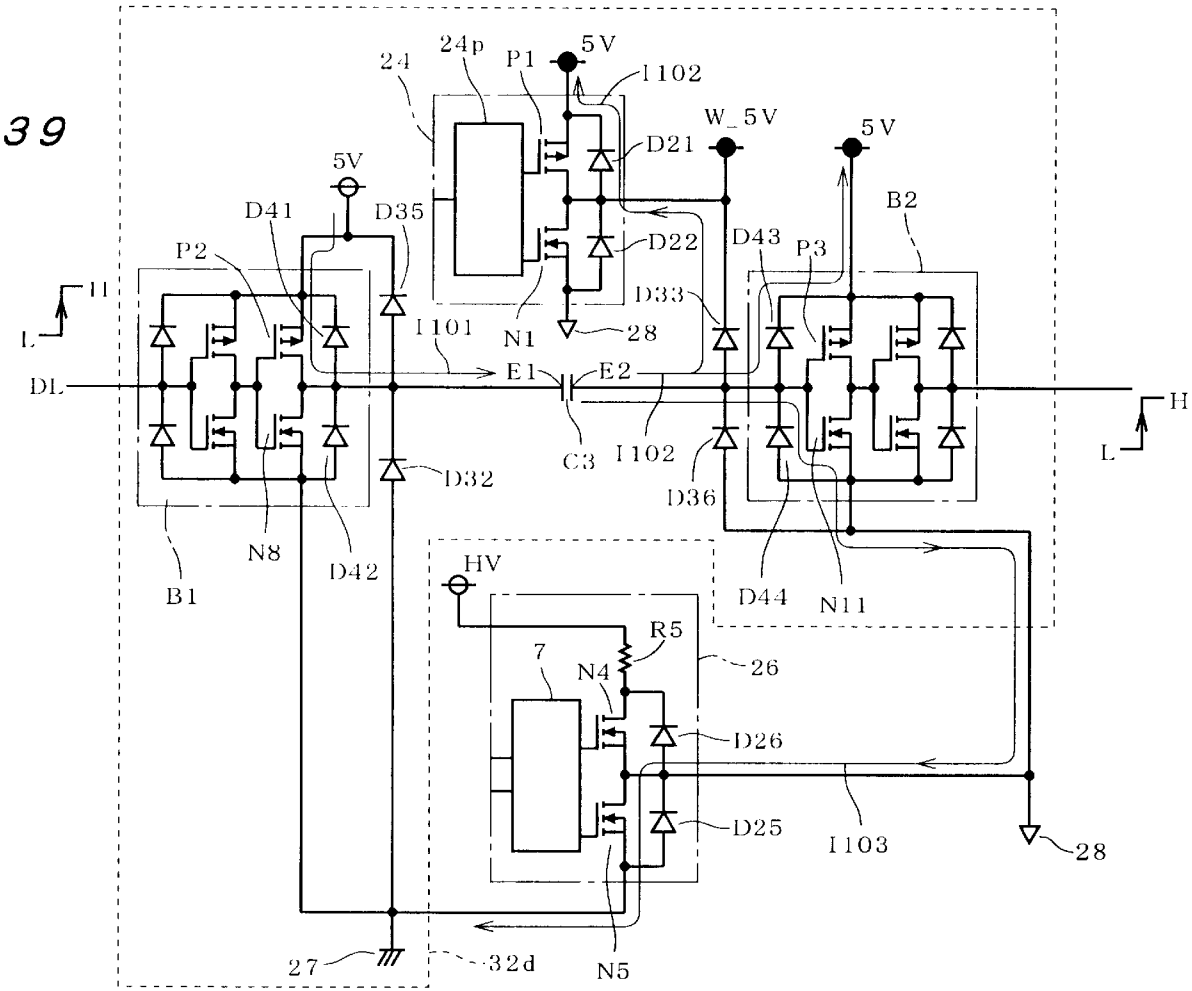
Figure 40:
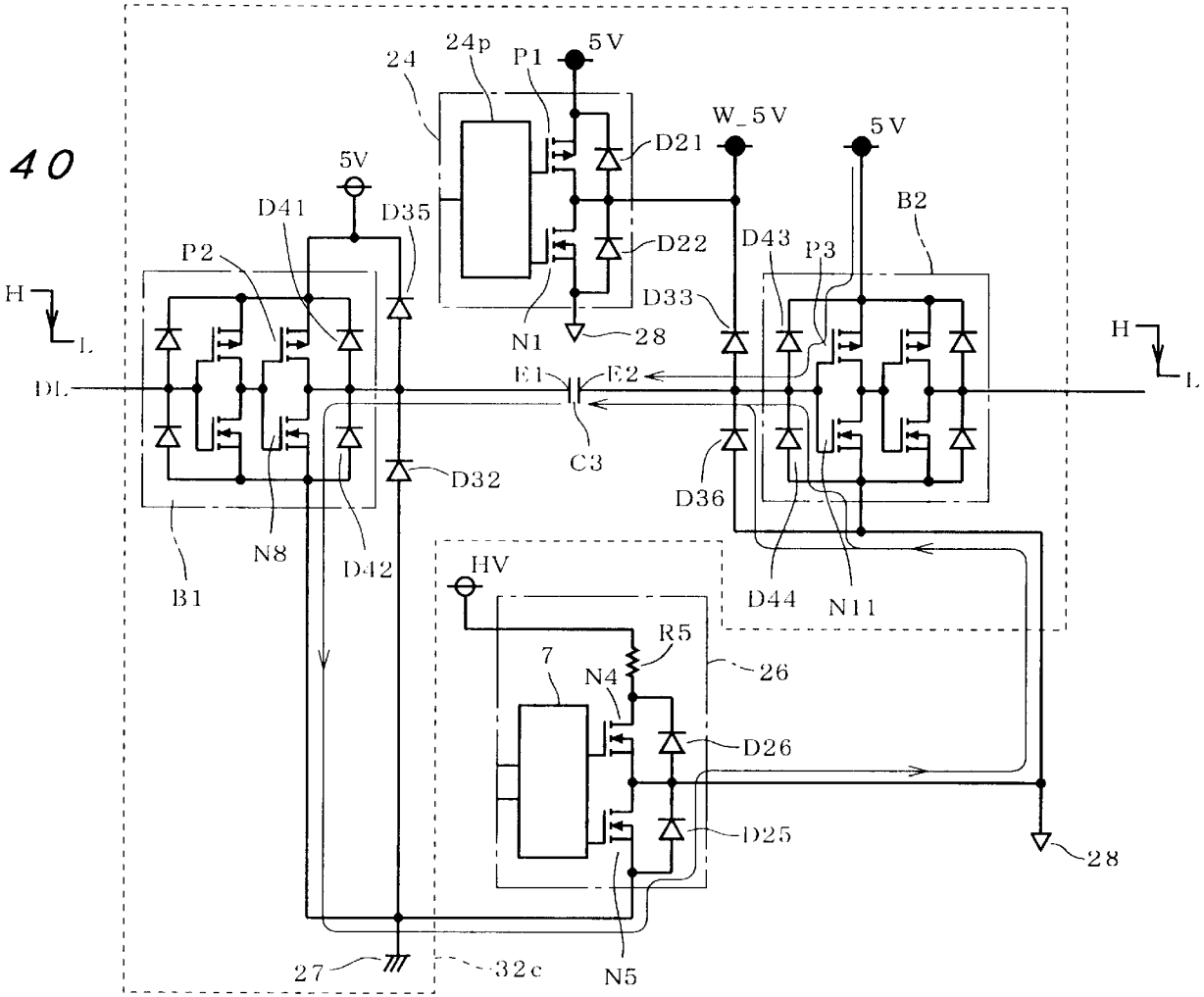

FIGS. 39 and 40 correspond to FIGS. 31 and 32 respectively, and show a current flow obtained when a data latch signal DL is changed from "L" to "H" and from "H" to "L" for a write discharge period. For the write discharge period, the second 5V potential is supplied to the electric potential W_5V. Therefore, a substantial current flow is not different from that in the third embodiment. A difference is made only in that a current flowing in the protective diode D43 flows to a second 5V power source without passing through a diode D21 when the data latch signal DL is changed from "L" to "H" (FIG. 39). Furthermore, a difference is made only in that a current is supplied from the second 5V power source without passing through the PMOS transistor P1 of the power control circuit 24 when the data latch signal DL is changed from "L" to "H" (FIG. 40).

F. Fifth Embodiment

Figure 41:
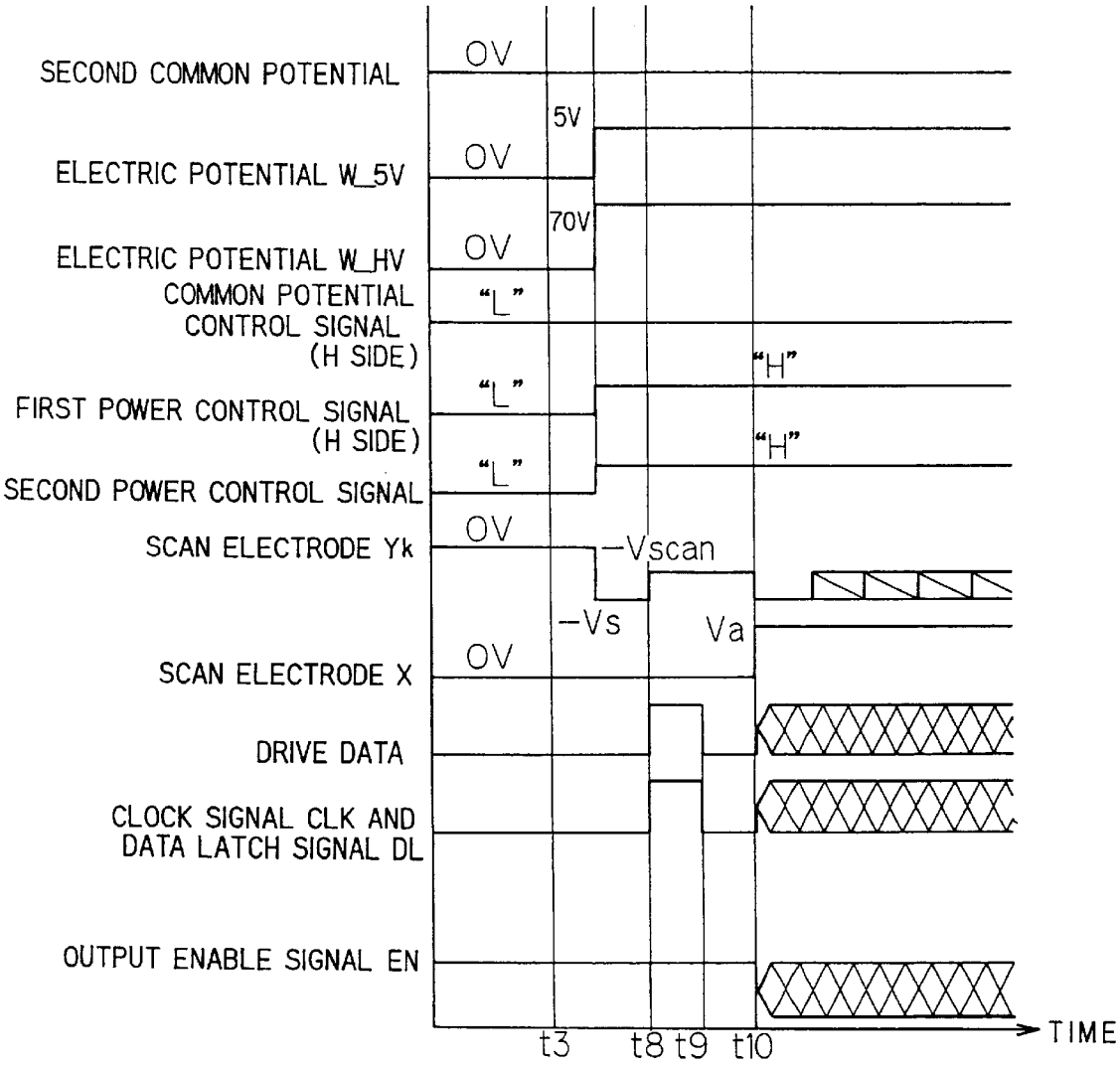
FIG. 41 is a timing chart showing operation according to a fifth embodiment of the present invention.

FIG. 41 is a timing chart showing operation according to a fifth embodiment. In the fifth embodiment, an electric charge erasing period of the capacitor C3 is performed at the beginning of a write discharge period (times t8 to t10) in the circuits used in the first to fourth embodiments. The scan electrode $Y_k$ first takes a scan potential $-V_{SC}$ at the time t8, and first takes an electric potential Va at the time t10. At the time t8, the H side of the common control signal, the H side of the first power control signal and the second power control signal have already been set to "L", "H" and "H", respectively. After the time t8, consequently, the second common potential and electric potentials W_5V and W_HV take the first common potential (ground potential), the second 5V potential and the second HV potential, respectively.

In any of the first to fourth embodiments, drive data, the clock signal CLK and the data latch signal DL are forcedly set to "L" and the output enable signal EN is forcedly set to "H" immediately before a time t3 (that is, after the time t6 even in the third and fourth embodiments). In the present embodiment, the drive data, the clock signal CLK and the data latch signal DL are forcedly set to "H" at the time t8, are forcedly set to "L" at a time t9 and become active at the time t10.

Figure 42:
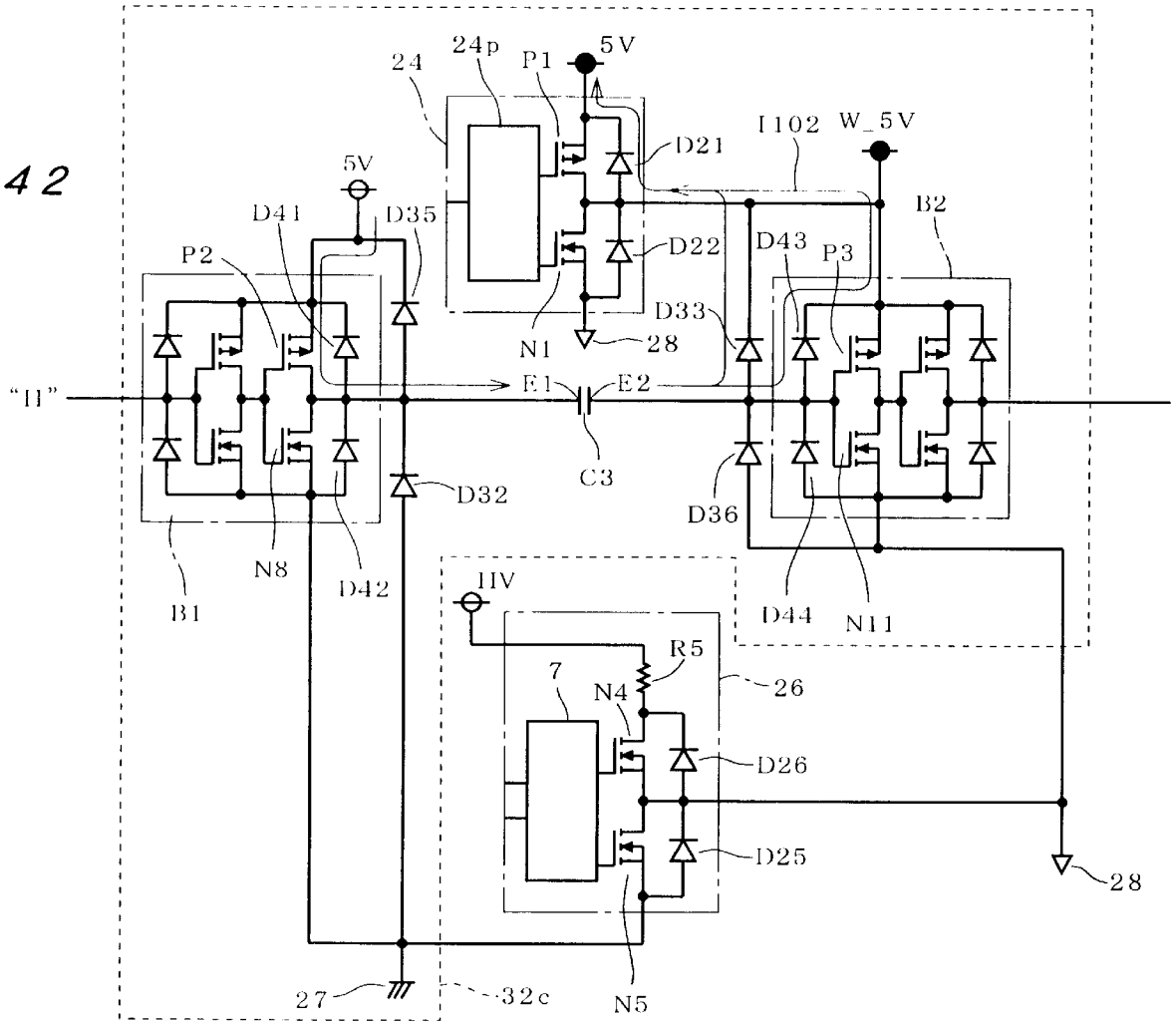
FIGS. 42 and 43 are circuit diagrams showing the operation according to the fifth embodiment of the present invention.

FIG. 42 is a circuit diagram showing operation to be performed at the times t8 to t9 according to the present embodiment for the circuit shown in the third embodiment. When the data latch signal DL is set to "H" at the time t8 (so are the drive data and the clock signal CLK), the PMOS transistor P2 and the NMOS transistor N8 in the buffer B1 are turned on and off, respectively. Furthermore, the PMOS and NMOS transistors P1 and N1 of the power control circuit 24 have already been on and off, respectively.

In a case where the terminal E2 is charged to have a higher electric potential than the electric potential on the terminal E1 in the capacitor C3 before the time t8, the electric potential on the terminal E2 of the capacitor C3 performs step-up to exceed 5V at the time t8. Consequently, a discharging current flows toward the second 5V power source through a parallel connection of diodes D33 and D43 and the diode D21. On the other hand, the first 5V potential is supplied to the terminal E1 through the PMOS transistor P2. The circuit shown in the first embodiment also has the same path. In the circuits according to the second and fourth embodiments, the discharging current flows in the protective diode D43 without passing through the diode D21.

Since the second common potential point 28 takes the first common potential, the protective diode D44 or, furthermore, the diode D36 is reversibly biased. Accordingly, an electric potential of 5V is applied for the first common potential on both the terminals E1 and E2 of the capacitor C3 so that a discharge is performed.

In a case where the terminal E1 is charged to have a higher electric potential than the electric potential on the terminal E2 in the capacitor C3 before the time t8, 5V is not exceeded even if the electric potential on the terminal E2 of the capacitor C3 performs the step-up. Therefore, the discharge shown in FIG. 42 is not caused. In the case where such charging is performed, the capacitor C3 is discharged at the times t9 to t10.

Figure 43:
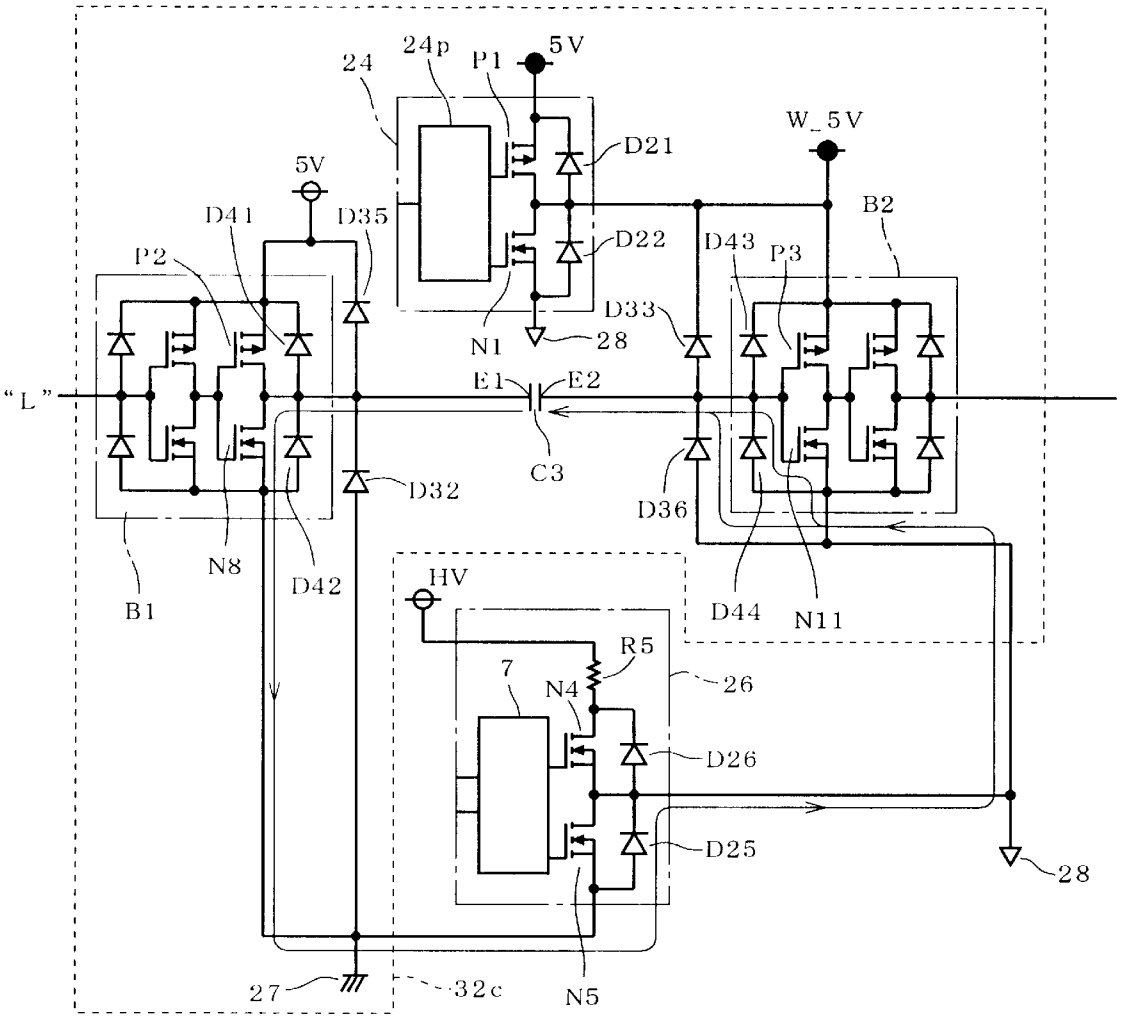

FIG. 43 is a circuit diagram showing operation performed at the times t9 to t10 in the present embodiment for the circuit shown in the third embodiment. At the times t9 to t10 in the present embodiment, when the data latch signal DL is set to "L" at the time t9 (so are the drive data and the clock signal CLK), the PMOS transistor P2 and the NMOS transistor N8 are turned off and on in the buffer B1, respectively. Differently from the first electric charge erasing period according to the third embodiment, the electric potential W_5V takes the second 5V potential. However, since the diodes D33 and D43 are reversibly biased, they cannot act as paths for a discharging current. In this case, accordingly, a discharge is the same as the operation to be performed for the first electric charge erasing period according to the third embodiment shown in FIG. 30.

G. Sixth Embodiment

Figure 44:
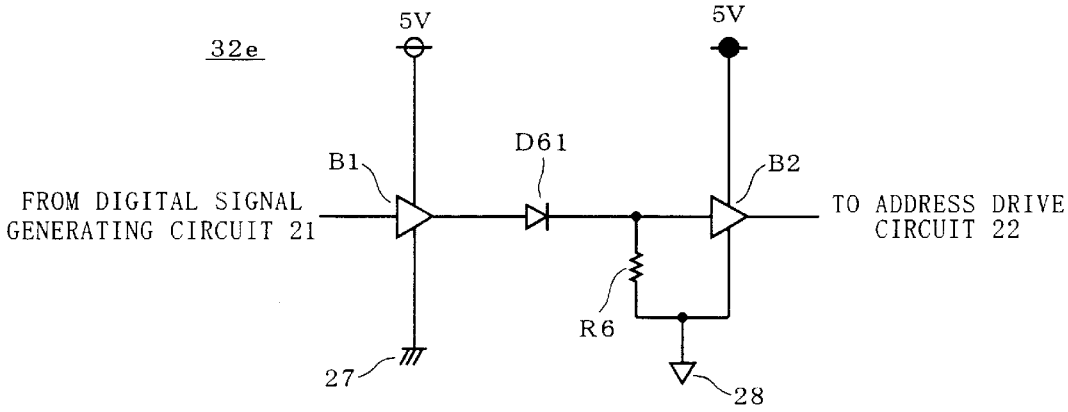
FIG. 44 is a circuit diagram showing a structure of a component 32*e;*

A sixth embodiment will describe a technique in which the component 32*a* shown in the first embodiment is deformed. FIG. 44 is a circuit diagram showing a structure of a component 32*e*. A capacitor is not used for an isolation in the component 32*e*. The component 32*a* is replaced by the component 32*e* to constitute the part 32 of the isolation circuit 23.

In the component 32*e*, for example, the data latch signal DL which is obtained from the digital signal generating circuit 21 is input to the buffer B1 (so are the clock signal CLK and one bit of drive data), and the output terminal of the buffer B1 is connected to an anode of a diode D61. Electric potentials are supplied from the first common potential point 27 and the first 5V power source to the buffer B1, respectively.

A cathode of the diode D61 is connected to the input terminal of the buffer B2 and one of terminals of a resistor R6 in common. The second 5V power source is connected to the power terminal of the buffer B2, and the second common potential point 28 is connected to the common terminal of the buffer B2 in common with the other terminal of the resistor R6.

In operation according to the present embodiment, therefore, the power control circuit 24 is not required and an electric charge erasing period for the capacitor C3 is not necessary.

Figure 45:
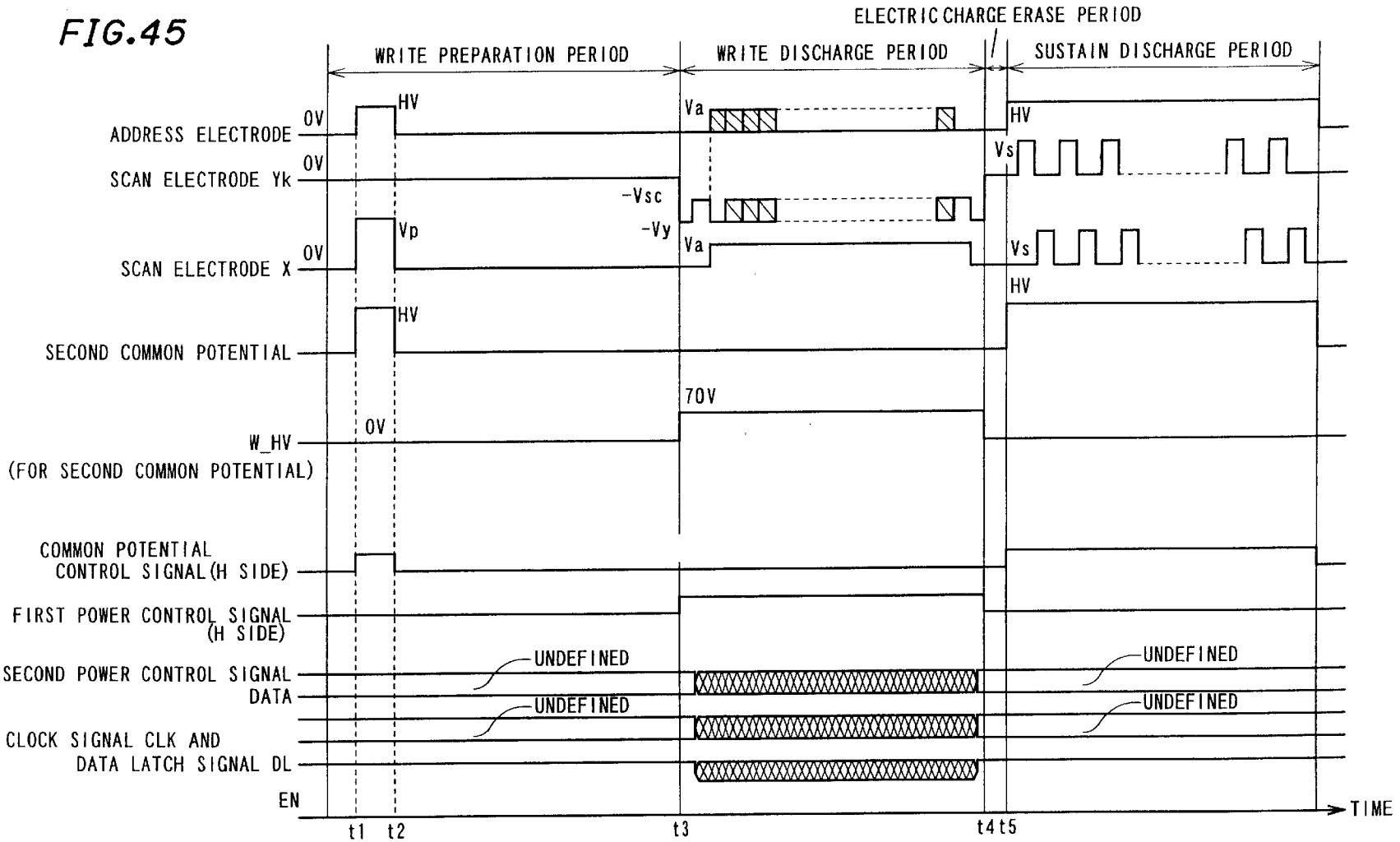
FIG. 45 is a timing chart showing operation according to a sixth embodiment of the present invention.

FIG. 45 is a timing chart showing the operation according to the present embodiment. The operation in the timing chart is different from the operation according to the first embodiment shown in FIG. 12 in that drive data, the clock signal CLK and the data latch signal DL may be "H" or "L" (undefined) in an inactive state.

Figure 46:
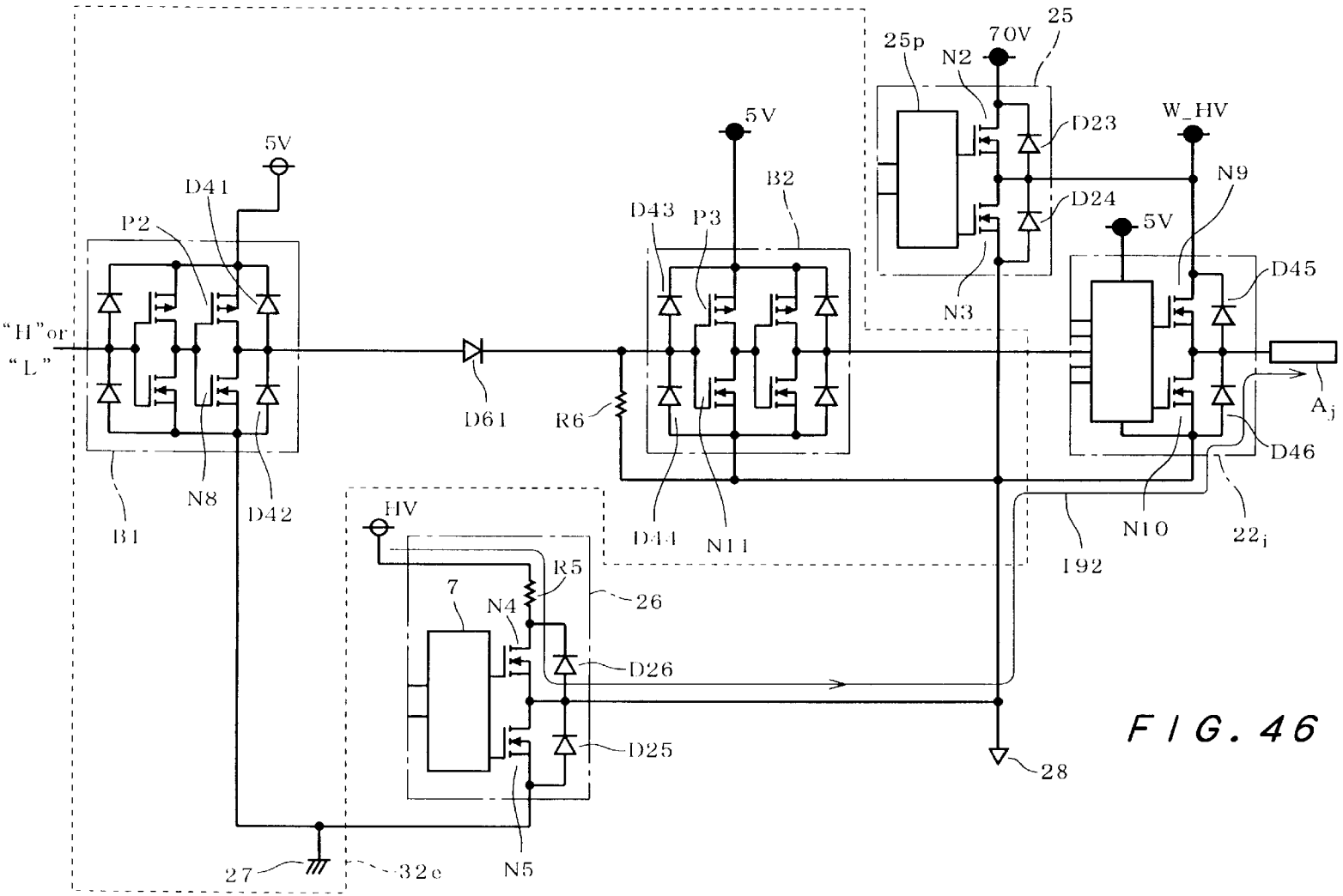
FIGS. 46 to 49 are circuit diagrams showing the operation according to the sixth embodiment of the present invention.
Figure 47:
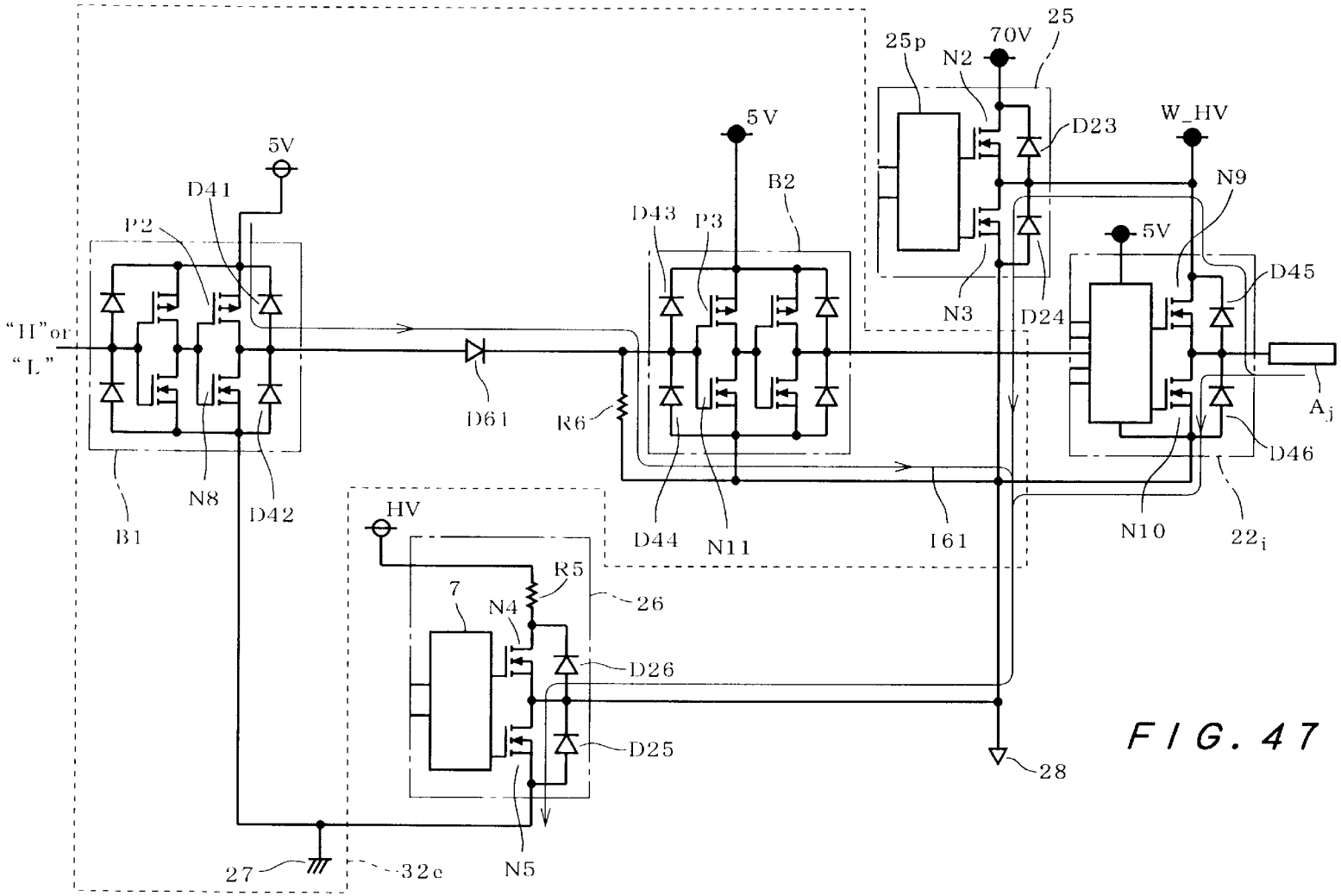

The operation to be performed for a write preparation period will be described below by attaching importance to differences between the present embodiment and the first embodiment. FIGS. 46 and 47 are circuit diagrams showing a current flowing when the second common potential is changed at times tl and t2, and correspond to FIGS. 13 and 14 respectively.

After the time t1, the current I92 flows to charge the address electrode $A_j$ in the same manner as in the first embodiment. For example, even if the data latch signal DL is any of "H" and "L", the cathode of the diode D61 is connected to the first HV power source through the resistor R6, the second common potential point 28 and the NMOS transistor N4 on the high arm side of the power control circuit 26. Therefore, the diode D61 is reversibly biased. Accordingly, even if the second common potential is raised, the current I93 shown in the first embodiment does not flow but the component 32*e* is isolated from a fluctuation in the second common potential.

After the time t2, electric charges stored in the address electrode $A_j$ are discharged to the first common potential point 27 through the NMOS transistor N10 on the low arm side of the drive circuit $22_i$ and the NMOS transistor N5 on the low arm side of the power control circuit 26 or the protective diode D45 on the high arm side of the drive circuit $22_i$ and the NMOS transistor N3 on the low arm side of the power control circuit 25 in the same manner as in the first embodiment.

If a level input to the buffer B1 is "H", the diode D61 is forward biased so that a forward current I61 flows. By limiting the magnitude of the forward current I61 by means of the resistor R6, the component 32*e* can be isolated from the fluctuation in the second common potential. It is apparent that the current I61 does not flow but the above-mentioned isolation can be performed if the level input to the buffer B1 is "L".

Figure 48:
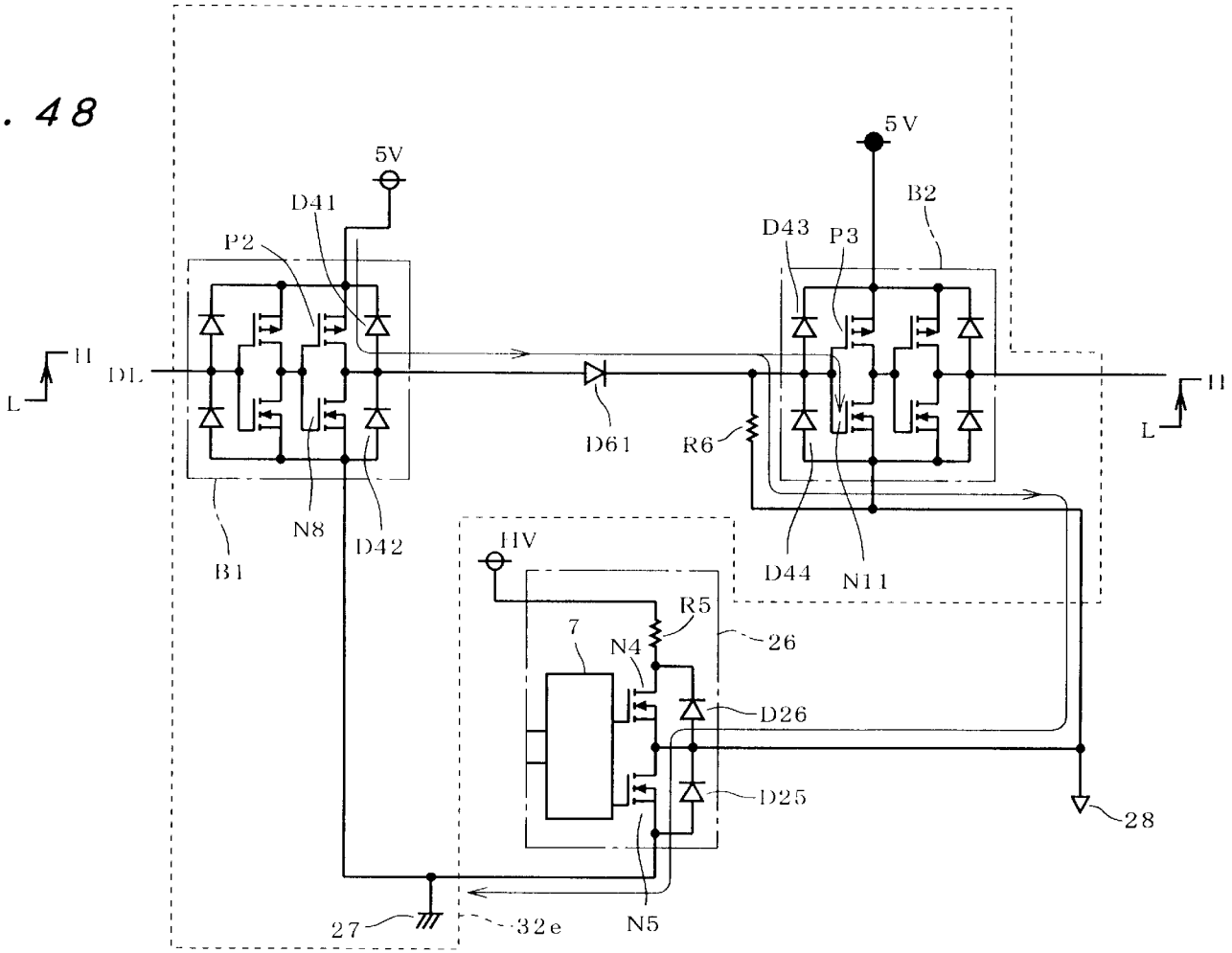

A write discharge sequence is the same as in the first embodiment. FIG. 48 corresponds to FIG. 15 showing the first embodiment, and is a circuit diagram showing a current flow obtained when the data latch signal DL is changed from "L" to "H", for example.

While the NMOS transistors N4 and N5 of the power control circuit 26 are turned off and on respectively, the PMOS transistor P2 and the NMOS transistor N8 of the buffer B1 are turned on and off respectively. Therefore, a current flows from the first 5V power source through the PMOS transistor P2, the diode D61, the resistor R6, the second common potential point 28 and the NMOS transistor N5. By a voltage drop of the resistor R6, an electric potential on the input terminal of the buffer B2 is set to "H" and a level "H" is transmitted.

In this case, a microcurrent I71 flows so that a gate electrode of the NMOS transistor N11 is charged.

Figure 49:
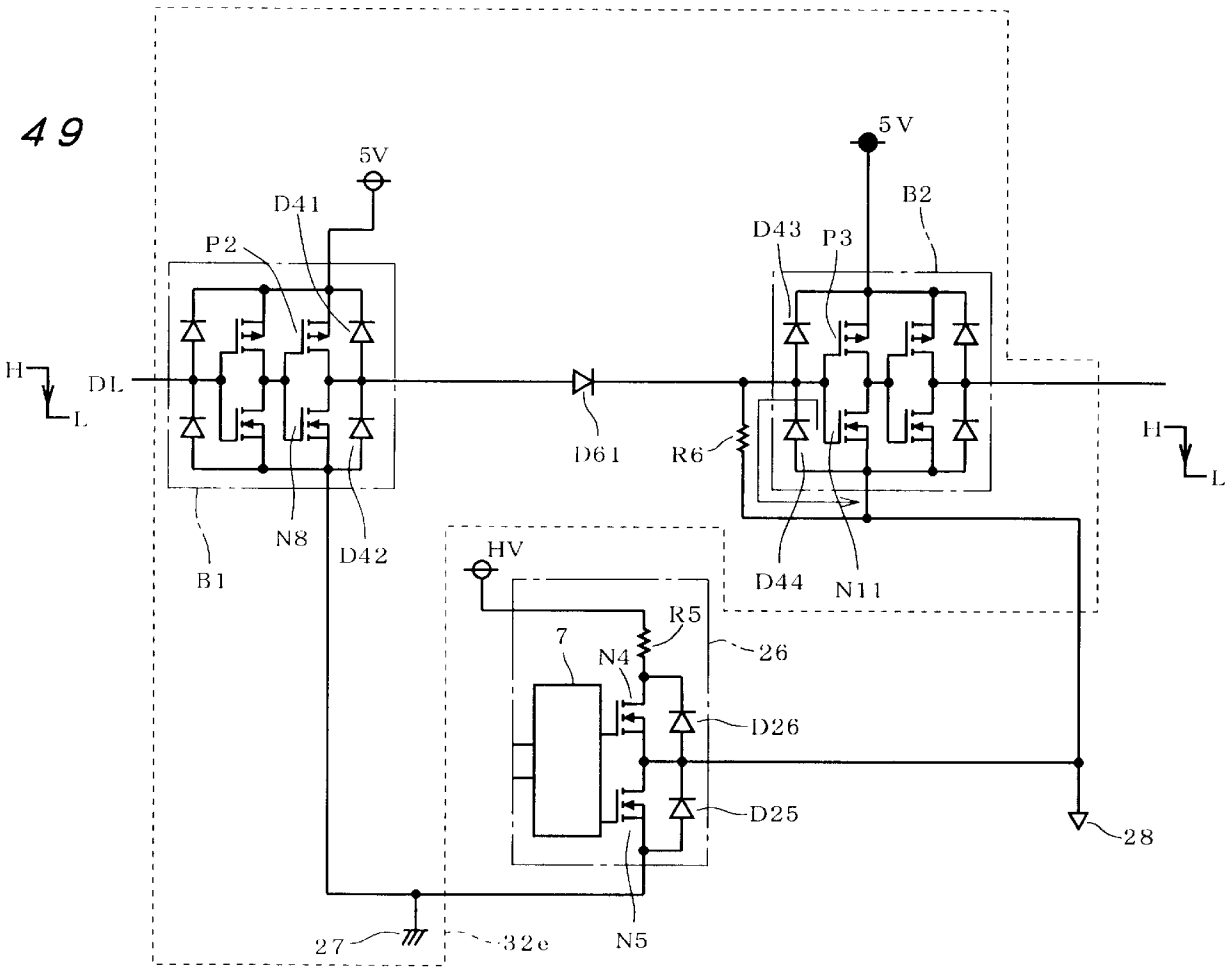

FIG. 49 corresponds to FIG. 16 showing the first embodiment, and is a circuit diagram illustrating a current flow obtained when the data latch signal DL is changed from "L" to "H", for example.

The PMOS transistor P2 and the NMOS transistor N8 of the buffer B1 are turned off and on, respectively. Therefore, the diode D61 is reversibly biased so that less current flows. Accordingly, a voltage drop is not caused in the resistor R6 but the first common potential (ground potential) is applied to the buffer B2 through the second common potential point 28 and a level "L" is transmitted.

The gate electrode of the NMOS transistor N1 which is charged as shown in FIG. 48 is discharged through the resistor R6. Accordingly, a transition speed of the level depends on an input capacity of the buffer B2 and the resistor R6. Therefore, it is desirable that a value of the resistor R6 should be set according to a frequency of an input signal.

While the output enable signal EN is set to "H" and is brought into an inactive state for a sustain discharge period in the present embodiment, the drive data, the clock signal CLK and the data latch signal DL may be undefined in the same manner as for the write preparation period. The reason is that the capacitor C3 does not need to be discharged.

H. Seventh Embodiment

In the first to fifth embodiments, in the case where the level of the signal input to the buffer B1 is changed from "L" to "H" to discharge the capacitor C3 (FIGS. 15, 22, 31, 39 and 48), the first 5V potential is supplied from the output terminal of the buffer B1, while the second common potential is equal to the first common potential. Therefore, the second 5V potential which is equal to the first 5V potential is also applied to the cathodes of the diodes D33 and D43. Accordingly, the electric potential on the terminal E2 of the capacitor C3 is higher than that on the terminal E1 by a forward voltage supported by the diodes D21 and D33 (or furthermore D43), and the terminal E2 of the capacitor C3 is slightly charged correspondingly. The present embodiment will describe a technique in which such a slight charge is also avoided.

Figure 50:
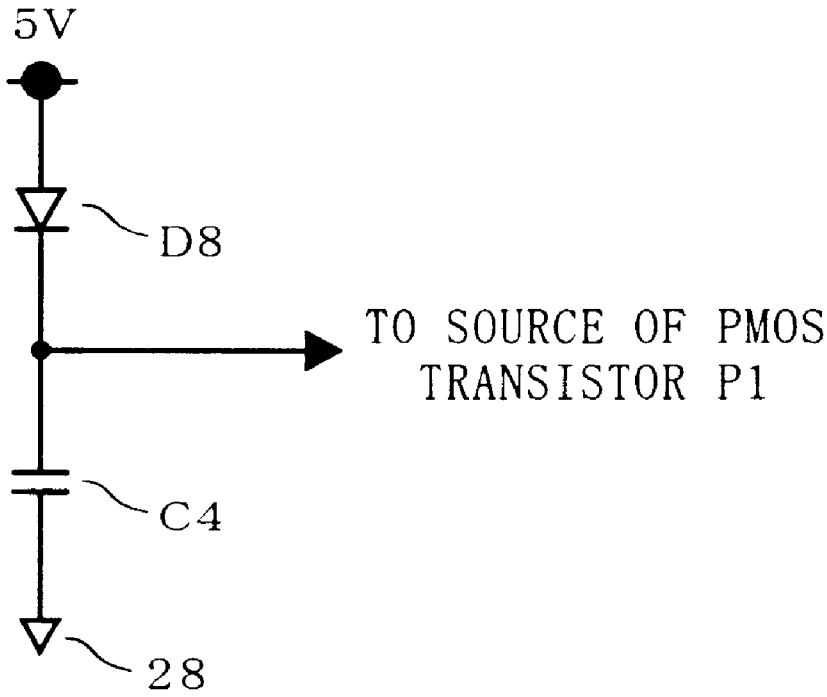
FIG. 50 is a circuit diagram showing a structure according to a seventh embodiment of the present invention.

FIG. 50 is a circuit diagram showing a structure of a voltage source for supplying an electric potential onto the high arm side of the power control circuit 24, that is, to the source of the PMOS transistor P1. An anode of a diode D8 is connected to the second 5V power source, and a capacitor C4 is connected between a cathode of the diode D8 and the second common potential point 28. An electric potential is supplied from a node of the capacitor C4 and the cathode of the diode D8 to the source of the PMOS transistor P1. The circuit is designed such that a forward voltage of the diode D8 is the sum of forward voltages of the diodes D21 and D33.

An electric potential which is lower than the second 5V potential by the forward voltage of the diode D8 is supplied to the source of the PMOS transistor P1. Therefore, the electric potential on the terminal E2 of the capacitor C3 is reduced down to the second 5V potential, that is, the first 5V potential so that the capacitor C3 can completely be discharged. A discharging current flowing in this case, for example, the current I102 shown in FIG. 15 flows to the second electric potential point 28 through the capacitor C4.

In the operation according to the present embodiment, the second common potential is equal to the first common potential. Therefore, the first common potential point 27 may be connected to the capacitor C4 and the first 5V potential may be connected to the anode of the diode D8.

I. Eighth Embodiment

Figure 51:
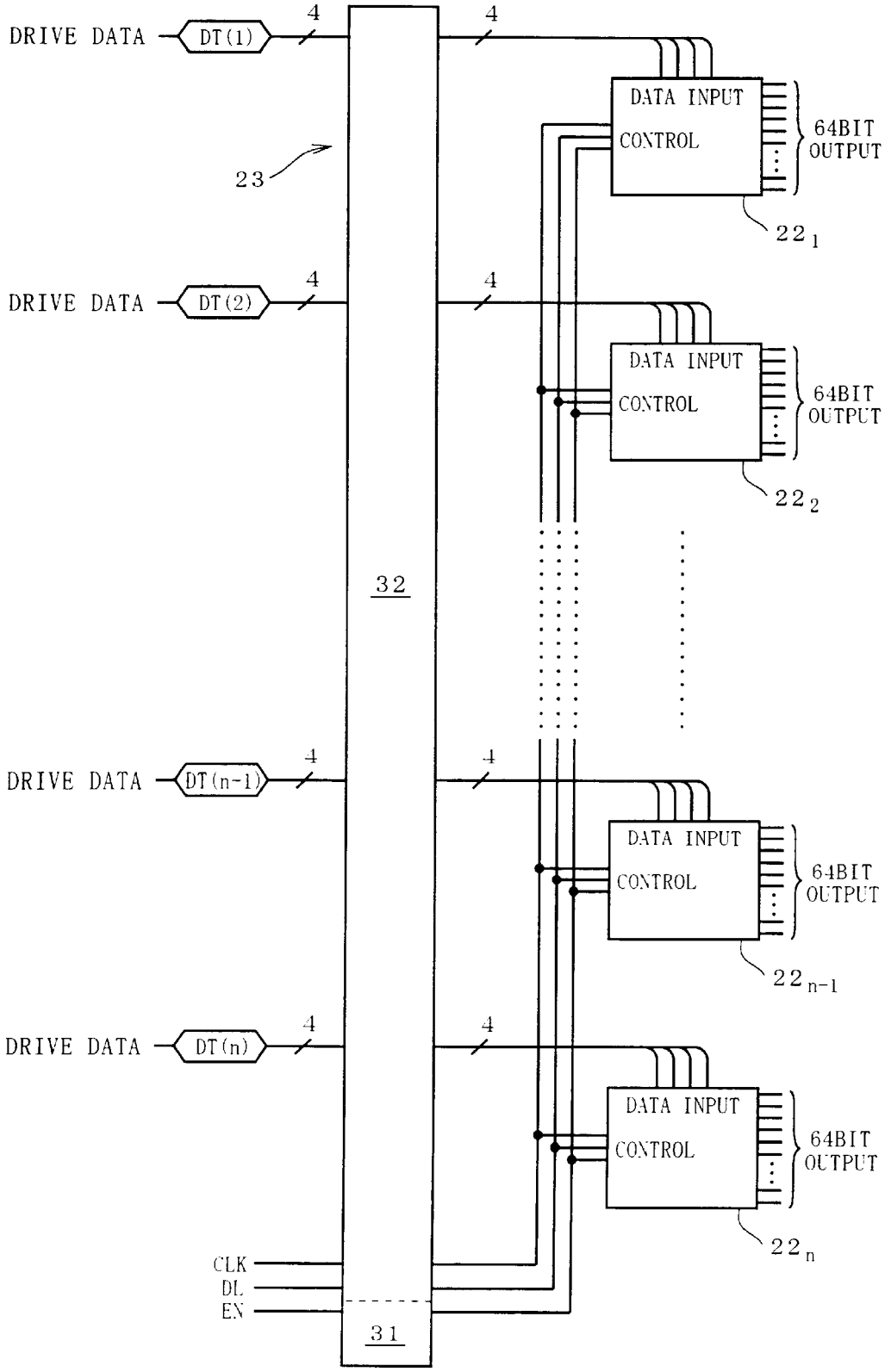
FIGS. 51 and 52 are circuit diagrams showing a structure according to an eighth embodiment of the present invention.

FIG. 51 is a circuit diagram showing a relationship between the drive circuit $\mathbf{22}_i$ and various signals given thereto through the isolation circuit 23. For example, in order to cope with a VGA specification, thirty drive circuits $\mathbf{22}_i$ are required as described in the first embodiment. Two control signals other than the output enable signal EN transmitted through the photocoupler PC in the part 31, that is, the clock signal CLK and the data latch signal DL are transmitted through the capacitor C3 in the part 32. These control signals are transmitted to each of the drive circuits $\mathbf{22}_i$ in common, and 4-bit drive data DT (1) to DT (n) are transmitted to each of the drive circuits $\mathbf{22}_i$ through the capacitor C3 in parallel. Finally, the number of the components 32*a* (or 32*b* to 32*e*) to be required is 30×4+2=122 in order to cope with the VGA specification. However, the number can be reduced as follows.

Figure 52:
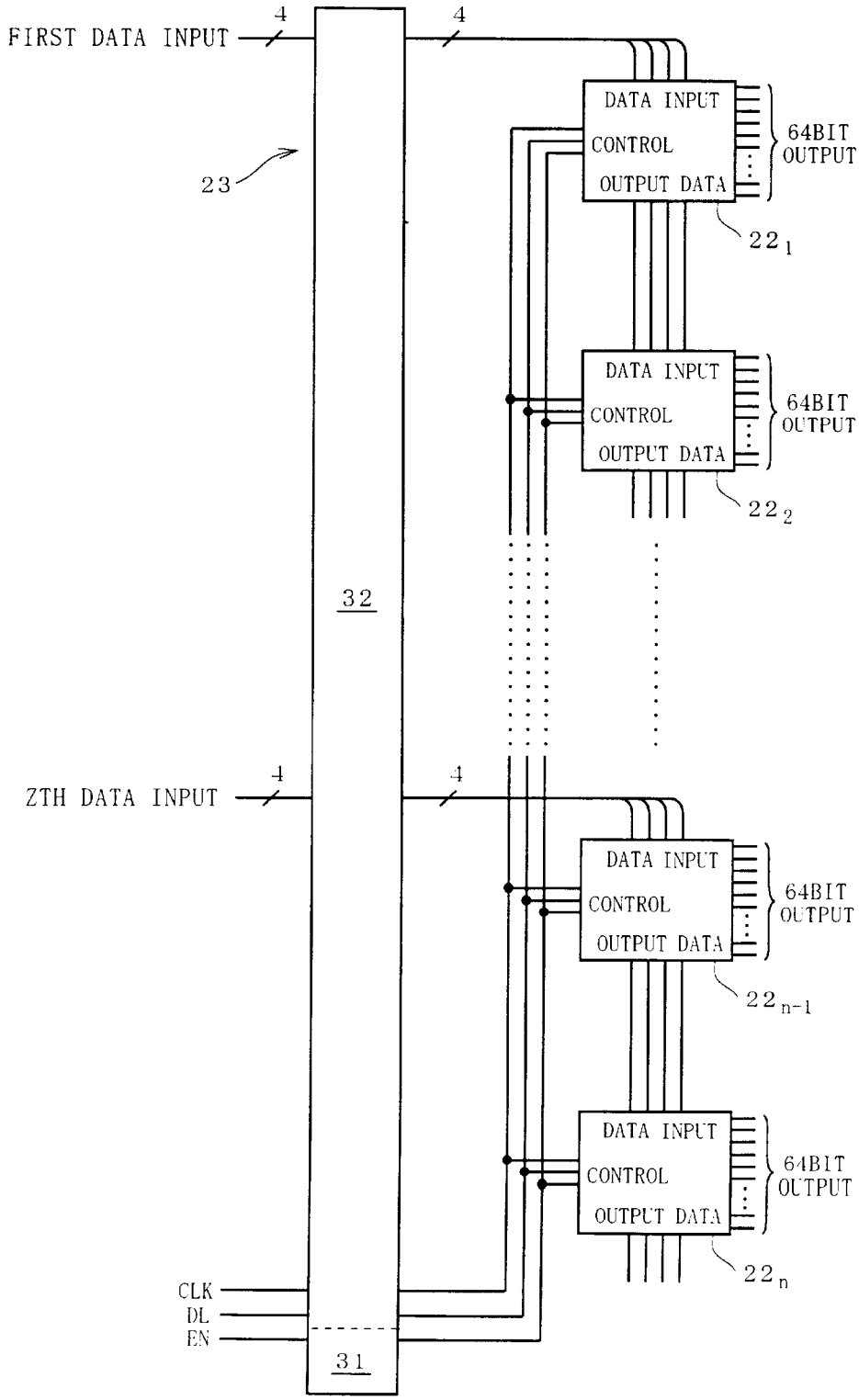
Figure 53:
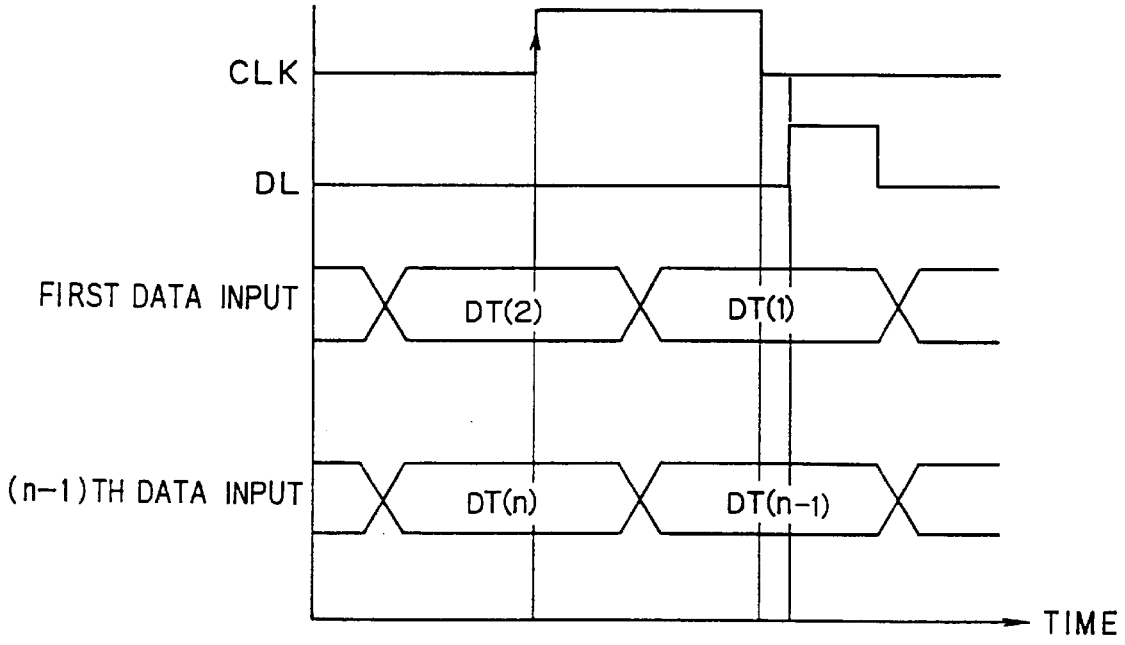
FIG. 53 is a timing chart showing operation according to the eighth embodiment of the present invention.

FIG. 52 is a circuit diagram showing the case where the drive circuit $\mathbf{22}_i$ has a serial input-output shift register built therein, and FIG. 53 is a timing chart showing a state in which drive data is input in the circuit of FIG. 52 (a delay in the isolation circuit 23 is ignored).

A 4-bit data output of an odd-numbered drive circuit $\mathbf{22}_{(2s-1)}$ is given to a 4-bit data input of an even-numbered drive circuit $\mathbf{22}_{2s}$ (s=1, 2, . . . z; z=n/2 if n is an even number, and z=(n−1)/2 if n is an odd number. In FIG. 52, n is an even number.) Since the drive circuit $\mathbf{22}_i$ has the serial input-output shift register, the 4-bit data input given thereto is output (shifted out) as its own data output synchronously with a rise (or fall) of the clock signal CLK. μPD16327 manufactured by NEC has such a register built therein.

Accordingly, 4-bit drive data DT (2s) for the even-numbered drive circuit $\mathbf{22}_{2s}$ and 4-bit drive data DT (2s−1) for the odd-numbered drive circuit $\mathbf{22}_{(2s-1)}$ are sequentially given to a 4-bit data input for the odd-numbered drive circuit $\mathbf{22}_{(2s-1)}$. Also in order to cope with the VGA specification, the number of the components 32*a* to be required is 30×4/2+2=62.

Of course, the number of the drive circuits $\mathbf{22}_i$ for transferring 4-bit data by the serial input-output shift register of the drive circuit $\mathbf{22}_i$ is not restricted to two but can be generally set to L (≧2). If L is greater, a frequency of the clock signal CLK should be increased (to L/2 times or more as high as the frequency of the data latch signal DL). It is desirable that a capacitance of the capacitor C3 in the component 32*a* (or 32*b* to 32*d*) should be small in order to shorten charging and discharging periods to increase isolation effects. If the capacitance of the capacitor C3 is small, operation is more stabilized during transfer if a frequency of a signal to be transferred through the capacitor C3 is higher. In respect of the operation of the isolation circuit 23, accordingly, it is desirable that L should be increased to raise the frequency of the clock signal CLK.

Figure 54:
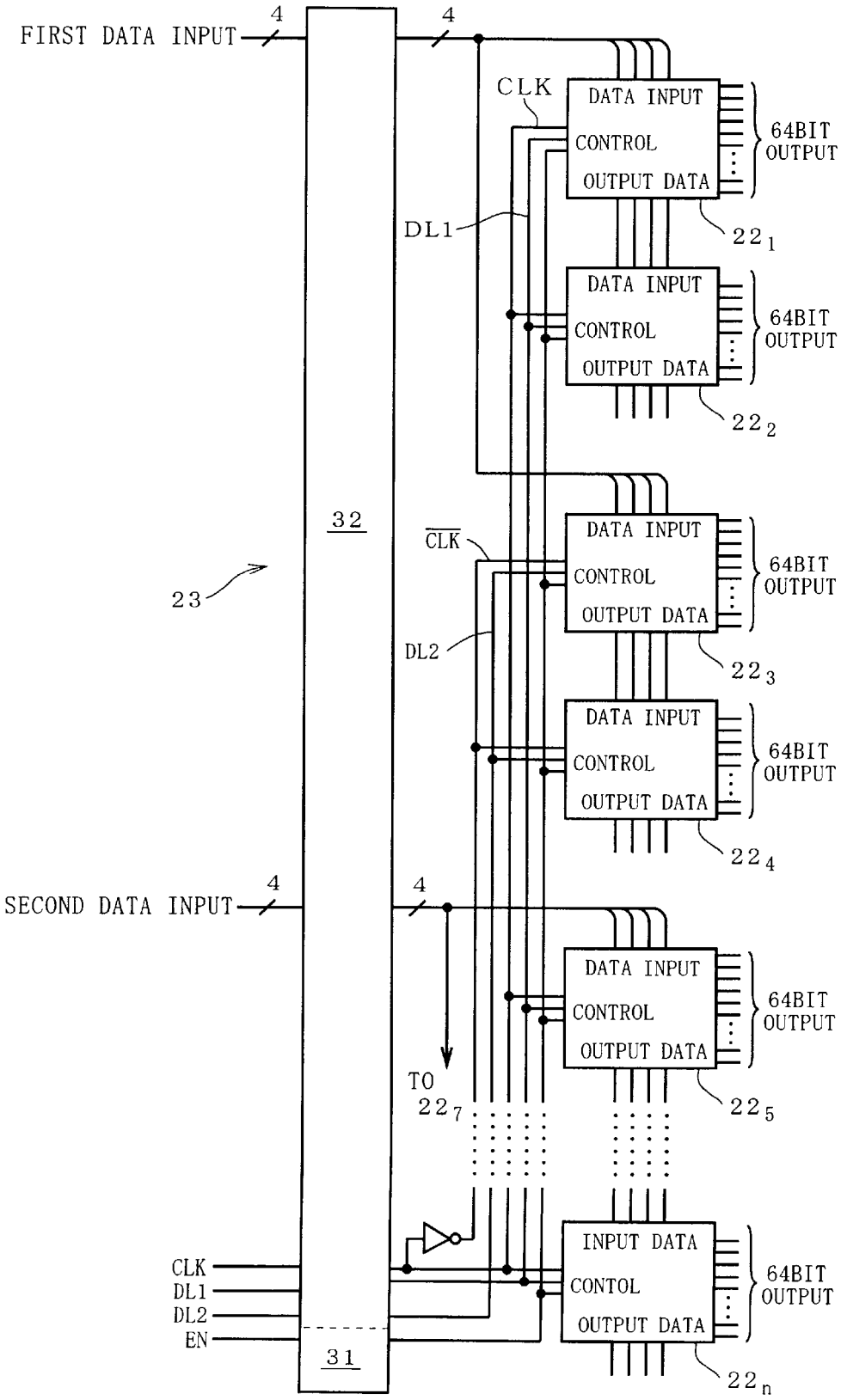
FIG. 54 is a circuit diagram showing the structure according to the eighth embodiment of the present invention.
Figure 55:
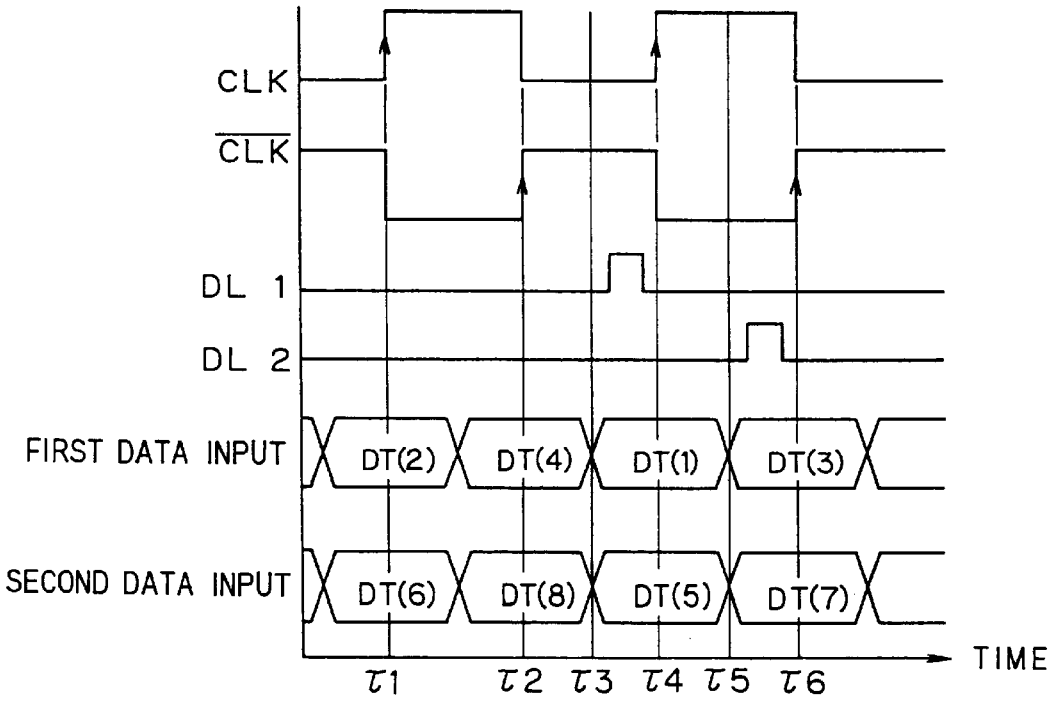
FIG. 55 is a timing chart showing the operation according to the eighth embodiment of the present invention.

However, the number of the components 32*a* (or 32*b* to 32*e*) can further be reduced with the frequency of the clock signal CLK kept as it is. FIG. 54 is a circuit diagram showing the case where a set of four drive circuits $\mathbf{22}_i$ receive drive data transfer, and FIG. 55 is a timing chart showing a state in which the drive data is input in the circuit of FIG. 54 (a delay in the isolation circuit 23 is ignored).

The serial input-output shift register operates synchronously with the rise (or fall) of the clock signal CLK. Therefore, if L=2 is set, for example, the highest frequency of a signal to be transferred in the isolation circuit 23 is ½ of the frequency of the clock signal CLK. An inverted signal bar CLK of the clock signal CLK is generated, and a 4-bit input is time-shared by a pair of drive circuits $\mathbf{22}_i$ (for example, drive circuits $\mathbf{22}_1$ and $\mathbf{22}_2$) in which the drive data is shifted by the clock signal CLK and a pair of drive circuits $\mathbf{22}_i$ (for example, drive circuits $\mathbf{22}_3$ and $\mathbf{22}_4$) in which the drive data is shifted by the inverted signal bar CLK.

First of all, 4-bit drive data DT (2) for the drive circuit $\mathbf{22}_2$ is transferred as a first data input to the isolation circuit 23. The drive data is shifted from the drive circuit $\mathbf{22}_1$ to the drive circuit $\mathbf{22}_2$ synchronously with the rise of the clock signal CLK at a time τ1. Next, 4-bit drive data DT (4) for the drive circuit $\mathbf{22}_2$ is transferred as the first data input to the isolation circuit 23, and is shifted from the drive circuit $\mathbf{22}_3$ to the drive circuit $\mathbf{22}_4$ synchronously with the rise of the inverted signal bar CLK at a time τ2. Furthermore, 4-bit drive data DT (1) for the drive circuit $\mathbf{22}_1$ is transferred as the first data input to the isolation circuit 23 at a time τ3, and a first data latch signal DL1 is set to "H" before a time τ4 at which the clock signal CLK rises so that the 4-bit drive data DT (1) and DT (2) are latched onto the drive circuits $\mathbf{22}_1$ and $\mathbf{22}_2$, respectively. At a time τ5 furthermore, the 4-bit drive data DT (3) for the drive circuit $\mathbf{22}_3$ is transferred to the isolation circuit 23. Then, a second data latch signal DL2 is set to "H" before a time τ6 at which the inverted signal bar CLK rises. Consequently, the 4-bit drive data DT (3) and DT (4) are latched onto the drive circuits $\mathbf{22}_3$ and $\mathbf{22}_4$, respectively.

Referring to a second data input, similarly, 4-bit drive data DT (6) for a drive circuit $\mathbf{22}_6$, 4-bit drive data DT (8) for a drive circuit $\mathbf{22}_8$, 4-bit drive data DT (5) for a drive circuit $\mathbf{22}_5$ and 4-bit drive data DT (7) for a drive circuit $\mathbf{22}_7$ are transferred in this order.

In the VGA specification, the number of the drive circuits $\mathbf{22}_i$ is thirty, the number of 4-bit inputs required for the drive circuits $\mathbf{22}_1$ to $\mathbf{22}_{28}$ is 28/4=7, and the number of 4-bit inputs required for the drive circuits $\mathbf{22}_{29}$ and $\mathbf{22}_{30}$ is one. Therefore, (8×4=32) components 32*a* (or 32*b* to 32*e*) are required for the drive data. Furthermore, since the component 32*a* is required for the clock signal CLK and the first and second data latch signals DL1 and DL2 which act as the control signals (the inverted signal bar CLK may take inversion of the clock signal CLK transferred through the isolation circuit 23), thirty-five components 32*a* are finally enough.

While the present invention has been described in detail, the above description is illustrative in all aspects and the present invention is not restricted thereto. It will be understood that numerous variants which are not illustrated can be supposed without departing from the scope of the invention.

What is claimed is:

1. An apparatus for driving an address electrode for a surface discharge type plasma display panel having a plurality of scan electrodes, a plurality of address electrodes which are orthogonal to the scan electrodes, and a display cell formed on each of intersecting points of the scan electrodes and the address electrodes, comprising:

a plurality of drive circuits including a first number of output stages, each output stage having an output terminal provided corresponding to each of the address electrodes and connected thereto, and a first input terminal and a second input terminal, one of which is selectively connected to the output terminal;

a first power control circuit for supplying, to the second input terminal, one of a reference potential and a first electric potential which is higher than the reference potential; and a second power control circuit for supplying, to the first input terminal, a second electric potential which is lower than the first electric potential and is higher than the reference potential or connecting the first input terminal to the second input terminal.

2. The address electrode driving apparatus according to claim 1, further comprising:

a control circuit for outputting drive data which serves to set the output terminal of the drive circuit to be connected to the first input terminal or the second input terminal, and a plurality of transmitting circuits provided corresponding to each of the address electrodes for transmitting the drive data for the corresponding address electrodes, each of the transmitting circuits including:

a first buffer having an input terminal for inputting the drive data and an output terminal for transmitting the drive data, being connected to a first reference potential point for supplying the reference potential and a first electric potential point for supplying a first source potential which is higher than the reference potential and is lower than the second electric potential, and receiving operating power therefrom;

a capacitor having one of terminals connected to the output terminal of the first buffer and the other terminal, and a second buffer having an input terminal connected to the other terminal of the capacitor and an output terminal connected to a corresponding one of the drive circuits, being connected to the second input terminal and a second electric potential point, and receiving operating power therefrom.

3. The address electrode driving apparatus according to claim 2, wherein each of the drive circuits further includes:

a protective diode having a cathode connected to a corresponding one of the address electrodes and an anode connected to the second input terminal.

4. The address electrode driving apparatus according to claim 3, comprising a third electric potential point to be connected to one of a fourth electric potential point to which a second source potential is supplied and the second input terminal, each of the transmitting circuits including:

a first diode an anode connected to the first reference potential point and a cathode connected to the terminal of the capacitor; and a second diode having an anode connected to the other terminal of the capacitor and a cathode connected to the third electric potential point, and the second buffer further including:

a protective diode having a cathode connected to the other terminal of the capacitor and an anode connected to the second input terminal.

5. The address electrode driving apparatus according to claim 4, wherein the second electric potential point is the third electric potential point.

6. The address electrode driving apparatus according to claim 4, wherein the second electric potential point is the forth electric potential point.

7. The address electrode driving apparatus according to claim 4, wherein each of the transmitting circuits further includes:

a third diode having an anode connected to the terminal of the capacitor and a cathode connected to the first electric potential point, and a fourth diode having an anode connected to the second input terminal and a cathode connected the other terminal of the capacitor.

8. The address electrode driving apparatus according to claim 7, wherein the second electric potential point is the third electric potential point.

9. The address electrode driving apparatus according to claim 7, wherein the second electric potential point is the fourth electric potential point.

10. The address electrode driving apparatus according to claim 4, wherein the first buffer further includes a protective diode having an anode connected to the terminal of the capacitor and a cathode connected to the first electric potential point.

11. The address electrode driving apparatus according to claim 4, further comprising:

a diode having an anode connected to the fourth electric potential point and a cathode; and a capacitor connected between the cathode of the diode and a second reference potential point acting as a reference of a second source potential to be applied to the fourth electric potential point, wherein the third electric potential point is connected to the fourth electric potential point through the diode.

12. The address electrode driving apparatus according to claim 2, further comprising:

a control circuit for outputting drive data which serves to set the output terminal of the drive circuit to be connected to the first input terminal or the second input terminal; and a plurality of transmitting circuits provided corresponding to each of the address electrodes for transmitting the drive data for the corresponding address electrodes, each of the transmitting circuits including:

a first buffer having an input terminal for inputting the drive data and an output terminal for transmitting the drive data, being connected to a first reference potential point for supplying the reference potential and a first electric potential point for supplying a first source potential which is higher than the reference potential and is lower than the second electric potential, and receiving operating power therefrom;

a diode having an anode connected to the output terminal of the first buffer and a cathode; and a second buffer having an input terminal connected to the cathode of the diode and an output terminal connected to a corresponding one of the drive circuits, being connected to the second input terminal and a second electric potential point, and receiving operating power therefrom.

13. The address electrode driving apparatus according to claim 12, wherein each of the transmitting circuits further includes a resistor provided between the cathode of the diode and the second input terminal.

14. The address electrode driving apparatus according to claim 2, wherein the drive circuits further include a second number of data input terminals for inputting the second number of drive data, and the second number of data output terminals for shifting out data given to the data input terminals, and a third number of drive circuits make a set and are connected in series with respect to the data input terminals and the data output terminals.

15. The address electrode driving apparatus according to claim 14, wherein the set of drive circuits have a timing in which the drive data is shifted out from the data input terminal to the data output terminal and a timing in which the drive data given to the data input terminal is latched, the timings being divided into two classes which are different from each other.

16. The address electrode driving apparatus according to claim 1, wherein the surface discharge type plasma display panel further includes a plurality of other scan electrodes which are orthogonal to the address electrodes, and a predetermined electric potential is applied to the scan electrodes through a pair of diodes connected in anti-parallel with each other.

17. An address electrode driving method for a surface discharge type plasma display panel, for a plasma display system comprising:

a surface discharge type plasma display panel including a plurality of scan electrodes, a plurality of address electrodes which are orthogonal to the scan electrodes, and a display cell formed on each of intersecting points of the scan electrodes and the address electrodes;

a plurality of drive circuits including a first number of output stages, each output stage having an output terminal provided corresponding to each of the address electrodes and connected thereto, and a first input terminal and a second input terminal, one of which is selectively connected to the output terminal;

a plurality of drive circuits provided corresponding to the address electrodes, each of which has an output terminal connected to a corresponding one of the address electrodes and a first input terminal and a second input terminal, one of which is selectively connected to the output terminal;

a control circuit for outputting drive data which serves to set the output terminal of the drive circuit to be connected to the first input terminal or the second input terminal;

a first power control circuit for supplying, to the second input terminal, one of a reference potential and a first electric potential which is higher than the reference potential;

a second power control circuit for supplying, to the first input terminal, a second electric potential which is lower than the first electric potential and is higher than the reference potential, or for connecting the first input terminal to the second input terminal;

a first buffer having an input terminal provided corresponding to the address electrodes for inputting the drive data for the corresponding address electrodes, an output terminal for transmitting the drive data, and an output stage having a push-pull structure which is connected in series between a first reference potential point for supplying the reference potential and a first electric potential point for supplying a first source potential which is higher than the reference potential and is lower than the second electric potential;

a capacitor having one of terminals connected to the output terminal of the first buffer and the other terminal;

a second buffer an input terminal connected to the other terminal of the capacitor, an output terminal connected to a corresponding one of the drive circuits, and an input stage having a push-pull structure which is connected in series between the second input terminal and a second electric potential point;

a first diode having an anode connected to the first reference potential point and a cathode connected to the terminal of the capacitor; and a second diode a cathode connected to the second electric potential point and an anode connected to the other terminal of the capacitor, the method comprising the steps of:

for a write preparation period, connecting the second electric potential point to the second input terminal;

connecting the first input terminal to the second input terminal by the second power control circuit; and supplying the first electric potential to the second input terminal by the first power control circuit, and then supplying the reference potential, for a write discharge period, connecting the second input terminal to the first reference potential point by the first power control circuit;

supplying the first source potential to the second electric potential point;

supplying the second electric potential to the first input terminal by the second power control circuit; and connecting an output terminal of each of the drive circuits to one of the first input terminal and the second input terminal based on the drive data, and after the write discharge period and before a sustain discharge period, connecting the second input terminal to the first reference potential point by the first power control circuit;

connecting the second electric potential point the second input terminal;

connecting the first input terminal to the second input terminal by the second power control circuit; and forcedly setting the drive data to a reference potential.

18. The address electrode driving method according to claim 17, further comprising the step of:

(a-4) forcedly setting the drive data to "H" prior to the step (a-3) for the write preparation period.

19. The address electrode driving method according to claim 18, further comprising the step of:

(d) forcedly setting the drive data to "L" after the write preparation period and before the write discharge period.

20. An address electrode driving method, for a plasma display system comprising:

a surface discharge type plasma display panel including a plurality of scan electrodes, a plurality of address electrodes which are orthogonal to the scan electrodes, and a display cell formed on each of intersecting points of the scan electrodes and the address electrodes;

a plurality of drive circuits including an output terminal provided corresponding to each of the address electrodes and connected to a corresponding one of the address electrodes, and a first input terminal and a second input terminal, one of which is selectively connected to the output terminal;

a control circuit for outputting drive data which serves to set the output terminal of the drive circuit to be connected to the first input terminal or the second input terminal;

a first power control circuit for supplying one of a reference potential and a first electric potential which is higher than the reference potential to the second input terminal; and a second power control circuit for supplying, to the first input terminal, a second electric potential which is lower than the first electric potential and is higher than the reference potential or connecting the first input terminal to the second input terminal, a first buffer having an input terminal provided corresponding to each of the address electrodes for inputting the drive data for the corresponding address electrodes, an output terminal for transmitting the drive data, and an output stage having a push-pull structure which is connected in series between a first reference potential point for supplying the reference potential and a first electric potential point for supplying a first source potential that is higher than the reference potential and is lower than the second electric potential;

a diode having an anode connected to the output terminal of the first buffer and a cathode;

a second buffer having an input terminal connected to the cathode of the diode, an output terminal connected to a corresponding one of the drive circuits, and an input stage having a push-pull structure which is connected in series between the second input terminal and a second electric potential point; and resistor connected to the second input terminal and the input terminal of the second buffer, the method comprising the steps of:

(a) for a write preparation period, (a-1) connecting the first input terminal to the second input terminal by the second power control circuit; and (a-2) supplying the first electric potential to the second input terminal by the first power control circuit, and then supplying the reference potential;

(b) for a write discharge period, (b-1) connecting the second input terminal to the first reference potential point by the first power control circuit;

(b-2) supplying the second electric potential to the first input terminal by the second power control circuit; and (b-3) connecting the output terminals of the drive circuits to one of the first input terminal and the second input terminal based on the drive data, and (c) after the write discharge period and before a sustain discharge period, (c-1) connecting the second input terminal to the first reference potential point by the first power control circuit; and (c-2) connecting the first input terminal to the second input terminal by the second power control circuit.

* * * * *